US005407302A

United States Patent [19]

Springett et al.

[11] Patent Number: 5,407,302

[45] Date of Patent: Apr. 18, 1995

[54] METHOD AND APPARATUS FOR SKID-OFF DRILLING

[75] Inventors: Charles N. Springett, Santa Ana, Calif.; Robert O. Hinton, London, England; Peter W. Braddick, Fullerton; Roger A. Greenland, Chino Hills, both of Calif.

[73] Assignee: Santa Fe International Corp., Dallas, Tex.

[21] Appl. No.: 16,604

[22] Filed: Feb. 11, 1993

[51] Int. Cl.[6] ..... E02B 17/04

[52] U.S. Cl. ..... 405/196; 405/201; 405/204; 405/209

[58] Field of Search ..... 405/195.1, 203, 209, 405/196, 201, 204, 224, 224.2

[56] References Cited

U.S. PATENT DOCUMENTS

| | | |
|---|---|---|
| 3,001,594 | 9/1961 | Suderow . |
| 3,033,525 | 5/1962 | Johnson . |
| 3,201,945 | 8/1965 | Sutton . |
| 3,433,024 | 3/1969 | Diamond et al. . |
| 3,474,629 | 10/1969 | Woodson . |
| 3,477,235 | 11/1969 | Branham et al. . |
| 3,575,005 | 4/1971 | Sumner . |
| 3,716,993 | 2/1973 | Sumner . |
| 3,740,957 | 6/1973 | McKenzie . |
| 3,931,778 | 1/1976 | Miller et al. . |
| 4,065,934 | 1/1978 | Dysarz . |
| 4,103,503 | 8/1978 | Smith . |
| 4,269,542 | 5/1981 | Mueller . |
| 4,583,881 | 4/1986 | Steele . |
| 4,602,894 | 7/1986 | Lorenz et al. . |
| 4,735,526 | 4/1988 | Kawagoe et al. . |
| 4,907,912 | 3/1990 | Smith . |
| 4,938,628 | 7/1990 | Ingle . |
| 4,973,198 | 11/1990 | Cox . |
| 5,032,040 | 7/1991 | Ingle . |
| 5,052,860 | 10/1991 | Ingle . |
| 5,139,367 | 8/1992 | Ingle . |

FOREIGN PATENT DOCUMENTS

PCT/US91/-
08299 11/1991 .

OTHER PUBLICATIONS

IADC/SPE 23855 (1992), "The Design Approach, Operational Performance, and Future Prospects For Self-Erecting Semisubmersible Tender Drilling," by Nagel, Knecht and Jackson of Off-Shore Co.

IADC/SPE 19978 (1990), "Jackups for the Nineties: What Should The Industry Expect?," by Springett of Santa Fe Drilling Co.

SPE/IADC 21980 (1991), "Cost-Saving Applications of Harsh Environment Jackups and Associated Contracting Philosophy Implications," by Hinton of Santa Fe Drilling Co.

"Skid-off rigs add to drilling options," *Ocean Industry*, pp. 25-28 (Oct. 1990).

"'Semi tender' idea works," *Drilling Contractor*, pp. 15-17 (Oct. 1992).

*Primary Examiner*—David H. Corbin

*Attorney, Agent, or Firm*—Pretty, Schroeder, Brueggemann & Clark

[57] ABSTRACT

A different approach to tender assisted drilling which has the flexibility to be used with multiple jack-up rigs, and nearly any type of fixed offshore production platform. A skid base includes distinct capping beam feet and skid-off feet, the former adjustable to capping beam spacing and the latter restricted to support of the skid base upon cantilever beams. A special swivel mechanism and sliding mounting in the capping beam feet, and a vertical jack in the aft skid-off feet, enable the skid base to be transferred to the fixed platform simply by aligning them over the capping beams and depressurizing the skid-off feet. Thus, walking mechanisms may be swivelled and oriented upon the capping beams, notwithstanding relative movement between the jack-up rig and the platform. The skid base is simply walked across from the cantilever beams to the platform. The drill floor package is installed onto the skid base by raising and locking the cantilever beams into alignment with the skid base, while the skid base remains in a floating condition upon the fixed platform, and by skidding the drill floor package atop the skid base. The skid base may then be uncoupled from the cantilever and aligned with the platform using the walking and swivel mechanisms and the sliding mountings of the capping beam feet. Longitudinal and transverse movement abilities of the drill floor permit tender-assist drilling upon a variety of precise locations of the platform, and is readily supported from the jack-up rig with the aid of modular piping.

24 Claims, 24 Drawing Sheets

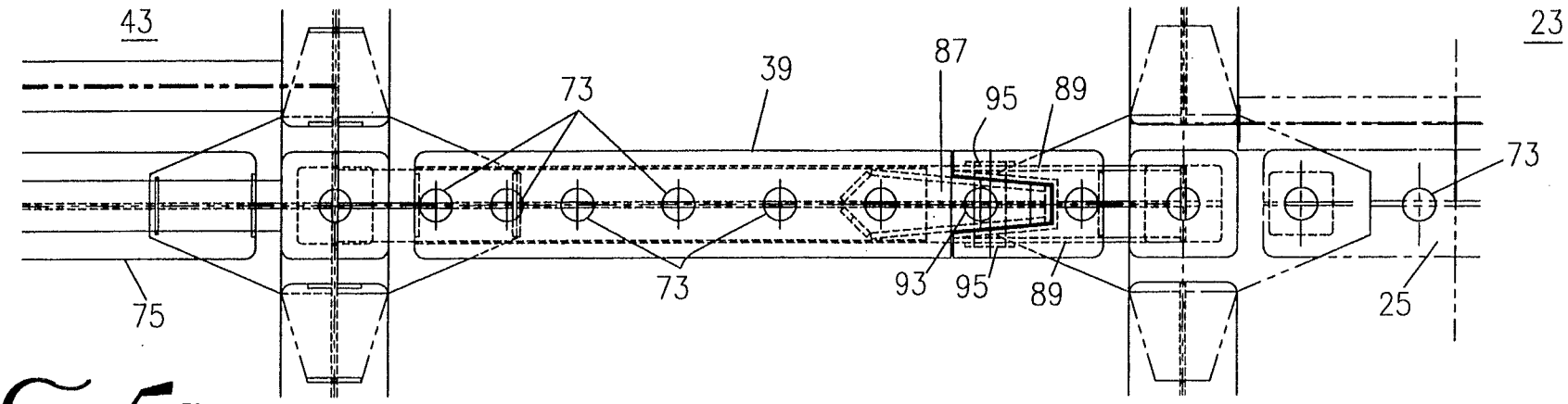
Fig. 5a
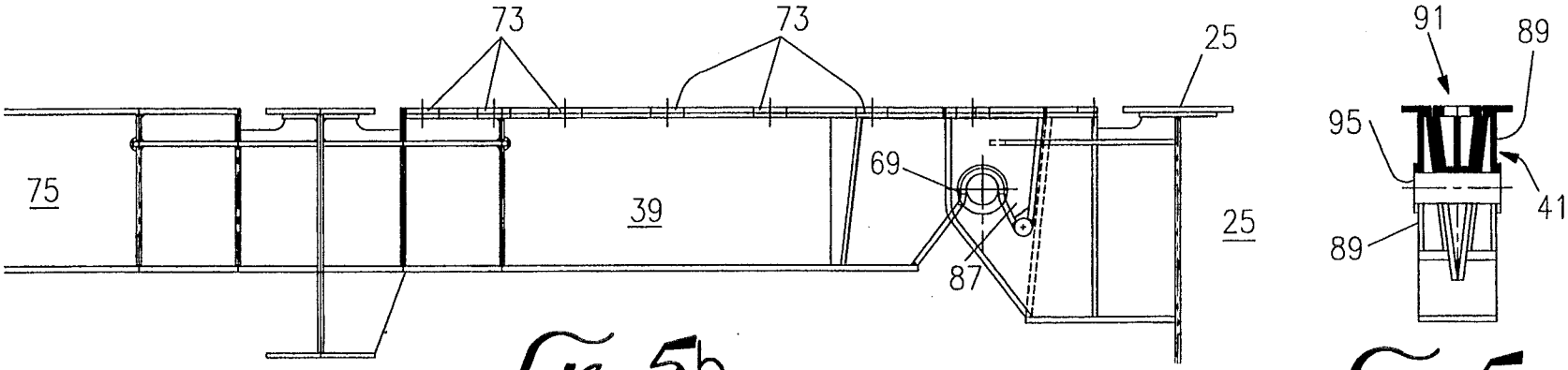
Fig. 5b
Fig. 5c

METHOD AND APPARATUS FOR SKID-OFF DRILLING

INTRODUCTION

This invention relates to the transport of heavy equipment to and from offshore drilling platforms. For ease of understanding, this description at times may refer to oil or gas drilling. However, it should be understood that the invention described below and as defined by the appended claims applies to any type offshore drilling, and is not limited solely to oil or gas drilling. The present invention provides each of the following: (1) a method of safely loading a drill floor package from a jack-up rig onto an offshore platform; (2) a method of safely loading a drill floor package from an offshore platform onto a jack-up rig; (3) an offshore drilling platform; (4) a skid base used to support the drill floor package; and (5) a foot assembly that supports the skid base.

BACKGROUND

Offshore oil and gas production platforms include fixed platforms supported above the sea surface by fixed legs, dug into the sea floor. These platforms are one mechanism for harvesting oil and gas from wells which have been drilled into fields located beneath the sea floor. Much as with conventional on-shore drilling, these platforms use a derrick and associated equipment to perform the actual drilling operation prior to oil or gas production. Once oil or gas is struck, capping equipment is used to contain the well and to govern removal of the oil for storage,, transportation and refinement. The drill floor package (typically including the derrick, drill floor and substructure) is then no longer needed and consequently, for all but the largest platforms, is removed and used to drill another nearby well or is removed to some other remote location for drilling. In this manner, the same drill floor package can be advantageously used on numerous fixed platforms. When the drill floor package is removed, the fixed platform becomes merely a production platform, no longer having drilling capabilities.

An offshore platform typically includes anywhere from four to forty drilling positions that may be used to drill wells into at least one production field below the sea floor. Consequently, the offshore platform serves as a central collection point for oil and gas obtained from the wells, which may be extend downwardly and outwardly in many directions through the sea floor. The larger the size of the production field, the larger the size of fixed platform used to collect the oil or gas taken from the field.

Typically, an offshore platform is positioned above a promising field in a manner that allows the most efficient drilling of this multiplicity of wells. Thus, the drill floor package and other drilling equipment are generally used over a short span of time to drill a number of proximate wells at a time when the platform is first constructed. However, production requirements and changes in capacity may require the drilling of additional wells at times after the original drilling process has been completed. It is therefore often desirable for the drill floor package to be brought back to the fixed platform, so that additional wells may be drilled to increase the production of oil harvested by the fixed platform, or for other reasons. It is, for example, sometimes desirable that the drill floor package be replaced on the fixed, production platform so that existing wells may be "reworked" to maintain a desired level of production.

As an alternate method to assembling the drill floor package (which may weigh as much as three-million pounds and extend one-hundred and fifty feet into the air) directly upon the upper surface of the platform, a floatable vessel, called a "jack-up rig" may also be used to drill the wells for the fixed platform. The jack-up rig, after completion of the drilling operation, is towed to other locations to provide other drilling services.

The jack-up rig is essentially a mobile drilling facility having everything necessary to support drilling operations, including crew facilities, storage tanks for fluid supply and storage, a derrick, and some drilling support equipment, such as well control equipment and the like. Roughly shaped like the home plate of a baseball diamond, the jack-up rig mounts three downwardly extendable legs which it extends into the sea floor in order to lift its hull above the surface of the water to perform the actual drilling, significantly insulated from the effect of wind and waves. When the rig is floating, the downwardly extendable legs may be moved with respect to the rig. When the legs are resting upon the sea floor, the hull may be moved with respect to the legs, above the surface of the water. Jack-up rigs are generally either used to perform exploration drilling or to perform production drilling over a fixed platform.

The design of early jack-up rigs evolved into what is commonly known as a "slot-type" jack-up rig. These rigs feature a derrick that movably overlies a slot existing in the aft end of the jack-up rig. Typically, the slot is sufficiently large that the jack-up rig may be positioned about a small fixed platform, which is entirely engulfed within the slot. The hull of the jack-up rig is then elevated so that the hull of the rig is raised above the fixed platform, and the derrick is moved over the slot to drill a limited number of wells through the slot and the fixed platform.

In recent decades, however, the tendency has been for fixed, offshore platforms to grow in size. Primarily, these larger platforms are used for production drilling of larger fields in relatively deeper waters, and are needed to withstand the more extreme weather and wave conditions that exist in that environment. In addition, the larger platforms are also able to sustain a larger number of well positions, corresponding to larger field size. With these large platforms, drilling equipment, including the drill floor package, may be permanently stationed upon the fixed platform.

The permanent installation of drill floor packages aboard platforms has certain problems, however. First, the drill floor package, which is a large and expensive piece of equipment, is used only for a short period and remains idle, when it could be used elsewhere. Second, the permanent installation of drill floor packages requires extensive support facilities, storage tanks, crew quarters, and the like. This requires much space aboard the fixed platform and requires much expense incurred only for the relatively-short duration drilling procedures. Third, in more recent years, the larger production fields are harder to find, and thus, the recent trend has been for somewhat smaller platforms to be constructed for production from a smaller number of wells. Thus, permanent installation of the drill floor package aboard a fixed, offshore platform is tending to become less economical.

Since many of the present day platforms are too large to accommodate drilling in the slot-mode (the platforms are too large to fit within the jack-up rig's slot), many jack-up rigs have been constructed to operate in a "cantilever mode." These jack-up rigs do not have a slot defined by their aft ends, but rather, have a cantilever structure that may be extended over the aft end of the jack-up rig and retracted to a stowed position aboard the jack-up rig. The drill floor package is typically mounted at the aft end of the cantilever structure. Thus, when it is desired to drill an oil or gas well from above a fixed platform, the jack-up rig is maneuvered adjacent to the fixed platform and its hull elevated above the sea surface and above the fixed platform. The cantilever is then extended over the desired drill slot and drilling occurs above and through the fixed platform.

The cantilever-type jack-up rigs have become quite popular, especially since they may be used with the larger platforms. Operators of slot-type jack-up rigs have thereby faced an economic incentive to adapt their rigs to use with large platforms, and to thereby remain competitive with the cantilever-type rigs. In part to address this problem, a method of "tender assist" drilling has been developed wherein the drill floor structure is skidded across from the deck of the jack-up rig's hull onto the fixed platform. When the jack-up rig is positioned with its aft end adjacent to the fixed platform, the hull of the jack-up rig is elevated to exactly the level of the fixed platform. A "pony base" is then pushed onto the upper surface of the fixed platform, and is supported by "capping beams" of the fixed platform (generally two parallel I-beams) that are capable of supporting the pony base. The drill floor package serves as a balancing load during this process, supporting the pony base by a pinned connection. That is, the pony base is not supported by a cantilever structure, but is coupled to the drill floor package which thereby keeps the pony base from tilting during the transfer procedure. Once the pony base is supported upon the capping beams, it is disconnected from the drill floor assembly, the hull of the jack-up rig is elevated until its upper surface is on a horizontal level with the top of the pony base, and a bridge structure is erected between the hull and the pony base. The drill floor package is then pushed across the bridge and onto the top of the skid base, and drilling is performed with the drill floor package continually supported by the fixed platform. The jack-up rig, its crew facilities and support equipment support the actual drilling operations. This type of tender assist drilling is generally described in PCT publication number WO 92/08007.

However, operating a jack-up rig in the cantilever mode in deeper waters (as deep or deeper than three-hundred feet) can present several difficulties. First, extreme weather conditions will frequently cause relative motion between the jack-up rig and the platform which will cause drilling operations to be suspended. Second, it is difficult to maneuver the jack-up rig sufficiently close to the platform for the cantilever structure to reach sufficiently onto the platform in order that all desired drilling positions may be accessed.

In partial response, cantilever-type jack-up rig operators have also developed their own methods of tender assist drilling which also use a procedure by which the drill floor package is loaded onto a fixed platform. These methods also present the advantage that the drill floor package is supported entirely upon the fixed platform, enabling drilling to continue in relatively harsh weather conditions, and over a larger number of possible well positions.

One such method for tender assist drilling using a cantilever jack-up rig is generally described in U.S. Pat. Nos. 4,938,628 and 5,052,860 to Ingle. The drill floor package is positioned at the aft end of the cantilever structure, which is extended in overlapping bracketing relation with the capping beams. Since the spacing of the lateral cantilever beams of the cantilever structure is approximately sixty feet, and since capping beam spacings generally vary between forty and fifty-five feet, the cantilever beams are used to place the drill floor package directly above the fore ends of the capping beams. The hull of the jack-up rig is then lowered, such that the capping beams lift the drill floor package directly off the cantilever structure, and continue to support the drill floor package during drilling operations.

These methods work relatively well and facilitate continued drilling under harsh weather conditions, because any relative motion between jack-up and platform no longer affects the drilling operation. They are not, however, without disadvantages. In particular, offshore drilling platforms are built in many configurations and styles by different operators. Thus, drill floor packages must generally be specially adapted to the design of the drilling platform, such that the framework of the drill floor package structure is properly supported upon the platform's capping beams. Depending upon the configuration of offshore platform, capping beams generally vary in spacing between 40 feet to 55 feet, and there is no uniform standard of construction. Also, since most fixed platforms feature decking that is positioned about and between the capping beams, the latter-described method of tender assist drilling must overcome a significant obstacle in an endeavor to place the drill floor package over any desired drill slot on the fixed platform.

Significantly, the transfer of the drill floor package, known as a "skid-off" or "skidding" procedure, presents inherent safety concerns. Basically, these methods involve the transfer of a three-million pound structure between two separated platforms which are both elevated a significant distance above the water. Although drilling itself is facilitated in relatively harsh weather conditions, the skid-off transference procedure requires relatively calm conditions, and thus, ties up use and location of the jack-up rig in attendance of calm weather for placement or removal of the drill floor package. This may require the attendance of a jack-up rig for as many as three weeks in some environments (such as the Central North Sea), awaiting an appropriate weather window. Aside from the typical $50,000 per day rental costs that are lost by the jack-up operator (jack-up rig mobilizations are very often lump sum transactions), production drilling is also delayed.

These methods also have certain other limitations. For example, during the "skid-off" procedure, there is a period when the drill floor package rests both upon the capping beams of the fixed platform and the cantilever beams. This can impose undesired side loads which are detrimental to both the cantilever structure and the capping beams of the fixed platform, because waves and weather may cause relative motion between the jack-up rig and the fixed platform during the skid-off procedure. Also, the jack-up rig must be positioned very closely to the fixed platform, and very accurately aligned therewith, which requires the most benign weather conditions. Although sophisticated alignment methods enable generally accurate alignment between the jack-up rig and the fixed platforms, there may be some limited misalignment between the cantilever beams and the capping beams, which causes these undesired side loads to be imposed upon one or both during skidding. This effect, as mentioned, may significantly heightened during harsh weather conditions. When such misalignment and relative movement occurs, the longitudinal capping beams are subjected to non-intended, non-vertical loads that may threaten the integrity of the platform structure and reduce safety factors.

Therefore, mobilization of a jack-up rig for a skidding operation may entail a significant amount of unused time which is devoted solely to awaiting ideal weather conditions. In addition, removal of the drill floor package also presents difficulties and consumes time, as the legs of the jack-up rig may settle into the sea floor, creating or amplifying misalignment between the fixed platform and the rig and delaying removal while the problems are cured.

Because tender assist drilling is now being applied to deep water and harsh environments, it is even more arduous to accurately position the jack-up rig alongside the fixed platform, unless the weather is very calm. Current skid-off methods do not work if the misalignment exceeds quite low values. When combined with the problem of undesired side loads and differing construction standards for capping beam surfaces, it is apparent that current skid-off methods have some significant drawbacks.

Thus, a need exists for a flexible approach to the skid-off process that may be safely performed in relatively harsh weather conditions, under circumstances in which there is relative motion between the jack-up rig and the fixed platform, and in which the jack-up rig need only be positioned within a tolerance not acceptable to current practice. Furthermore, a need exists for a practical method of transferring a drill floor package to and from offshore platforms and that can provide drilling access to all of the drill slot locations on the larger platforms. A need also exists for a drill floor package support structure that can be adapted on-site to be loaded upon the upper platform surfaces of nearly any offshore platform, irrespective of the spacing between the capping beams or the existence of decking. Still further, this drill floor package support structure should preferably be, despite the enormity of its size and weight, capable of assembly at sea and should not require the jack-up rig to be towed into port for installation and preparation. The current invention is intended to satisfy these needs and to provide further related advantages.

SUMMARY OF THE INVENTION

The present invention provides a method of safely transferring the drill floor package from a jack-up rig onto a fixed production platform, even with misalignment or relative motion occurring between the two. The drill floor package may then be efficiently moved about the surface of the fixed platform by special moving devices that enable the equipment to access remote portions of the fixed platform. To reduce disadvantages of these distances, modular piping enables ready drilling support by the jack-up rig at nearly any location upon the fixed platform.

Still further, the present invention provides a skid-off method wherein the jack-up rig does not have to be as closely positioned to the fixed platform as with previous methods, and which, since it accommodates relative motion or misalignment, can perform both the positioning operation alongside the platform and the skid-off transference within a much larger weather window, potentially achieving great savings for jack-up rig operators. Also, the present system may be used with nearly any configuration of fixed platform, notwithstanding the capping beam configuration or the existence of decking.

More particularly, the present invention provides each of the following: (1) a method of safely loading the drill floor package from a jack-up rig onto an offshore platform; (2) a method of safely loading the drill floor package from an offshore platform onto a jack-up rig; (3) an offshore drilling platform; (4) a skid base used to support the drill floor package; and (5) a foot assembly that supports the skid base. Each of these methods and devices are briefly summarized below.

First, the invention provides an offshore platform having a drill floor package (including a derrick and drill floor substructure), a fixed platform above the surface of the water, and a skid base that supports the drill floor package. The skid base is supported on its underside by pairs of fore and aft skid-off feet, which support the skid base upon the cantilever beams of the jack-up rig. It can also be supported by pairs of fore and aft capping beam feet, which enable the skid base to be moved on the capping beams of the fixed platform and which are used in conjunction with the skid-off feet when the skid base is transferred from jack-up to platform.

To perform the transference, the jack-up rig is positioned close to the fixed platform and the hull of the jack-up rig is elevated to substantially the platform height, to thereby align the longitudinal axis of the jack-up rig in substantial alignment with the longitudinal axis of the fixed platform. The cantilever beams are then extended aft from a normally stowed position aboard the jack-up rig, until their aft ends are close to the fore ends of the capping beams of the fixed platform. The skid base is moved aft along the cantilever beams, until an aft pair of the capping beam feet are in proximity to and overlie the capping beams. A swivel mechanism and other bearings operate to swivel and laterally move the aft capping beam feet to align them with the capping beams, thus compensating for any angular and/or lateral misalignment between the cantilever beams and the capping beams. Each capping beam foot also includes a selectively operable movement mechanism for moving the capping foot longitudinally along its associated capping beam. When the aft capping beam feet are aligned over the capping beams, weight is transferred from the aft skid-off feet to the aft capping beam feet.

The aft movement of the skid base is continued, with the skid base supported by both of the aft capping beam feet and fore skid-off feet. When the fore capping beam feet reach a position overlapping the fore ends of the capping beams, they are swivelled and transversely moved into alignment with them. The fore capping beam feet are then engaged with the capping beams and the fore skid-off feet are disengaged from the cantilever beams, and motion is continued aft along the capping beams (the skid base having been completely transferred to the fixed platform). It must be appreciated that fore and aft movement of the skid base during its transfer is in line with the cantilever beams, and because the jack-up rig is not necessarily in angular alignment with the platform, the transverse movement of the aft capping beam feet with respect to the skid base permits their continued alignment with the capping beams as the skid base moves aft.

Once the skid base is fully loaded onto the platform, it is desired to skid the drill floor package across onto the skid base. The surface of the skid base, at the forward end and adjacent the upper surface, is locked to the cantilever beams to provide a continuous surface for transference of the drill floor package. To accomplish this, the rig is jacked up until forwardly extending spur beams of the skid base engage and lock the cantilever beams, tying the skid base to the jack-up rig as the skid base continues to freely ride upon the swivel mechanisms of its capping beam feet, and their transverse mountings. This configuration permits the skid base to remain supported by the fixed platform for subsequent transference of the drill floor package, yet remain in a floating mode so that relative motion between the rig and the fixed platform does not introduce lateral loads into either the platform or the jack-up rig.

In more particular features of the invention, the drill floor package is initially mounted on top of the cantilever beams, forward of the skid base, for movement along them. After the skid base has been transferred to the capping beams of the fixed platform, the jack-up rig is raised on its legs to bring locking structures at the ends of the cantilever beams vertically into locking engagement with the spur beams. In this linked condition, the spur beams prevent longitudinal separation of the skid base and the cantilever beams, or misalignment, and allow the drill floor package to be moved across onto the fixed platform.

The current invention also presents a novel skid base that is adapted to support a drilling structure upon the fixed platform. The skid base has an upper surface that receives the drill floor package, and a lower surface that is wide enough to be supported upon sets of feet on both the capping beams and cantilever beams. In addition, the skid base mounts a plurality of foot assemblies that are disposed vertically below the skid base and that are transversely adjustable along the underside of the skid base to be aligned with a supporting beam. This also permits the feet to synchronously move the skid base with respect to the capping beams.

In another form, the skid base also includes two distinct sets of feet, namely, the capping beam feet, which carry the skid base only upon the capping beams of the fixed platform, and the skid-off feet, which carry the skid base only upon the cantilever beams of the jack-up rig. The capping beam feet are used to move the skid base longitudinally, using the capping beams as rails.

Finally, the capping beam feet and the aft pair of skid-off feet described herein each include a novel walking mechanism for moving the skid base along the capping beams and the cantilever beams, respectively. Each walking mechanism includes spaced fore and aft outer legs which extend downwardly to rest up on the associated capping beam or cantilever beam, thereby supporting the weight of the skid base upon it. The walking mechanism includes a center leg which is alternately raised and lowered with respect to the outer legs by an elevating and lowering mechanism, so that the outer legs and the center leg alternately support the skid base on the underlying one of the beams. Each time the outer legs and the skid base are raised from the beam by the center leg being lowered onto it, a horizontal jack creates longitudinal movement between the raised outer legs and the lowered center leg via an interposed set of horizontally mounted longitudinal movement rollers. The skid base is thereby moved in the desired fore or aft direction along the beams. When the outer legs are lowered thereby raising the center leg from the beam, the horizontal jack is operated in the opposite direction to reset the walking mechanism for the next step.

Each capping beam foot further includes a swivel mechanism that provides swivelling motion about a vertical axis, and a sliding mounting that provides transverse movement of the foot relative to the skid base. These mechanisms of the capping beam feet allow the skid base to translate and follow movement of the capping beam feet upon the capping beams, or movement of the skid-off feet upon the cantilever beams, during the transfer and movement procedures to thereby compensate for relative misalignment and relative motion. Thus, in the preferred embodiment, described below in greater detail, each capping beam foot advantageously is movable in three dimensions (longitudinally upon the capping beams, transversely on the underside of the skid base, and rotation about a central vertical axis). All three movement dimensions are activated when the center leg is lowered by the jack mechanism and the spaced, outer legs simultaneously raised.

Using the foregoing methods and devices, the present invention uses the skid base to position the drill floor package on the offshore platform, both longitudinally and transversely, without undesired lateral stresses upon the capping beams of the offshore platform, even with some relative movement between the jack-up rig and the fixed platform, and even if there is substantial misalignment between jack-up and platform.

A preferred embodiment is illustrated in the accompanying drawings.

DESCRIPTION OF THE DRAWINGS

FIG. 5A is a plan view of one of the spur beams extending forward from the skid base on a level with its upper surface, in its engaged condition with the cantilever beams. This view shows sockets in the surface of the spur beams that are designed to be hooked by a conventional dog (jacking) mechanism used to haul the drill floor across the spur beams.

FIG. 5B shows a side view of the spur beams shown in FIG. 5A, including a locking slot defined on the underside of the spur beams.

FIG. 5C shows a cross sectional view of the locking structure of the cantilever beams, having a locking pin which is designed to receive the locking slot defined by its associated spur beam.

DETAILED DESCRIPTION

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of each of the apparatus and two methods, which were summarized above and which are defined in the enumerated claims.

INTRODUCTION TO THE PRINCIPAL PARTS

The preferred embodiment provides a specialized skid base which acts as a movable intermediary between the capping beams of an offshore platform and a drill floor package. Using this structure, a drill floor package may be efficiently and safely loaded between the offshore platform and tendering vessels, notwithstanding minor misalignment or movement between the two during such a move. More particularly, these operations may be achieved with a heightened degree of safety beyond systems of the prior art.

As described further below, this skid base is a structure that conveniently mounts various pieces of drilling equipment, such as the well control equipment, gumbo shakers, and pipe couplings necessary to support drilling operations. The skid base movably supports a derrick upon an upper surface of the skid base, such that the derrick may be moved both longitudinally and transversely upon the surface of the platform. This arrangement enables the derrick to be conveniently moved to any desired drilling position on the offshore platform.

As described further below, the skid base also has specialized skid-off feet and capping beam feet that enable the skid base to move upon the cantilever beams of the jack-up rig and the capping beams of the fixed platform, respectively. These assemblies possess mechanisms that allow continuous support by the capping beams of the fixed platform and/or the cantilever beams of a jack-up rig as the skid base is moved from one to the other. It must be remembered that the structures discussed herein are immense in size, and present great hazard and difficulty in their movement upon spaced girders at a significant height above the sea's surface.

Figure 1A:
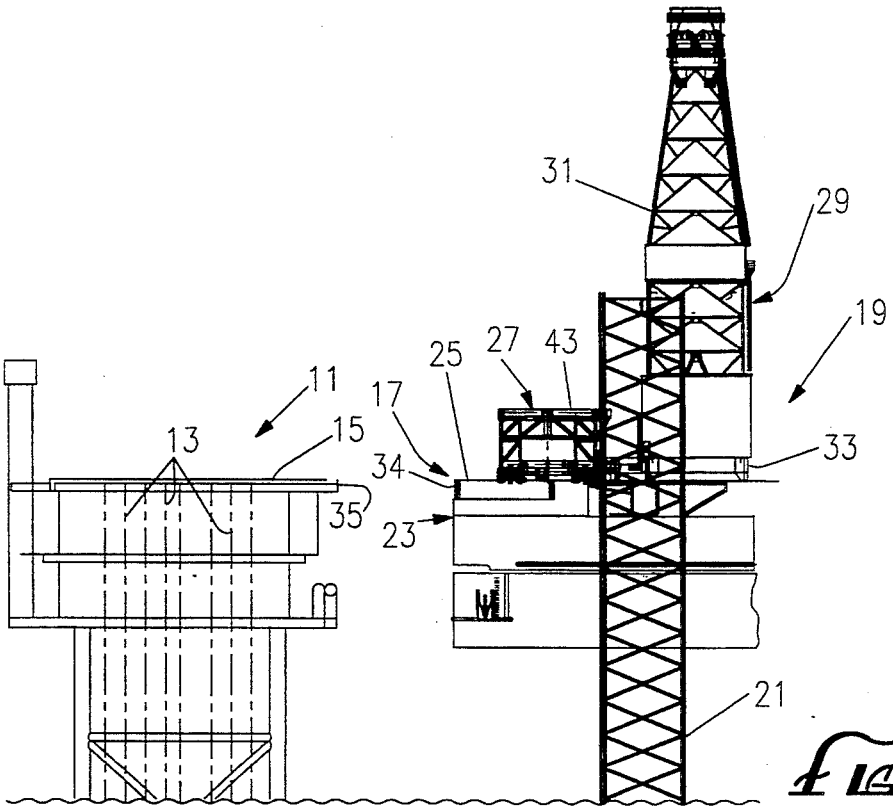
FIG. 1A shows a fixed platform having a number of drilling positions (shown in phantom) and the aft portion of a jack-up rig's hull which has been elevated to approximately the same height as the fixed platform. The jack-up rig bears a cantilever structure movable on the hull, a drill floor package and a skid base.
Figure 1B:
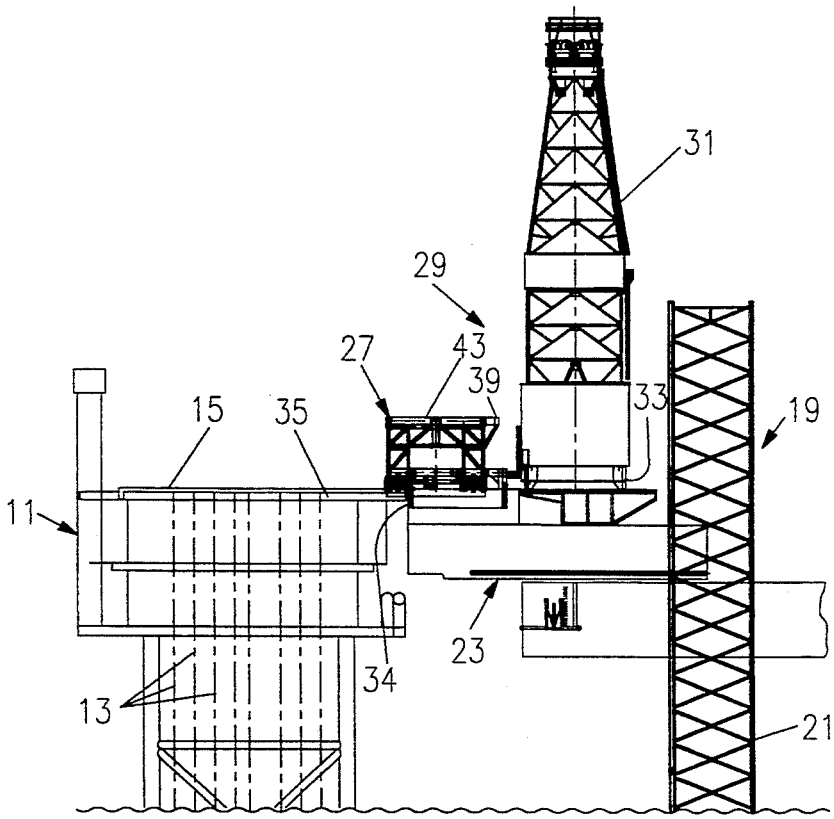
FIG. 1B shows the arrangement of FIG. 1A but with the cantilever structure extended from the aft portion of the jack-up rig towards the fixed platform. The skid base and drill floor package are shown as advanced along the cantilever beams towards the fixed platform.

FIGS. 1A through 1D present an overview of the use of the jack-up rig and the drill floor package according to the preferred embodiment. A fixed offshore platform 11 is shown in FIG. 1A. The platform conventionally includes a working platform supported above the surface of the sea by a plurality of fixed legs extending downwardly into the sea floor. It has a number of drilling positions 13 for the drilling of wells, which are illustrated in phantom lines. A pair of capping beams 15 extend longitudinally across the upper surface of the fixed platform in parallel, transversely spaced relation. At the right side of FIG. 1A, the aft portion 17 of the hull of a jack-up rig 19 is shown as elevated above water upon its downwardly extendable legs 21 (only one is shown in FIG. 1). The jack-up rig is floatable and can be towed to its intended-use location and then fixed in position by lowering the legs of the rig until support is gained from the sea floor. The hull is then raised upon the legs above the sea surface, as is conventionally known. The jack-up rig 19 is shown with a cantilever structure 23. The cantilever structure is moveable longitudinally on the jack-up rig between a stowed position lying within the boundaries of the rig (FIG. 1A) and an extended position in which aft regions of the cantilever structure extend aft from the jack-up rig (FIG. 1B). There are two parallel cantilever beams 25, forming part of the cantilever structure, which mount a skid base 27 and a drill floor package 29. The drill floor package, which includes a derrick 31 and drill floor substructure 33, are to be moved onto the offshore platform for drilling a well. The skid base 27 and the drill floor package 29 rest upon adjacent portions of the cantilever beams 25, with the drill floor package forward of the skid base in preparation for their loading onto the offshore platform.

TRANSFER OF THE SKID BASE AND DERRICK TO THE FIXED PLATFORM

The skid base is a massive three-dimensional rectangular framework. For example, in the preferred embodiment, it weighs approximately 525 tons. The skid base is loaded onto the hull of the jack-up rig in port as a single enclosed unit, or delivered directly to the platform. Alternatively, it may be assembled on the jack-up rig 19 from sections weighing approximately 20 tons each, either in port or on the jack-up rig in its elevated condition, from substructures delivered from tendering vessels.

In using the equipment of the present invention, the jack-up rig 19, in its floating condition, is towed to the vicinity of the fixed platform 11 and maneuvered to position the aft ends 34 of the cantilever beams 25 on the rig near the end 35 of the capping beams 15 on the fixed platform, with the pairs of capping beams and cantilever beams having these adjacent ends aligned and pointing towards each other. Because of the difficulties of maneuvering jack-up rigs, it is difficult to avoid some amount of misalignment of the longitudinal axes of the cantilever beams and capping beams. Sophisticated aligning and locating equipment now available should enable the misalignment to be feasibly held to less than a misalignment of 5° or two meters in the transverse direction, and the preferred embodiment is purposefully designed to accommodate such misalignments. The legs 21 of the jack-up rig are then lowered to stabilize and fix its position, and the rig's hull is elevated on the legs until the upper surfaces of the cantilever beams are on the same horizontal level as the upper surfaces of the capping beams on the fixed platform.

Next, the cantilever beams 25, which are transversely spaced apart in parallel relation by approximately 60 feet, are extended aft until only a small gap exists between their aft ends 34 and the fore ends 35 of the capping beams, for example, about one foot or less. Because of the scale of the drawings, the gap is not shown in FIGS. 1A–1D, but is shown in FIG. 2A. At this point, the two parallel cantilever beams 25 are extended in adjacent, generally parallel relationship to the capping beams 15, as shown in FIG. 1B. The capping beams 15 of a fixed offshore platform have varying spacings, typically within a range of between 40 and 55 feet transversely apart.

While sophisticated devices and methods exist for aligning the aft end of the jack-up rig 19 with the end 35 of the fixed platform, so that the cantilever beams 25 may be closely aligned with the capping beams 15, misalignment between the capping beams and the cantilever beams of up to 5° or two meters is relatively common, especially under harsh weather conditions. Thus, such misalignment is illustrated in accordance with the principles of the invention and the operation of the preferred embodiment in FIG. 3A.

With the capping beams 15 and cantilever beams 25 in generally aligned relationship, the skid base 27 is moved in the aft direction upon the cantilever beams to a position where it is close to the capping beams, as illustrated in FIG. 1B. Aft movement of the skid base is continued until it moves onto the capping beams as shown in FIG. 1B. The movement is then continued until the skid base 27 has been transferred entirely to the capping beams, using special skid-off feet and capping beam feet that will shortly be described with reference to FIGS. 2A and 2D.

Next, the cantilever beams 25 are retracted somewhat in the fore direction, and the hull of the jack-up rig 19 is then elevated on the legs 21 to raise the upper surface 37 of the cantilever beams to the level of the upper surface 43 of the skid base. The skid base has horizontal spur beams 39 extending forwardly adjacent its upper surface, which become locked to a locking structure 41 at the aft ends of each of the cantilever beams 25 (as will be further described), to firmly lock the skid base and cantilever beams together and provide a continuous surface between them.

Figure 1C:
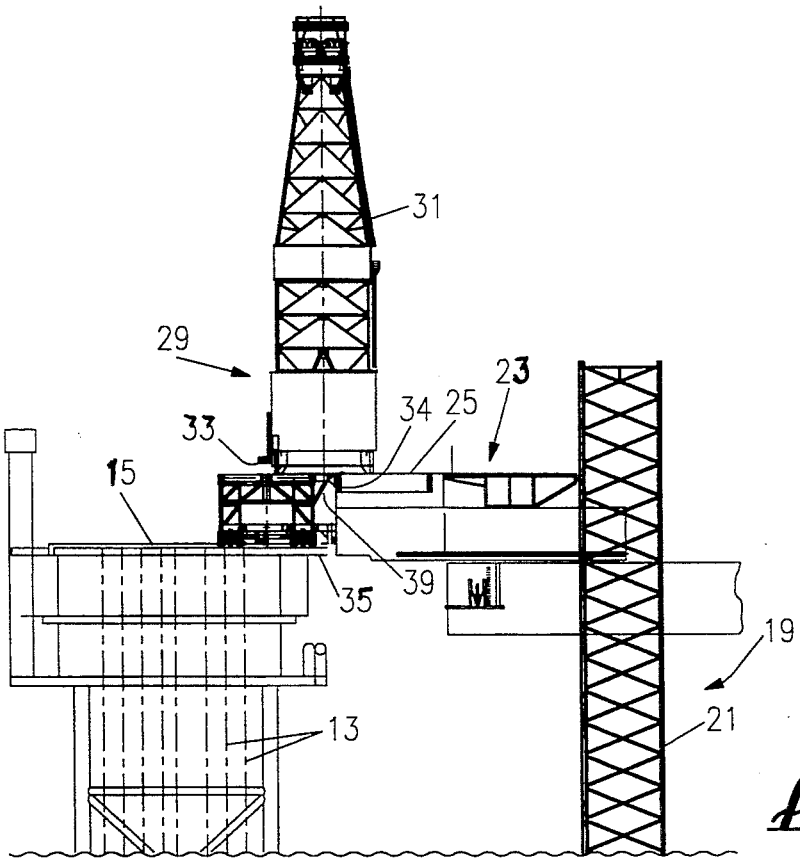
FIG. 1C shows the arrangement of FIG. 1B, but with the skid base entirely skidded onto the fixed platform and the capping beam feet of the skid base resting entirely upon the capping beams; the jack-up rig is further elevated to place the upper surface of the cantilever on a level with the upper surface of the skid base.
Figure 1D:
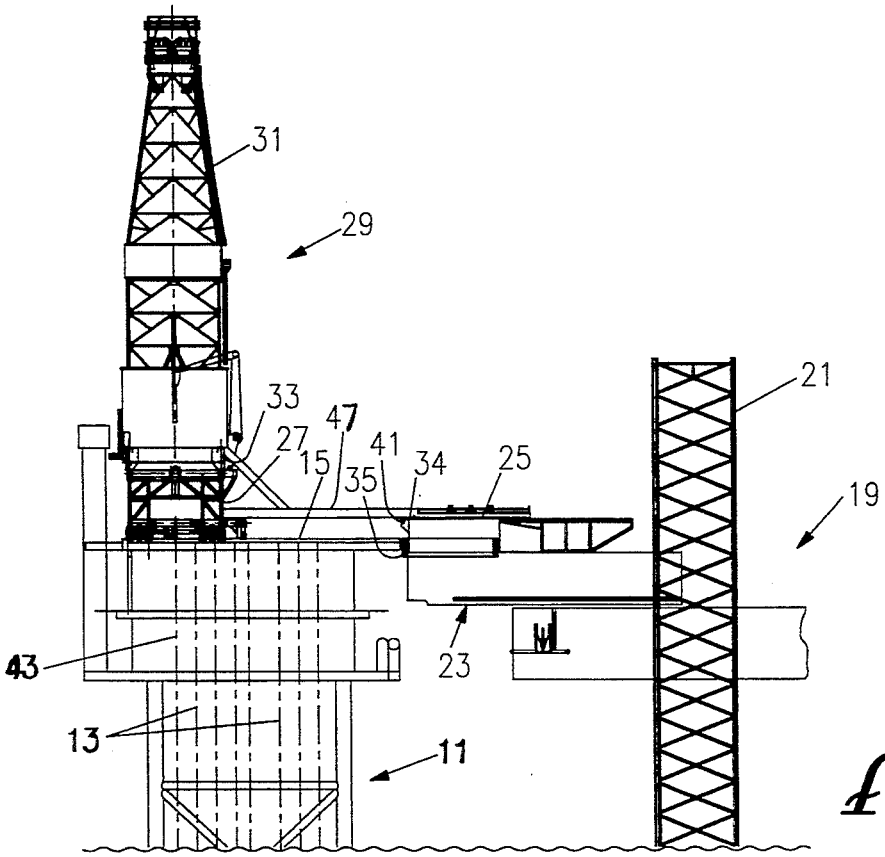
FIG. 1D shows an arrangement similar to FIG. 1C, but with a drill floor package, including a derrick and drill floor, installed upon the upper side of the skid base, the skid base and the drill floor package having been moved to an aft portion of the fixed platform to align with a drilling position shown as the left-most phantom line.
Figure 2A:
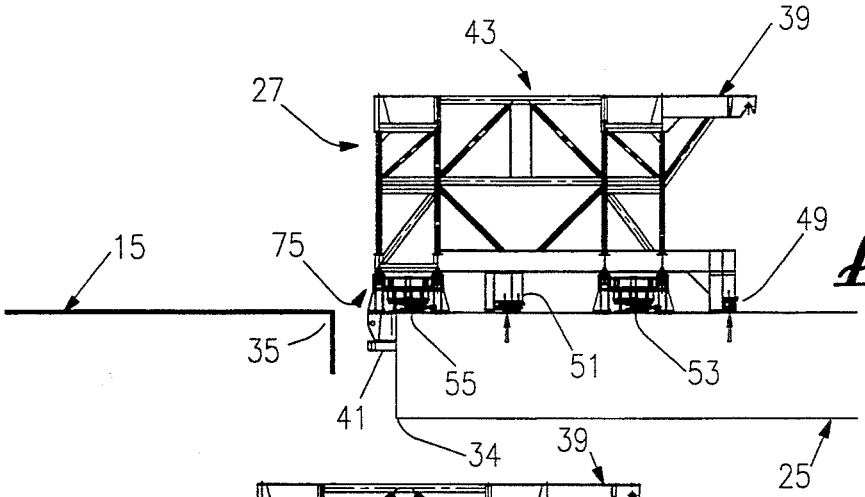
FIG. 2A shows a side view of the skid base illustrating its position on the extended cantilever beams shortly before commencing transference to a fore portion of the capping beams of the fixed platform. The vertical arrows identify where the load is being borne upon the beams.

Following this, the drill floor package 29 is moved aft along the cantilever beams 25, over the spur beams 39 and onto the upper surface 43 of the skid base, as shown by FIG. 1C. After this transference is complete, the spur beams 39 are disengaged from the cantilever beams by lowering the hull of the jack-up rig down upon the legs. The skid base 27 and its load (the drill floor package) are then moved to a desired drilling location, e.g., the aft-most drilling position 45 in FIG. 1D. The jack-up rig's hull is lowered somewhat and a catwalk 47 then extended from the jack-up rig to the skid base 27 for support of drilling operations by the jack-up rig and its crew.

The drill floor package is thus transferred to lie entirely upon the fixed platform, and the jack-up rig is not burdened with maintaining the immensely heavy drill floor package 29 at an extended position. This arrangement allows for drilling operations to occur in relatively harsh weather conditions, and allows drilling equipment to be positioned at nearly any desired drilling position 13 by movement of the skid base 27 in the longitudinal direction and transverse movement of the drill floor package, without the requirement that the jack-up rig's cantilever structure 23 directly and precisely place the drill floor package. This arrangement also allows for an ease of transference of the drill floor package between the jack-up rig and the offshore platform, with an improved level of safety.

SEQUENCE OF ENGAGEMENT OF THE SKID-OFF FEET AND CAPPING BEAM FEET

The transference of the skid base 27 is effected by fore and aft pairs of skid-off feet 49 and 51 and fore and aft pairs of capping beam feet 53 and 55, which are mounted to the underside of the skid base for engagement with the cantilever beams 25 of the jack-up rig and the capping beams of the offshore platform, respectively. Their sequence of operation in the transference process is shown in FIGS. 2A–2D. These figures indicated by vertical arrows the particular feet that are bearing the load of the skid base 27 at different stages during the transference.

Each of the aft pair of skid-off feet 51 include a walking mechanism, described later, that engages the associated cantilever beam and selectively advances the foot along the beam in the fore or aft direction, using the beam as a rail. The skid-off feet in each pair 49 and 51 are transversely spaced apart at the same spacing as the cantilever beams, (sixty feet) to support the skid base 27 upon them.

Figure 4:
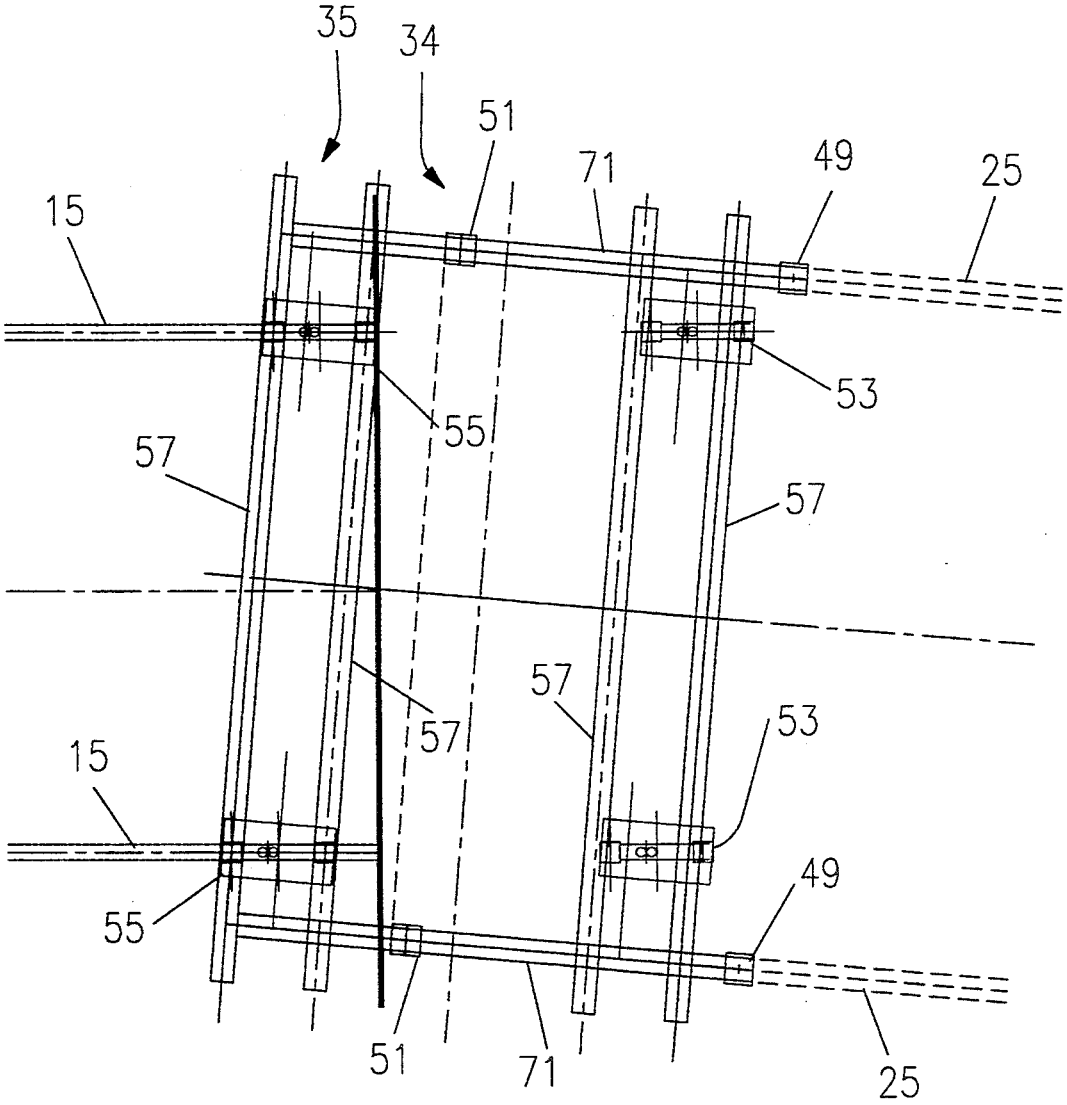
FIG. 4 is a schematic plan view of an early stage of transference of the skid base to the capping beams, corresponding to the stage shown in FIG. 2B. It shows a limited degree of misalignment between the cantilever beams and the capping beams, and indicates the positions of the fore capping beam feet on the capping beams.

Each capping beam foot also includes a walking mechanism (also described later), which allows the skid base 27 to move along the capping beams 15 in a manner similar to movement of the skid base upon the skid-off feet. However, the capping beam feet do not enable only longitudinal motion, but further also configured for (i) transverse movement relative to the skid base 27 and (ii) swivelling motion relative to the skid base about a vertical axis. Specifically, as shown in FIG. 4, the pairs of capping beam feet 53 and 55 are slidably mounted upon transverse skid base beams 57, which form part of the transverse structural support for the skid base. Accordingly, the fore and aft pairs 53 and 55 of capping beam feet are adjusted to match the transverse spacing of the capping beams, normally within a range of approximately 40 to 55 feet.

Figure 2B:
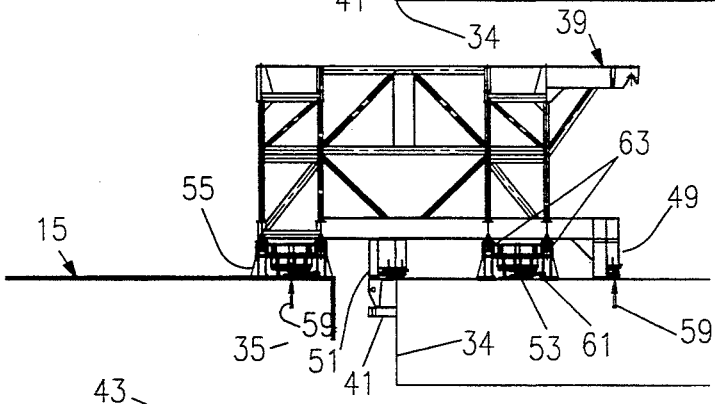
FIG. 2B shows an initial step of transference of the skid base to the capping beams, with the skid base supported by the aft capping beam feet upon the fore portion of the capping beams, and by the fore skid-off feet upon an aft portion of the cantilever beams, with the other capping beam feet and skid-off feet not in load-bearing relation to the underlying beams.
Figure 2C:
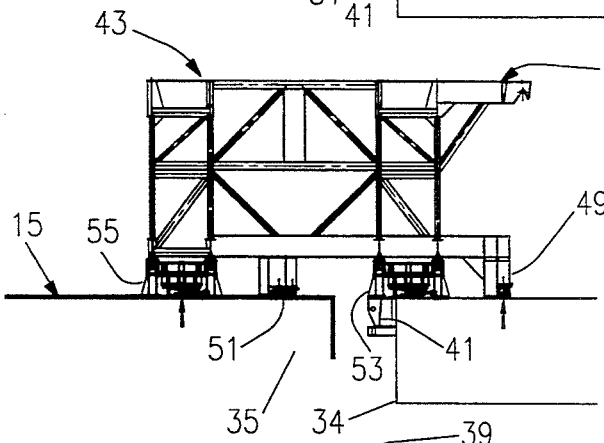
FIG. 2C shows a further step in the transference, with the skid base still supported by the same feet as in FIG. 2B but with the fore capping beam feet moved further aft to a position adjacent to the fore portion of the capping beams.

The sequence in which the various pairs of feet come into use during transfer of the skid base 27 to the fixed platform 11, will now be described. Initially, (FIG. 2A) the skid base is supported only by the fore and aft pairs of skid-off feet 49 and 51, and is moved aft along the cantilever beams 25 by them with the pairs of capping beam feet 53 and 55 out of contact with the cantilever beams and capping beams. Aft movement of the skid base 27 is continued until the aft pair of skid-off feet 51 are at the aft end 34 of the parallel cantilever beams 25 (FIG. 2B). At this point, the aft pair of capping beam feet 55 are aligned to engage each of the parallel capping beams 15 for longitudinal movement, as may best be seen in FIG. 4. Once the aft pair of capping beam feet 55 are aligned, vertical jack mechanisms in each of the aft skid-off feet 51 are retracted, causing the aft pair of capping beam feet to engage the capping beams as shown in FIG. 2B. The arrows in FIG. 2B, designated by the reference number 59, mark locations upon each of the capping beams and cantilever beams where the weight of the skid base is borne, respectively, by the aft capping beam feet 55 and the fore skid-off feet 49.

As previously referred to, each of the capping beam feet, including the aft capping beam feet 55, possess a swivel mechanism 61 and an upper sliding mounting 63 that enables the capping beam feet to be moved transversely across the skid base 27 to the extent necessary to align them in pairs with the pair of capping beams 25. Thus, the lower portion of the aft capping beam feet are swivelled to align them for motion longitudinally along the capping beams, while the skid base continues to move aft along the cantilever beams 25 during its transfer onto the offshore platform 11. Each of the skid-off feet and the capping beam feet is individually selectively controlled by an operator in its periods of intermittent aft movement during the transfer period. The operators that control movement of the various feet that are bearing the load at any particular time must necessarily synchronize movements of the feet along the respective beams to avoid imposing distorting forces on the skid base 27. This synchronization in the preferred embodiment, is achieved by visual observation of the motion of the feet and verbal radio communication among the operators. With the aft pair of capping beam feet 55 engaged with the capping beams 15, skid base movement is continued aft using the synchronized walking mechanisms of the aft capping beam feet and freely-rotating rollers of the fore skid-off feet 49 to support the skid base 27 in movement along the capping and cantilever beams 15 and 25. If there is some misalignment between the cantilever and capping beams, the capping beam feet continue to move longitudinally along the capping beams, while at the same time moving along the transverse skid base beams to accommodate any angular misalignment between the jack-up rig and the platform.

Figure 2D:
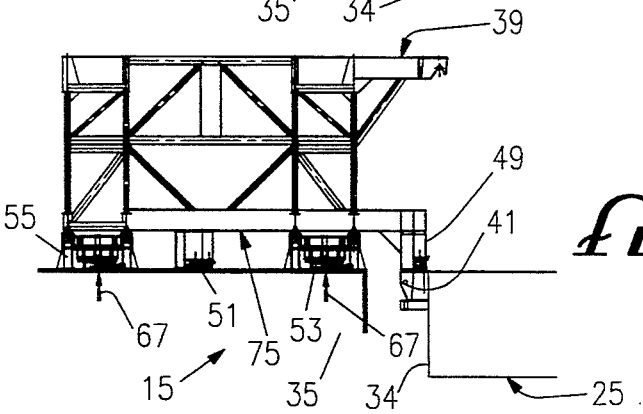
FIG. 2D shows the next step in transference, with the skid base moved still further aft, with the fore capping beam feet engaging the fore portion of the capping beams to support the skid base on the capping beams with the skid-off feet out of load-bearing relation to the cantilever beams.

The movement of the skid base 27 in the aft direction is continued until the fore capping beam feet 53 are in position above the fore ends 35 of the capping beams 15 (FIG. 2D). The fore capping beam feet 53 are identical in construction to the aft capping beam feet 55 and are similarly positioned and oriented to align for longitudinal movement along the platform capping beams 15. Vertical jack mechanisms on each of the fore skid-off feet 51 are then operated to alter the relative vertical positioning of the fore skid-off feet and the fore capping beam feet 53 until the weight of the skid base has been transferred from the fore skid-off feet to the fore capping beam feet, as shown in FIG. 2D.

Figure 2E:
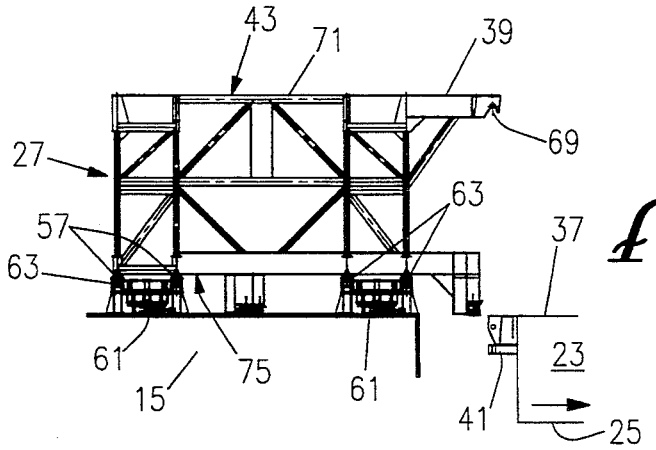
FIG. 2E shows the next step in transference, with the skid structure moved to ride entirely upon both sets of capping beam feet. The skid-off feet have been removed from engagement with the cantilever beams and the cantilever structure has been retracted in the direction indicated by the arrow to clear the fore skid-off feet.

The vertical arrows of FIG. 2D, designated by the reference numeral 67, illustrate the weight of the skid base as being entirely supported upon the capping beams once the fore skid-off feet have been disengaged from the cantilever beams. At this point, the skid base 27 rides upon the capping beams 15 at a narrower gauge than the skid-off feet, which accordingly are supported outside the capping beams, in mid-air. As shown in FIG. 2E, transference of the skid base 27 is completed by continuing the aft movement of the skid base upon the capping beams 15.

THE TRANSFERENCE OF THE DRILL FLOOR PACKAGE

When the skid base 27 is entirely supported on the capping beams 15, the drill floor package 29 is then moved onto the skid base.

As a preliminary step, the cantilever structure 23 of the jack-up rig 19 is retracted sufficiently onto the rig to place the locking structures 41 mounted to the end of each cantilever beams 25 in vertical alignment beneath a downwardly open locking slot 69 at the fore end of each of the previously referred to spur beams 39 (FIG. 2E).

Figure 2F:
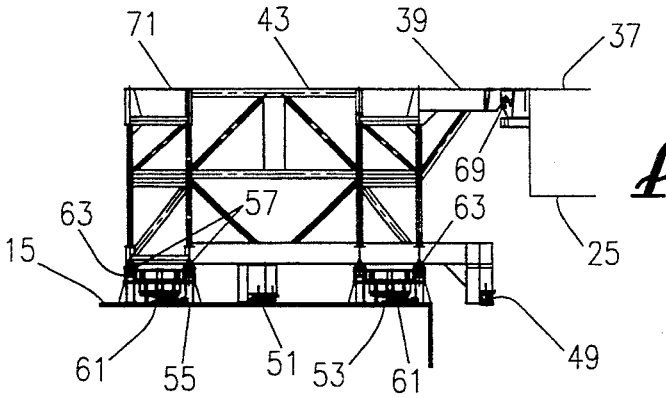
FIG. 2F shows a further step in which the hull and cantilever structure have been elevated such that two locking structures at the end of the cantilever beams engage spur beams extending forwardly from the top fore portion of the skid base.

The hull of the jack-up rig 19 is then elevated on the legs 21 to engage the two locking structures 41 with the locking slots 69, thereby locking the upper surfaces of cantilever beams and the skid base 37 and 43 in horizontal alignment. The skid base is thereby prepared to receive the drill floor package 29 upon its upper surface 43 via the horizontal spur beams 39, which provide a smooth transition between the two (FIG. 2F).

Importantly, during the transference of the drill floor package, the capping beam feet are left to freely support the skid base upon their swivel mechanisms and sliding mountings, such that the upper surfaces of the cantilever beams and the skid base 37 and 43 may be maintained in locked relation, notwithstanding that the skid base is then-supported upon the capping beams 15. With the upper surfaces 37 and 43 in locked alignment, the drill floor package 29 is skidded from a position aboard the cantilever beams onto the upper surface of the skid base.

As seen in FIGS. 2 and 3, the skid base is of generally rectangular, box construction. Upon its upper surface 43, it mounts two longitudinal beams 71 that are spaced sixty-feet apart to align with the cantilever beams 25. The spur beams 39 are extensions of these longitudinal beams, and permit the drill floor package 29 to be skidded directly onto the longitudinal beams.

This transference is accomplished by using a plurality of circular sockets 73 which are defined in the upper surfaces 37 of the cantilever beams, the spur beams 39, and the longitudinal beams 71 just mentioned. Using the sockets, a pair of dog mechanisms (not shown) pull or push the drill floor package 29 along these beams, which remain flush during the entire operation. The dog mechanisms, described further below, are simple hydraulic jacks which are used to engage the sockets and slide the drill floor package with respect thereto.

The drill floor substructure 33 mounts eight skidding feet, which will be described further below. Only four of these feet are used for the fore-to-aft skidding transference of the drill floor package. Accordingly, the entire drill floor package 29 is elevated by hydraulic jacks (not shown) before the transference commences and a skidding shoe is inserted beneath each of the four skidding feet used for the fore-to-aft movement of the drill floor package. These skidding shoes are effective to maintain the other four skidding feet (which are used only for transverse movement of the drill floor package upon the skid base 27) out of interfering relationship with the skid base during the transference.

As seen in FIG. 1C, the drill floor package 29 is then skidded from the cantilever beams across the spur beams 39 and onto the longitudinal beams 71 of the skid base until it is completely supported by the skid base 27. The drill floor package is then again elevated and the skidding shoes removed. When the drill floor package is lowered, the transverse skidding feet support it for transverse movement upon the skid base 27.

The transference of the drill floor package 29 thus complete, the hull of the jack-up rig 19 is lowered down on the legs 21 to thereby disengage the spur beams 39 from the cantilever beams 25. The drill floor package 29 and skid base 27 are then ready to be aligned with the capping beams 15 and moved to the desired drilling position.

ALIGNMENT OF THE SKID BASE WITH THE CAPPING BEAMS

Figure 3A:
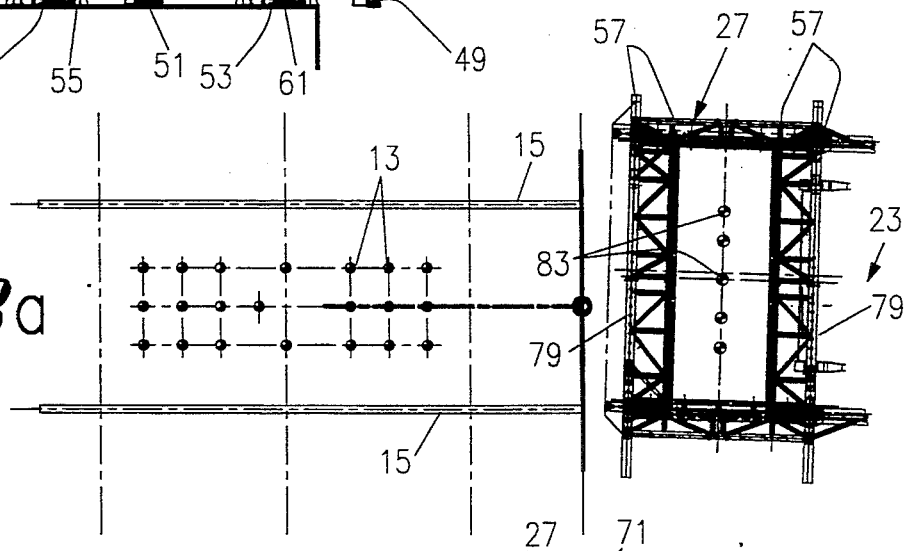
FIG. 3A shows a plan view of the relative position of the skid base and the capping beams just before the commencement of transference, corresponding to the side view shown in FIG. 2A. It illustrates the capping beams of the fixed platform, a number of drilling positions, and the cantilever beams, which are in adjacent, but misaligned relationship relative to the capping beams.
Figure 3B:
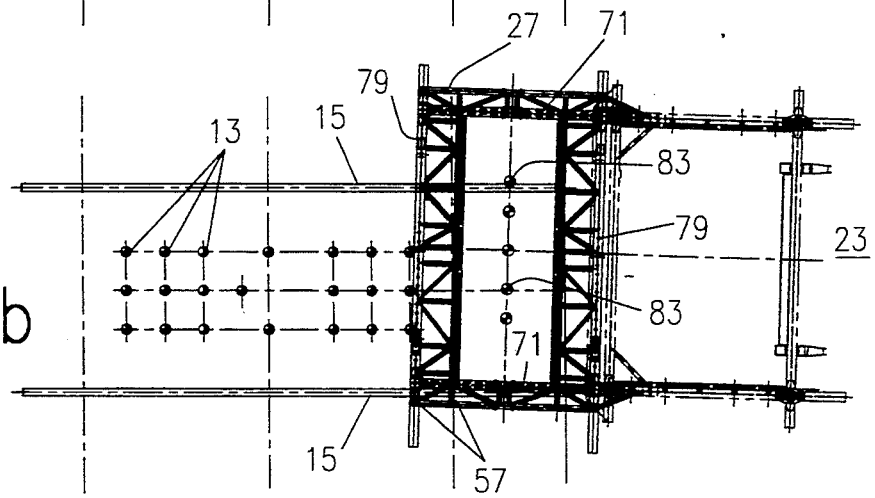
FIG. 3B shows the next step in transference, with the aft portion of the cantilever structure extended to place the aft capping beam feet in close, elevated relationship to the capping beams. The skid base is resting atop the aft capping beam feet (not shown) and the fore skid-off feet (not shown), corresponding to the stage of transfer shown in FIG. 2C.
Figure 3C:
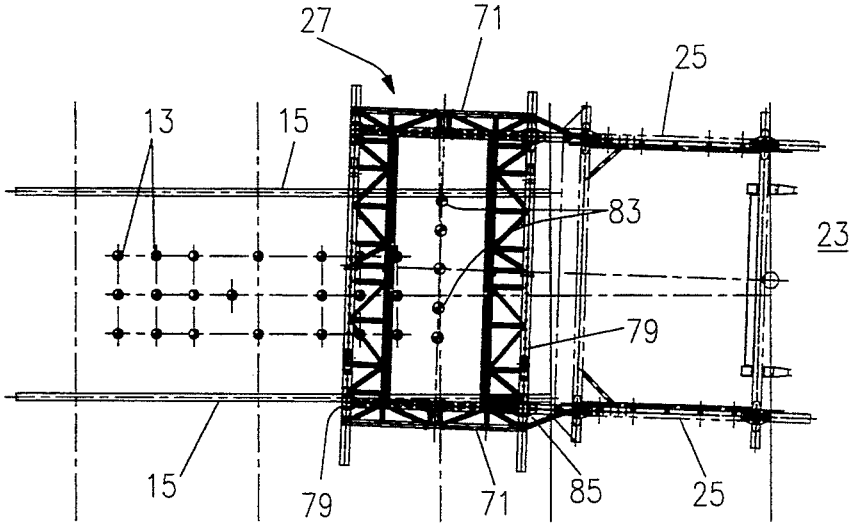
FIG. 3C shows a later stage of transference in which the skid base is resting entirely upon the fore and aft pairs of capping beam feet. The cantilever beams have been retracted to clear the fore skid-off feet and elevated to engage them with the spur beams on the skid base, corresponding to the stage shown in FIG. 2F. In this position, the drill floor package, including the derrick and the drill floor, may now be moved across the cantilever beams and onto the spur beams and the upper surface of the skid base.
Figure 3D:
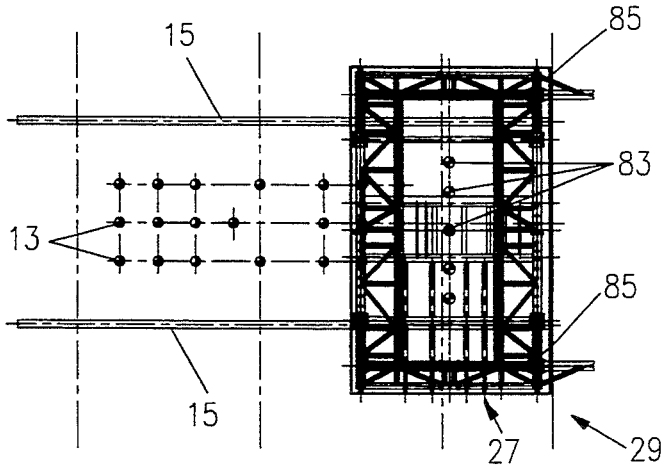
FIG. 3D shows a stage of transference, subsequent to FIG. 3C, in which the drill floor has been skidded onto the skid base, the skid base having been longitudinally aligned with the capping beams. The cantilever beams are not shown in this figure.

With the drill floor package 29 and skid base 27 entirely supported upon the cantilever beams 15, it is necessary to align the skid base with the capping beams, such that transverse movement of the drill floor package may easily be aligned with any of the drilling positions 13, illustrated in FIG. 3C.

To perform this alignment, the swivel mechanisms 61 and sliding mountings 63 of each of the capping beam feet are left in a free movement state. The walking mechanisms of each of the four capping beam feet are then selectively advanced in the aft direction, such that the skid base 27 freely follows the capping beam feet and translates about a vertical axis to align with the capping beams 15. This is easily accomplished, since axial directions of movement of the walking mechanisms have been aligned with the capping beams 15 during the transference of the skid base 27 onto the upper surfaces of the capping beams.

When each foot of the fore and aft pairs of capping beam feet 53 and 55 are transversely aligned, the skid base will necessarily be positioned in angular alignment with the capping beams. Transverse jack mechanisms that couple each of the capping beam feet to the underside of the skid base 75 may then be synchronized to move the skid base 27 and the drill floor package 29 transversely in relation to the capping beams 15, either to align the skid base with the desired drilling position or to center the skid base upon the capping beams.

Figure 16A:
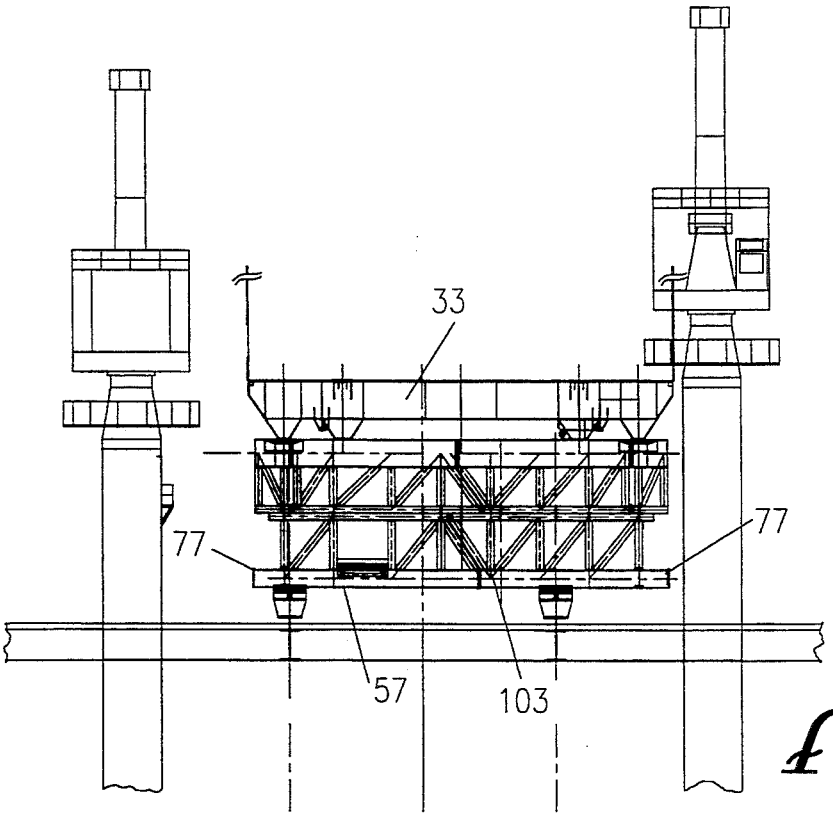
FIG. 16A shows a front view of the skid base and drill floor, wherein the skid base has been fitted with optional transverse base extensions; the skid base is shown as transversely displaced upon the capping beam feet to place the drill floor at a desired drilling position.
Figure 16B:
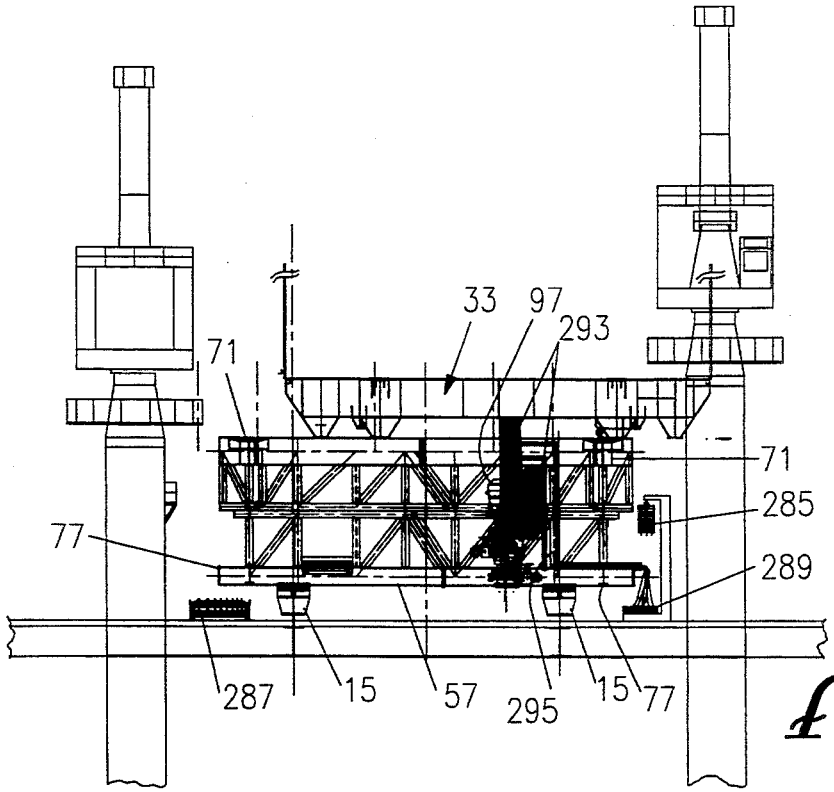
FIG. 16B shows the skid base and drill floor of FIG. 16A with the skid base generally centered upon the capping beams, but with the drill floor moved transversely on upper rails on the upper surface of the skid base, via all eight of its skidding feet.

As best seen in FIGS. 16A and 16B, the transverse skid base beams 57 on the underside of the skid base which mount the capping beam feet may be optionally equipped with transverse base extensions 77. These extensions are I-beams matched to the cross sectional shape of the skid base beams 57, to increase the range of transverse movement of the capping beam feet upon the underside of the skid base. Thus, using these extensions 77, the skid base 27 is equipped to handle abnormally large misalignment, which may occur, for example, during extreme weather conditions.

Figure 15A:
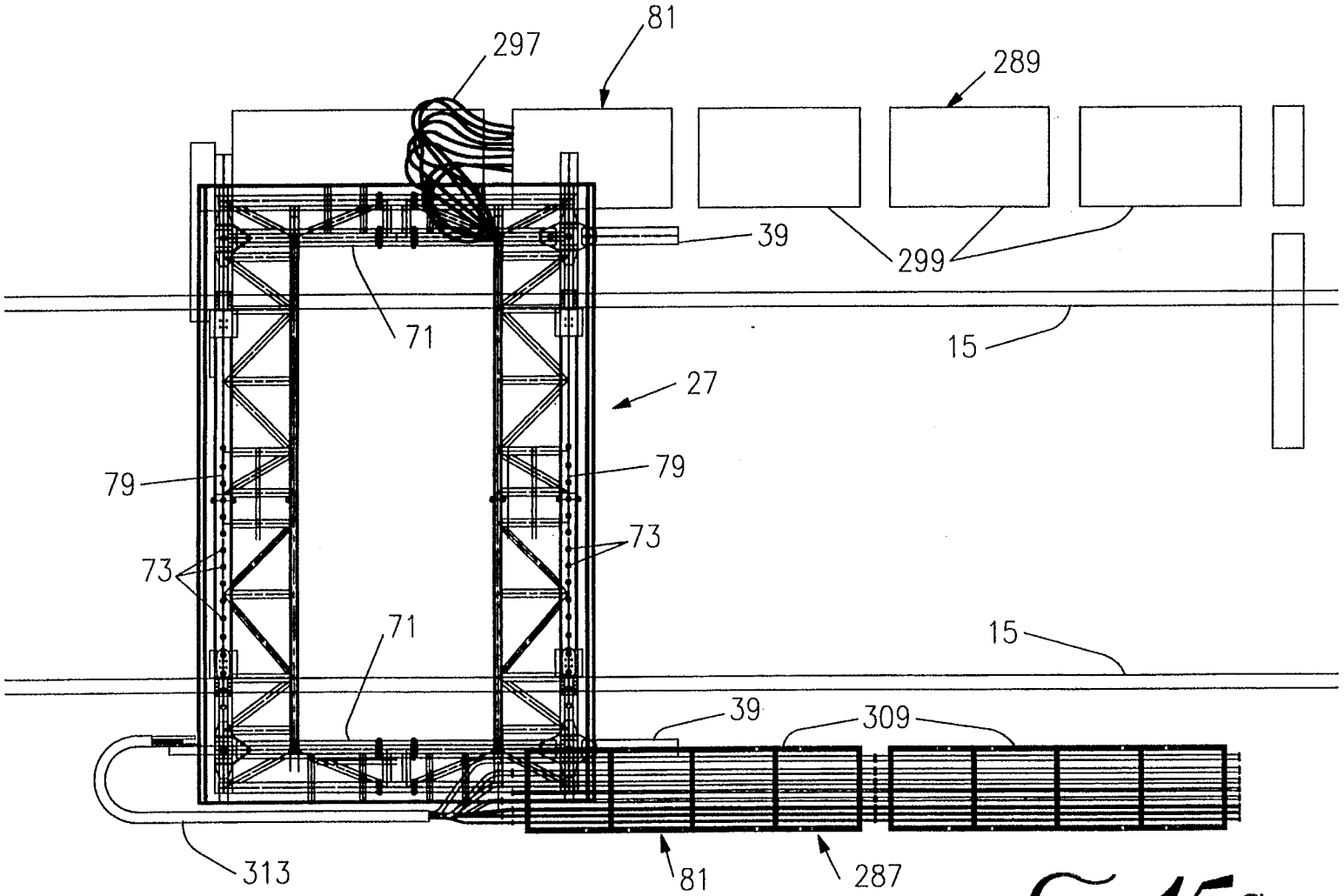
FIG. 15A is a plan view of the skid base, shown in an aft position upon the capping beams; adjacent to the skid base, a drag chain and a number of pipe "suitcases" couple service piping to the fore portions of the capping beams for supporting drilling operations; a similar array of suitcases are also shown as coupling the blow-out preventer and diverter to the fore portion of the capping beams, for connection to the jack-up rig.

Since the drill floor package 29 may itself be moved transversely along the upper rails 79 of the skid base, in normal preferred operation, the skid base 7 will be centered upon the capping beams 15 and the transverse base extensions will not be used. This is ideal if no wells have yet been drilled, because as illustrated in FIG. 15A, a number of piping and hose assemblies 81 are installed to couple the skid base with the tendering jack-up rig 19 for assistance of drilling operations. These assemblies may require movement or alteration if the skid base is moved after their installation. Thus, in drilling a multiplicity of adjacent wells, it is preferred that the skid base 27 rest in one transverse position while the drill floor substructure 33 is moved on the upper rails 79 to transversely position the drill floor package.

As seen in FIG. 3A, the upper surface 43 of the skid base includes two parallel longitudinal beams 71 that are spaced transversely by sixty feet and the two transverse upper rails 79, spaced longitudinally by forty feet (to match the spacing of the skidding feet of the drill floor substructure). As discussed below, the drill floor package 29 is moved transversely upon these upper rails for selection of the desired drilling position 13.

STRUCTURE AND OPERATION OF THE SPUR BEAMS AND LOCKING STRUCTURES

FIG. 5 shows a spur beam 39 in locked relation between the upper surface 43 of the skid base and the upper surface 37 of one of the cantilever beams. As seen in FIG. 5A, each of the spur beams 39 and the cantilever beams feature a plurality of the circular sockets 73 defined in their upper surfaces. As will be described below, each of these sockets are engaged by the dog mechanisms (mentioned above) that pull or push the drill floor package 29 in skidding movement along the upper surface of cantilever beams, across the spur beams 39 and onto the upper surface 43 of the skid base.

As best seen in FIG. 5A, the fore end of the spur beam includes a wedge-shaped hook 87 that downwardly engages a pin 93 of the locking structure 41 of the associated cantilever beam. This hook 87 is received between the prongs 89 of a fork 91 of the locking structure 41. The pin 93 is positioned at such a height relative to the locking slot 69, that as the cantilever beams 25 are elevated with their pins 93 aligned to the locking slots, the pins will align the upper surfaces of the spur beam 39 and the cantilever beams at the same horizontal level.

Thus, by elevating and lowering the hull of the jack-up rig 19 in relation to the skid base 27, the pin 93 may be seen to fit (FIG. 5B) snugly into the locking slot 69 of the spur beams, thereby enabling smooth transference of the drill floor package 29 across the spur beams and onto the upper surface 43 of the skid base.

STRUCTURE OF THE SKID BASE

As mentioned, the skid base 27 is of a rectangular, box construction and is utilized not only to support the drill floor package 29, but also to movably support the blow-out preventer 97 and other drilling equipment that are used to support drilling operations.

Figure 19A:
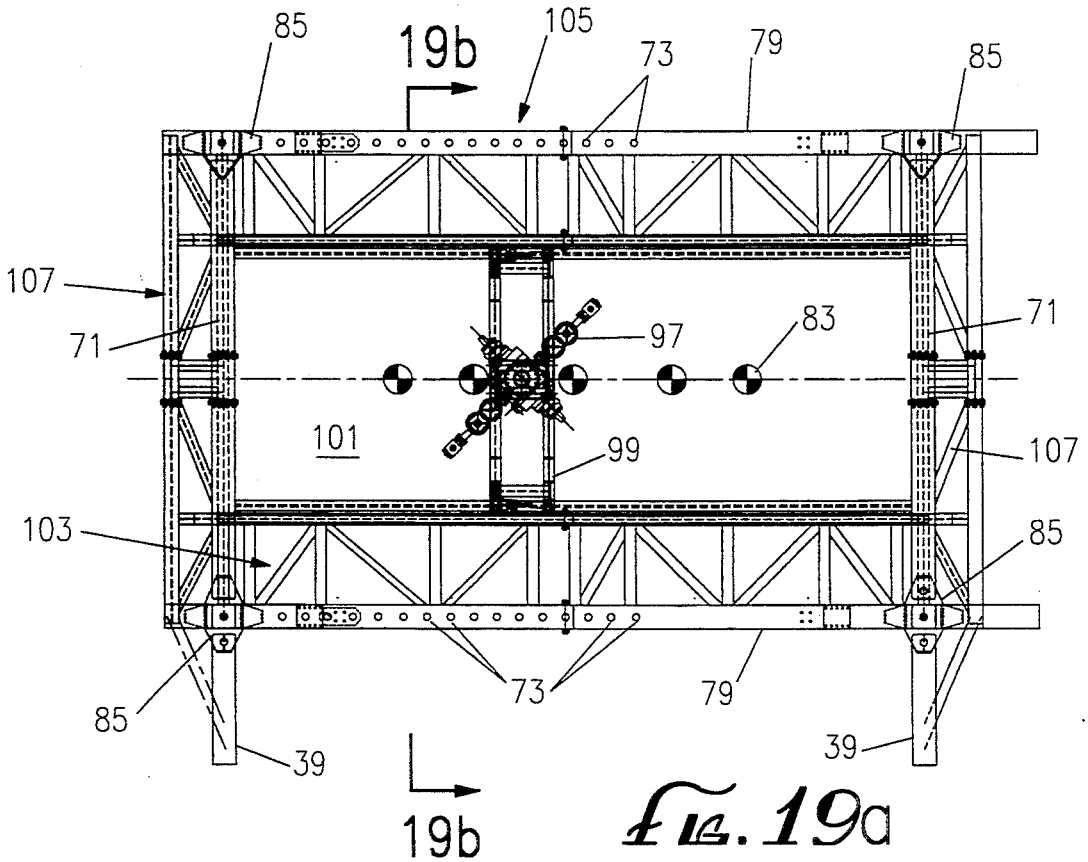
FIG. 19A ms a plan, cross-sectional view of the skid base, showing a blow-out preventer mounted within a center cavity of the skid base upon a transversely-slidable tray.
Figure 19B:
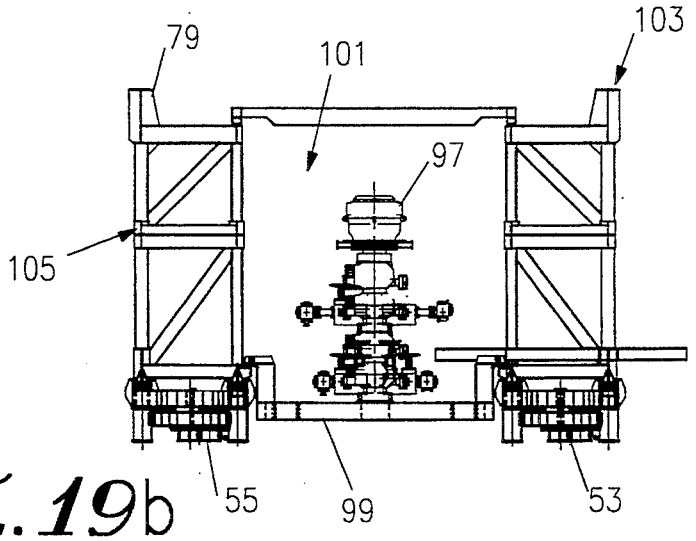
FIG. 19B shows a side view of the skid base of FIG. 19A, taken along lines 19B—19B.

As best seen in FIG. 19A, the blow-out preventer 97 is mounted on a transversely movable cart 99 within a center cavity 101 of the skid base. The skid base is comprised of fore, aft and side truss structures 103, 105 and 107 that structurally support the drill floor package 29 upon the upper surface of the capping beams 15. Two pairs of transverse skid base beams 57 (FIG. 19B) support the fore and aft truss structures 103 and 105, and also movably mount the capping beam feet, so that the latter may be transversely aligned to ride upon the capping beams.

On the upper surface of the skid base 43, the four truss structures 103, 105 and 107 each support a beam that will be used for movement of the drill floor package. As best seen in FIG. 19A, the two parallel longitudinal beams 71 that receive the drill floor package 29 from the jack-up rig 19 are supported by the two side truss structures 107 at a spacing of sixty feet. The fore and aft truss structures 103 and 105 each support the transverse upper rails 79 that movably mount the drill floor package 29, for transverse selection among a plurality of drilling locations 13.

As seen in FIG. 19A, the starboard half of the transverse upper rails of the skid base feature circular sockets 73 along a portion of their length. These sockets, as described further below, are adapted to be engaged with the dog mechanisms that move the drill floor package 29 transversely along these rails 79.

STRUCTURE AND OPERATION OF THE CAPPING BEAM FEET

Figure 6:
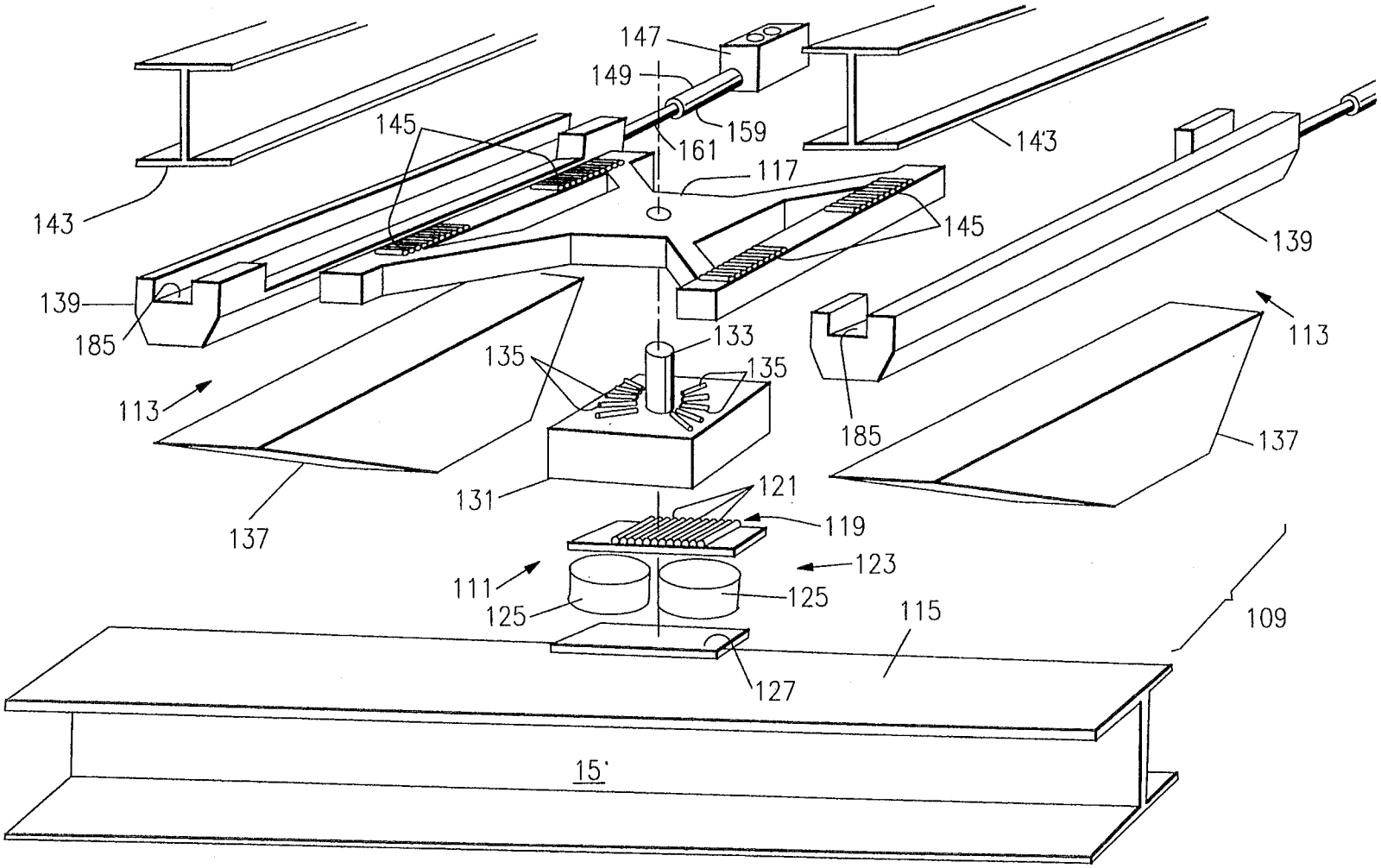
FIG. 6 shows a partially sectioned, perspective view of one of the capping beam feet used to support the skid base upon the capping beams. For simplicity, parts of the structure have been removed to make the relevant structure move easily visible.

FIG. 6 is a perspective exploded view of one of the four capping beam feet, all four of which are identical in construction. A center leg 111 and two outer legs 113 of a walking mechanism 109 permit the capping beam foot to "walk" axially along the surface of the associated capping beam 15. Although not shown, a pair of clamp mechanisms for each of the spaced, outer legs 113 retain those legs within a slight vertical range of the upper surface 115 of the capping beams, thereby limiting the walking motion of the capping beam foot to the upper surface of the capping beams, which accordingly, function as rails for the skid base 27.

The center leg 111 and spaced, outer legs 113 are alternately lifted and the center leg simultaneously moved, so as to thereby perform the walking motion. An "X"-shaped upper framework 117 operatively couples the spaced, outer legs 113 and the center leg 111, and mounts on its underside a rolling mechanism 119, which includes a plurality of longitudinally disposed rollers 121.

As shown in FIG. 6, the center leg 111 includes a pancake jack mechanism 123 having two vertical jacks 125, each with a three-inch stroke, and a capping beam pad 128, disposed to contact and ride upon the surface 115 of the capping beam and support the skid base in walking movement. A pair of horizontal walking jacks 120, although not shown, connect the center leg 111 to a lower framework 131 and thus operatively couple the spaced, outer legs 113 and the center leg. The lower framework 131 has a central pivot post 133 and a plurality of swivel rollers 135 which allow all of the lower framework, the center leg, the rolling mechanism, and lower pedestals 137 of each of the spaced, outer legs 113, to swivel with respect to the skid base beams 57, and thereby allow the direction of axial movement of the walking mechanism 109 to be oriented with the capping beam.

The "X"-shaped upper framework 117 and an upper pedestal 139 (of each of the outer legs) do not swivel with respect to the skid base beams 57. Rather, the upper framework and upper pedestal are affixed by clamps 141 to the lower flanged surface 143 of the two mounting skid base beams. The upper framework 117 mounts four roller sets 145 disposed in pairs for selectively supporting each of the mounting skid base beams. When the pancake jack mechanism 123 is actuated to maximum extension, these roller sets 145 are raised from a normally reclined position within the upper pedestals 139 to support the mounting skid base beams 57.

The two transverse skid base beams 57 that form the bottom surface of each of the fore and aft trusses 103 and 105 each jointly mount a pair of capping beam feet. Each of these capping beam feet feature two grippers 147 facing inwardly of the capping feet, such that the grippers of each foot within the fore and aft pairs of capping beam feet 53 and 55 each grip the same transverse skid base beams 57 and point toward each other. These grippers 147 are coupled to their associated capping beam foot with a transverse jack mechanism 149 that, when activated, causes the capping beam foot to move transversely relative to its grippers. The capping beam foot may thereby be moved transversely along its mounting skid base beams 57 to align with the capping beams 15 of the fixed platform during the aforementioned transference procedure. Alternatively, with all four capping beam feet supporting the skid base 27 upon their associated capping beams 15, actuation of the transverse jacks 149 may be synchronized to move the entire skid base 27 and drill floor package 29 transversely, with the capping beam feet remaining stationery upon the capping beams but moving with respect to the skid base beams 57.

When the pancake jack mechanism 123 has elevated the transverse sets of rollers 145 to support the skid base, the transverse jacks 149 may be actuated to provide relative movement between the capping beam foot and the grippers 147. The transverse clamp mechanisms 141 retain the upper pedestal 139 adjacent to the lower flange 131 of a mounting skid base beam, allowing transverse displacement when the skid base beam is engaged by the transverse rollers sets 145.

With this understanding of the principle components of the capping beam construction, the more detailed aspects of the capping beam feet will be discussed with reference to FIGS. 7–9.

Figure 7A:
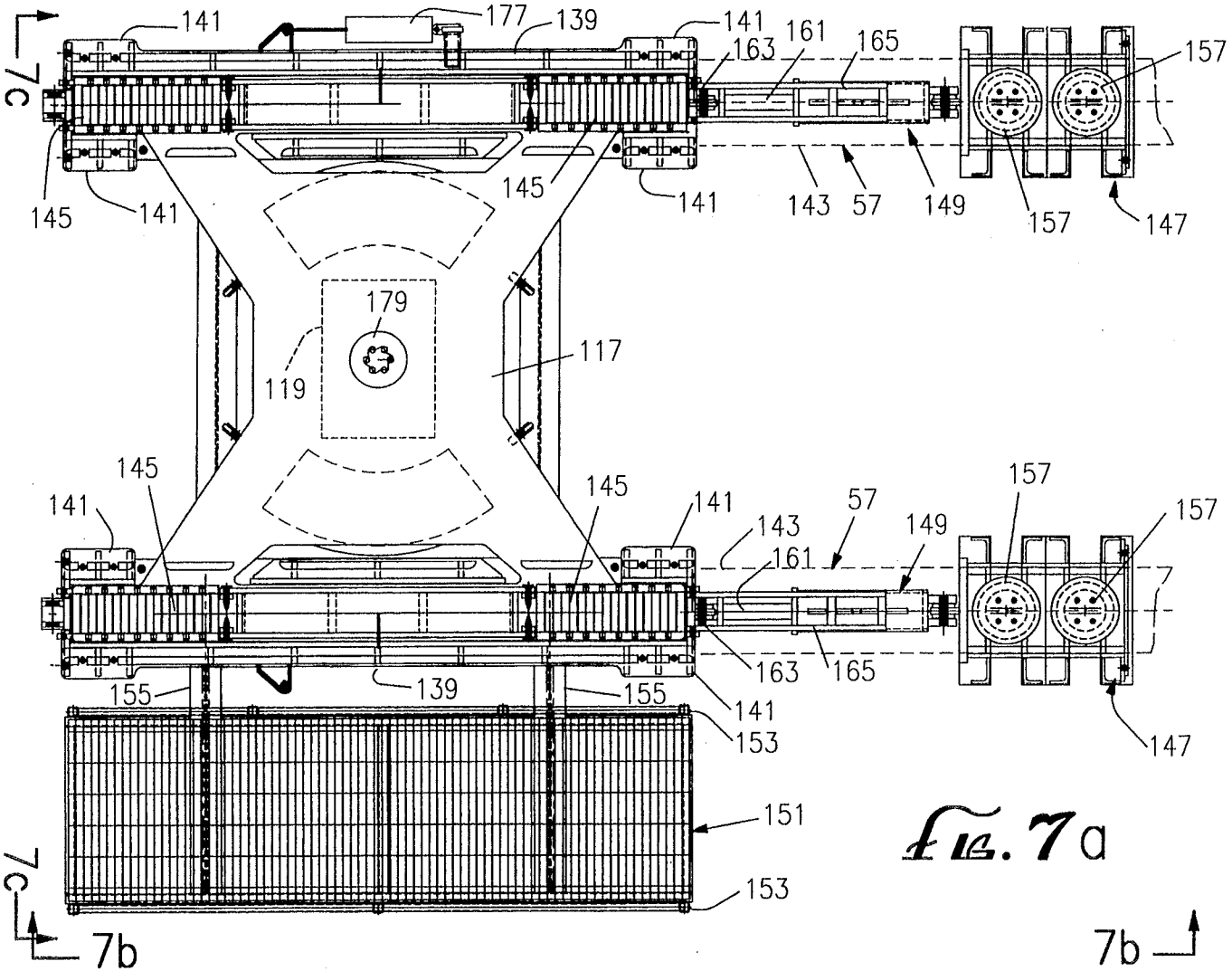
FIG. 7A is a plan view of a capping beam foot. It shows two transverse jack mechanisms for transverse movement between the capping beam foot and the skid base; and an adjacent operator platform.

FIG. 7A is a detailed plan view of one of the capping beam feet. Each capping beam foot includes an operator platform 151 having a number of hand rails 153 to ensure the safety of the operator. From the platform, the operator of each foot has access to the electronic controls of the various hydraulic jack mechanisms, described further below. Importantly, the skid base 27 itself is sufficiently immense that the operators may control alignment of the skid base and subsequently ensure continued alignment of the capping beam feet with the capping beams 15 by relying upon radio communication and line of sight. The operator platform 151 is connected to each capping beam foot by a set of lower support beams 155 that connect to one of the two spaced, outer legs 113.

The fore and aft spaced, outer legs 113 are connected by the "X"-shaped upper framework 117 at the center of the assembly, which movably mounts the center leg 111 of the walking mechanism 109. These outer legs are adapted to support the skid base 27 upon the capping beams in a static manner that does not permit any relative movement between the skid base and the capping beams (the capping beams are not shown in FIG. 7A but would extend from left to right).

Figure 7B:
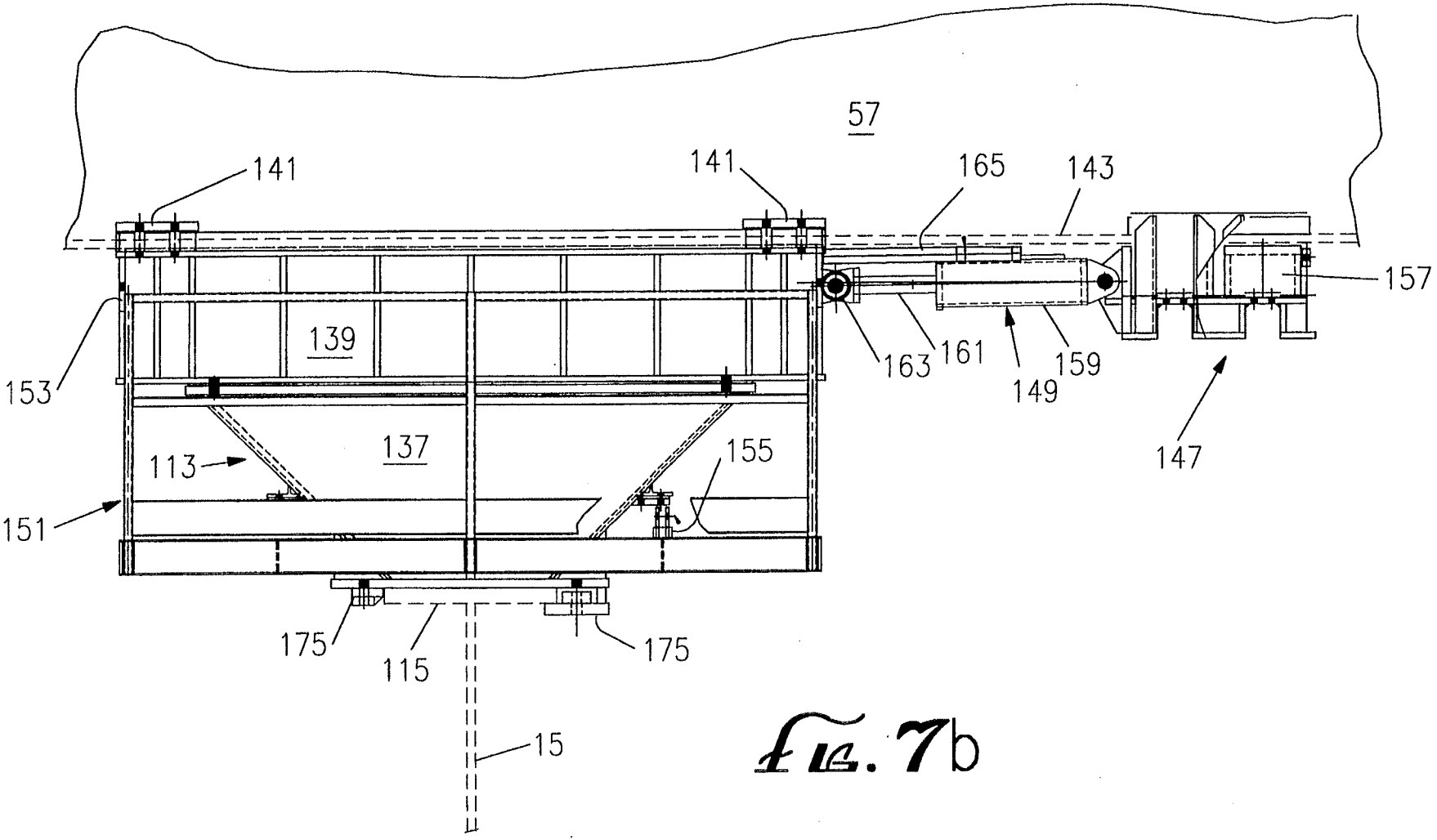
FIG. 7B is an end view of the capping beam foot of FIG. 7A, showing the capping beam foot mounted to the underside of the transverse skid base beam (forming a part of the skid base), a flange of the skid base beam being shown in phantom. The capping beam foot is shown in engagement with one of the capping beams, shown in phantom underneath the capping beam foot.
Figure 7C:
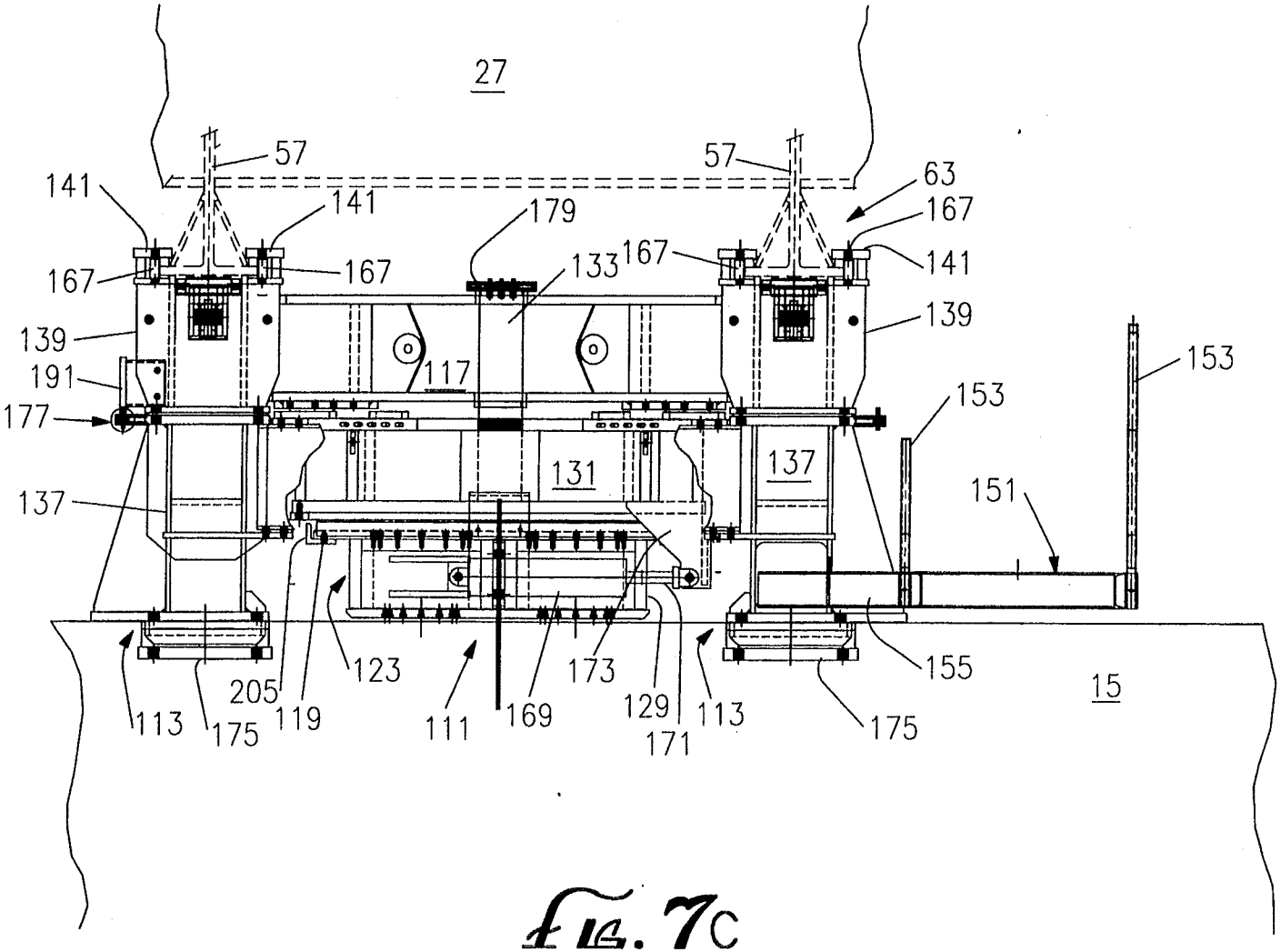
FIG. 7C shows a simplified side view of the capping beam foot shown in FIG. 7B, resting on one of the capping beams. In its upper region, it shows, in phantom, a pair of the skid base beams whose flanges are engaged by the upper pedestal of the capping beam foot.
Figure 8A:
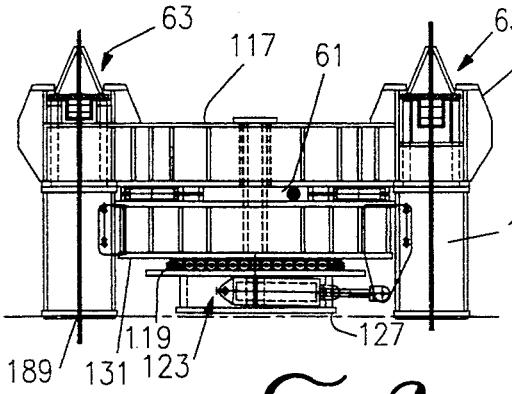
FIG. 8A shows a simplified view of the capping beam foot of FIG. 7C in an at-rest position, with two outer legs of the foot supporting the skid base and a center leg mechanism in a centered and raised position between the outer legs.
Figure 8B:
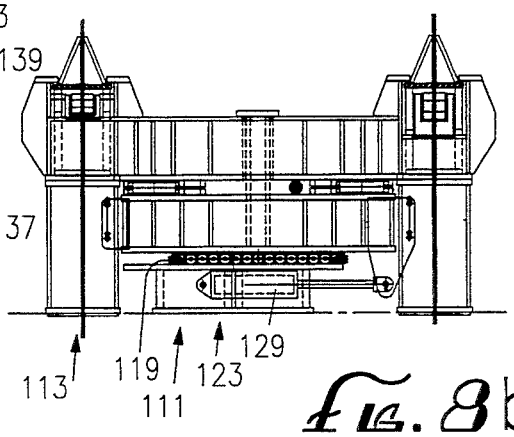
FIG. 8B shows the capping beam foot of FIG. 8A, but with the center leg moved horizontally to the left by a horizontal jack, towards one extreme position adjacent to one of the outer legs.
Figure 8C:
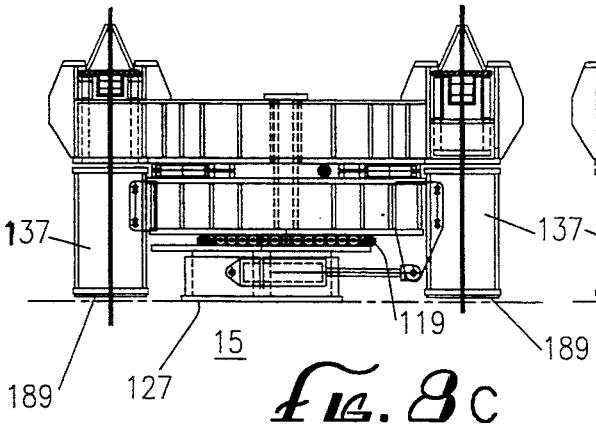
FIG. 8C shows the capping beam foot of FIG. 8B, with the center leg extended downwards into contact with the capping beams by a pancake jack, to lift both outer legs out of contact with the capping beam.
Figure 8D:
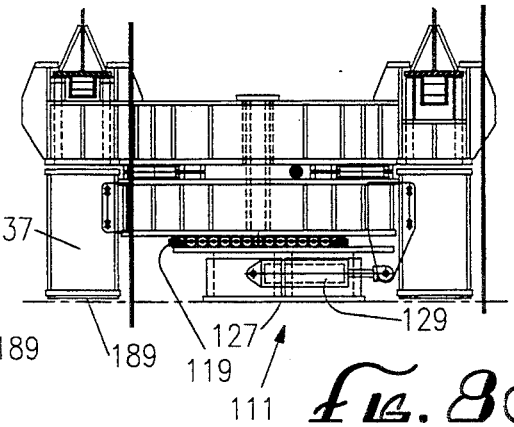
FIG. 8D shows the capping beam foot of FIG. 8C, after the walking jacks have been stroked in the reverse direction, thereby moving the raised outer legs (and the skid base) relative to the lowered center leg, with the weight of the skid base being borne through an intermediate row of longitudinal movement rollers to the center leg, thereby imparting movement of the skid base along the capping beam.
Figure 8E:
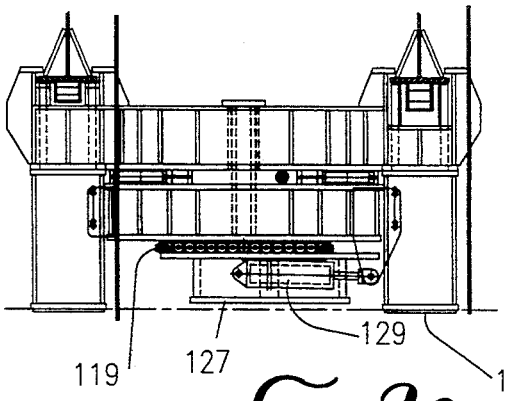
FIG. 8E shows the capping beam foot of FIG. 8D, with the center leg lifted upwards by the pancake jack and the outer legs lowered downwards into contact with the capping beam, thereby resuming their support of the skid base.
Figure 8F:
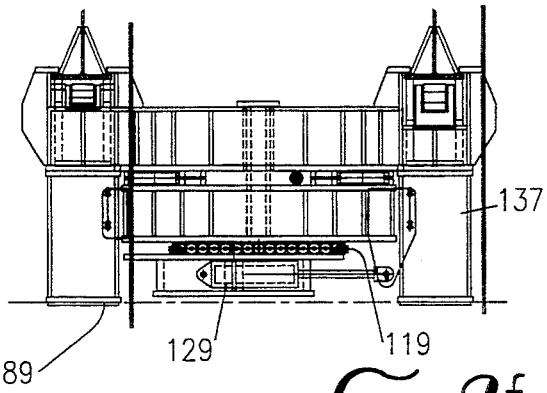
FIG. 8F shows the foot mechanism of FIG. BE, with the center leg moved again horizontally to the left by the walking jacks, the foot mechanism having completed one cycle of movement and ready to commence the next cycle as shown in FIG. 8B.

With reference to FIG. 7C, the center leg 111 of the walking mechanism 109 is mounted beneath the lower framework 131 with the rolling mechanism 119 therebetween, so as to provide sliding longitudinal contact between the lower framework and the center leg. The pancake jack mechanism 123 is selectively pressurized to cause the center leg 111 to extend downwards, thereby contacting the capping beam and lifting both of the spaced, outer legs 113 out of contact with the capping beam. The associated corner of the skid base 27 is then supported through all three sets of rollers 119, 135 and 145 and the center leg 111. The two horizontal walking jacks 129 are then used to impart relative sliding motion between the center leg 111 and the lower framework 131, which is connected to the lower pedestals 137 of the spaced, outer legs 113. The entire skid base 27 and the spaced, outer legs 113 are thereby moved over the longitudinal rollers 119 upon the center leg 111. The spaced, outer legs 113 may then be set back down and the center leg 111 lifted and returned towards an opposite outer leg while in the elevated condition.

The upper framework 117, shown in FIG. 7A, horizontally couples the two upper pedestals 139. As mentioned, at each corner of its "X"-shaped structure, the upper framework mounts transverse rollers 145 which provide relative movement between the capping beam foot and the two skid base beams 57 that mount it. Thus, the capping beam foot can readily be gauged to any conventional capping beam spacing, and synchronized with the other capping beam feet to move the skid base 27 transversely (by moving the skid base beams while the capping beam foot rests upon its associated capping beam 15). Each of the four transverse roller mechanisms 145 are part of a sliding mounting 63 of the capping beam foot that permits transverse relative movement with the two mounting skid base beams. The rollers actually ride within the upper pedestals 139 at reclined positions, and thus are normally maintained out of contact with the skid base beams 157, which are left to ride in static fashion upon the spaced, outer legs 113.

With reference to FIG. 7B, it is seen that the swivel rollers 135 are sandwiched between the upper and lower frameworks 117 and 131 to provide relative swivelling motion between the two. The upper framework 117 and upper pedestal 139 remain mounted to the skid base beams by means of the four aforementioned clamps 141, although the capping beam foot may selectively be moved sideways by the transverse roller sets 145 when they are elevated by the pancake jack mechanism 123 into load bearing relation with the skid base 27. The skid base beams 57, like the capping beams 15 and the cantilever beams 25, are all "I" shaped beams having flange portions extending from either side of the vertically disposed beams to thereby provide horizontal mountings and supports for each of the foot assemblies. Thus, four clamps 141 are utilized to clamp each of the spaced, outer legs 113 of the capping beam foot to the two mounting skid base beams, two clamps 141 for each outer leg 141 to retain each of the skid base beams. The clamps 141 may be selectively tightened by means of a plurality of bolts (not shown).

As indicated in FIG. 7C, the clamps 141 permit a small amount of vertical movement between the skid base beams 57 and the upper pedestals 139. When it is desired to move the skid base beams transversely relative to the capping beam foot, the upper framework 117 is raised by actuation of the pancake jack mechanism 123, and the transverse rollers 145 are thereby brought into contact with the lower surface of the skid base beams 143, lifting the skid base beams up slightly above the upper pedestals 139 as they make contact. The four clamps 141 also function as an upper stop for the transverse rollers 145, but allow for transverse movement once the transverse rollers have engaged the skid base beams.

Both (1) alignment of the capping beam feet with the capping beams and (2) subsequent transverse movement of the skid base upon the capping beam feet may be accomplished with the transverse hydraulic jacks 149. These jacks are mounted between each of the two spaced, outer legs 113 of the capping beam foot and the grippers 147 which are affixed to the skid base beams. With reference to FIG. 7B, one gripper 147 is shown in cut-away view, revealing one of two vertically-disposed hydraulic jacks 157. When the jacks are de-pressurized, the gripper may be slid with respect its mounting skid base beam 57. When the two vertical jacks 157 of the gripper are again pressurized, the gripper solidly clamps the skid base beam and does not permit any relative movement with respect thereto.

Each transverse hydraulic jack 147 includes a horizontally disposed cylinder 159 and a piston rod 161 that moves transversely with respect to the cylinder. The piston rod 161 is coupled to the capping beam foot by means of a pin assembly 163, as shown in FIG. 7B. The cylinder 159 of each jack is attached to the lower horizontal flanges 143 of the skid base beams by a frame 165 that slidably retains it in adjacent relationship to the skid base beams. As the capping beam foot will not normally be moved transversely with respect to the skid base during synchronized movement of the skid base 27 along the capping beams 15, a move spacer 167 may be inserted between an upper bracket of the clamps 141 and the skid base beams 57 to prevent transverse movement of the capping beam foot relative to the skid base beams.

FIG. 7C shows a side cross-sectional view of the capping beam foot and its walking mechanism 109. The walking mechanism includes the pancake jack 123, which is used raise and lower the center leg 111 and the frameworks 117 and 131 to transfer the weight of the skid base 27 onto the foot by lifting the spaced, outer legs 113 out of contact with the capping beams 15. Additionally, the walking mechanism 109 also includes the horizontal hydraulic jacks 129, each having a cylinder 169 coupled to the center leg and a piston rod 171 coupled to the lower framework at a finger 173, intermediate the two transverse lower pedestals.

Four capping beam clamps 175 are used to secure the capping beam foot upon the upper surface 115 of the capping beam, and also to guide movement of the capping beam foot with respect thereto. These clamps 175 retain the lower pedestals 137 in adjacent relationship to the capping beams, but allow for a small amount of vertical movement of the lower pedestals when lifted out of contact with a capping beam by the foot, which occurs during walking motion. As discussed below, the walking motion of the capping beam foot lifts the lower pedestals out of contact with the capping beams by less than two inches.

The upper framework 117 and lower framework 131 that couples the spaced, outer legs 113 are each respectively rotationally tied to the upper pedestal 139 and the lower pedestal 137. That is, when it is desired to swivel the capping beam foot, the pivot post 133, mounted at the center of the capping beam foot allows the lower pedestal 137, the lower framework 131 and the center leg 111 to swivel together with respect to the upper pedestal 139 and the upper framework 117, which are mounted by the skid base beams. This swivelling movement is selectively powered with a hydraulic swivel jack 177 that couples the upper and lower pedestals at the spaced, outer leg opposite the operator platform 151. That is, one spaced, outer leg mounts the operator platform 151 and the other, opposing spaced, outer leg mounts the swivel jack 177, each upon their respective exterior sides. The pivot post 133 is mounted by the lower framework 131 and fixed at its upper end above the upper framework 117 by a pivot cap 179, such that when the capping beam foot is supported in mid-air in preparation to be aligned and placed upon the capping beam 15, the upper and lower frameworks 117 and 131 and the two upper and lower pedestals 139 and 137 allow for powered swivelling movement by use of the swivel jack 177.

Figure 9A:
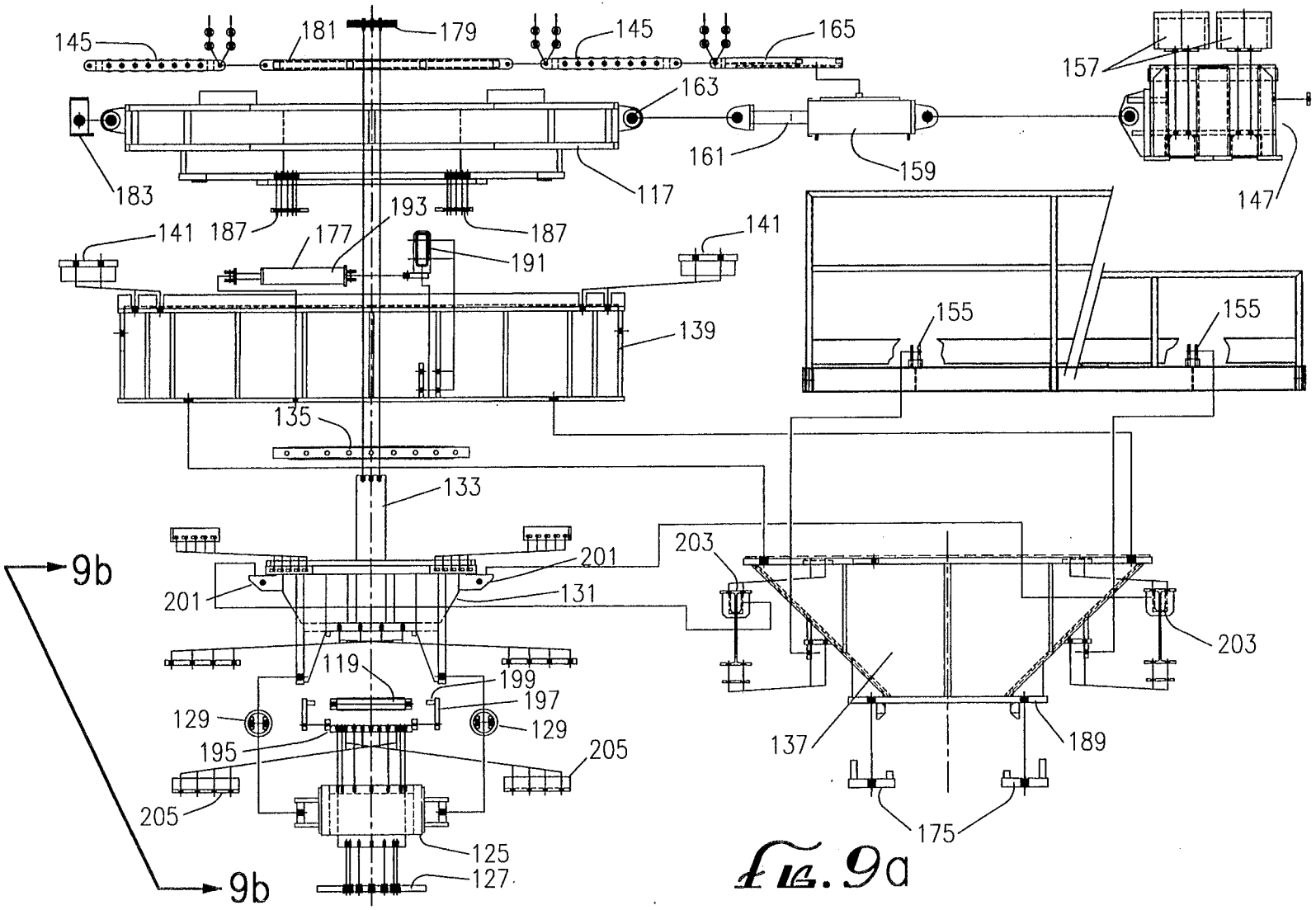
FIG. 9A is an exploded front view showing the parts of the capping beam foot of FIG. 7C.
Figure 9B:
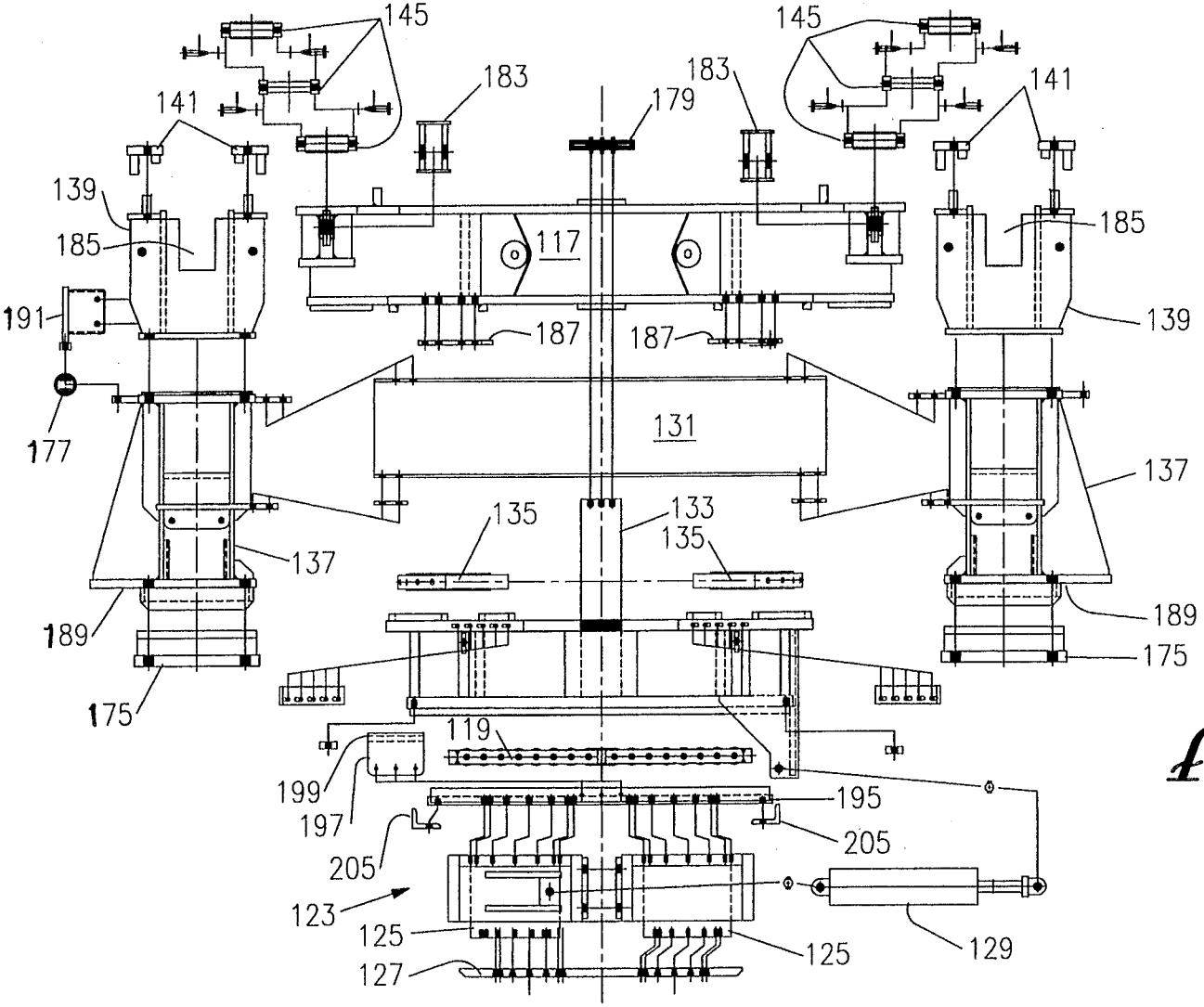
FIG. 9B is another exploded view of the capping beam foot of FIG. 9A, taken along lines 9B—9B.

The capping beam foot is illustrated in exploded detail in FIGS. 9A and 9B. With reference to FIG. 9A, it is seen that the upper framework 117 mounts a spacer 181 that transversely separates each two transverse roller sets 145. A stop 183 mounted at one side of the transverse roller sets within each upper pedestal 139 limits the range of the rollers. The-portions of the upper framework 117 which mounts the rollers ride within vertical cavities 185 with the upper pedestals 139. Both of the upper framework 117 and the lower framework 131 also mount swivel motion stops 187 for the two trays of swivelling rollers 135.

The lower pedestal 137 is trapezoid-shaped and rides below the upper pedestal 139 on either side of the lower framework 131. It features a bottom surface 189 that normally rides directly upon the capping beam and also mounts the capping beam clamps 175. In addition, one of the lower pedestals 137 (as shown in FIG. 9A) mounts the lower support beams 155 of the operator platform. The other opposing lower pedestal, as shown in FIG. 9B, is coupled to its associated upper pedestal 139 by the swivel jack 177. It is seen in FIG. 9B that the upper pedestal also mounts a vertical pin 191 for the cylinder 193 of the swivel jack, to enable the swivel jack 177 to power swivelling movement of the lower pedestals 137 with respect to the upper pedestals 139. As seen in FIG. 9B, the longitudinal rollers are contained within a roller tray 195 having two vertically disposed lateral arms 197. Each of these arms 197 has an inward flange 199, that retains the rollers within $\frac{1}{8}$ inch of the lower framework 131. As the pancake jack mechanism 123 is stroked, the entire roller tray 195 is forced upwards, thereby compressing the rollers 121 against the lower framework 131.

PRESSURIZATION OF THE PANCAKE JACK MECHANISM TO PROVIDE MOVEMENT WHEN THE SKID BASE IS SUPPORTED BY THE CAPPING BEAMS

The pressurization of the pancake jack mechanism 123 will now be described as it relates to the above mentioned parts. The pancake jack mechanism 123 has a stroke that allows for the center leg 111 to move downwards by three inches. First, the capping beam pad is normally maintained $\frac{1}{2}$ inch above the surface of the capping beam 15. After the pancake jack mechanism 123 is stroked $\frac{1}{2}$ inch downward, the continued pressurization of the pancake jack mechanism causes the longitudinal roller tray 195 to compress the longitudinal rollers 121 and swivel rollers 135 each upwards by up to $\frac{1}{8}$ inch, after which the frameworks are lifted by the pancake jack mechanism 123 through these rollers. The transverse roller sets 145 mounted by the upper framework 117 are, if no moving spacers 167 are mounted as shown in FIG. 7C, forced $\frac{3}{8}$ inch upwards to contact the skid base beams 57 and lift them a further $\frac{3}{8}$ inch with respect to the upper pedestals 139. At this point, the pancake jack mechanism 123 has been stroked downwards by $1\frac{3}{8}$ inches, and the transverse roller sets 145 contact the roller stop (clamps 141) and cannot be lifted further, relative to the upper pedestal 139. The upper pedestal 139 does move $\frac{3}{8}$ inch upwards and out of contact with the lower pedestal, and the vertical coupling pin 191 of the swivel jack 177 is appropriately configured as a sliding coupling, such that the swivel jack moves together with the lower pedestals 137. In addition, two male members 201 of the lower framework contact the upper termination of transversely disposed slots 203 within each of two lower pedestals 139, and thereafter lift the lower pedestals 137 off of the capping beam the remaining $1\frac{5}{8}$ inches.

AXIAL MOVEMENT OF THE WALKING MECHANISM ALONG THE UPPER SURFACE OF THE CAPPING BEAM

With reference to FIG. 8, the walking steps of the capping beam feet will now be explained in greater detail, insofar as they relate to the normal walking cycle of the walking mechanisms. FIGS. 8A and 8B respectively show a capping beam foot at a normal (at-rest) position with the pancake jack mechanism 123 de-pressurized, and also with the horizontal walking jacks 129 fully stroked in preparation for movement. Thereafter, to commence walking movement, the pancake jack mechanism 123 is stroked to move the capping beam pad 127 (of the center leg) downwards three inches, as just described, with the lower pedestals 137 thereby elevated above the surface of the capping beam (FIG. 8C). FIG. 8D illustrates the subsequent movement of the spaced, outer legs 113 and the skid base 27 with respect to the capping beams 15, as the horizontal walking jacks 129 are contracted, thereby pulling the skid base along the set of longitudinal roller mechanism 119 atop the center leg 111 until a longitudinal roller stop 205 is reached. Subsequently, the pancake jack mechanism 123 is de-pressurized, such that the skid base 27 is once again statically supported upon both spaced, outer legs 113. Finally, with the center leg 111 fully elevated (½ inch above the capping beam), it is again extended by the horizontal walking jacks 129, as shown in FIG. 8F, and is ready for another "step." In this manner, each of the capping beam feet are used to axially move the skid base along one of the capping beams, with the skid base freely supported by the swivel mechanism 61 and the sliding mounting 63.

If desired, after alignment of the skid base 27 upon the capping beams 15, the move spacer may be optionally inserted to retain the capping beam feet in rigid transverse relation to the skid base, and a pair of inch shim plates inserted between the upper and lower pedestals to prevent swivelling movement. It has been found in practice, however, that these are not necessary.

TRANSVERSE MOVEMENT OF THE CAPPING BEAM FOOT WITH RESPECT TO THE SKID BASE

Transverse movement of the capping beam foot may be divided into two categories, including movement of the foot while suspended in mid-air for alignment upon the capping beams 15 and synchronized transverse movement of the skid base 27 once the capping beam feet are in load bearing relation on the upper surface of the capping beams.

With respect to the former, it is not necessary to engage the transverse roller sets 145 with the skid base beams 57 in order to allow transverse movement of the capping beam foot while in mid-air. This is because the capping beam foot, essentially a large jack mechanism, is of sufficiently small mass that the transverse hydraulic jacks 149 may move the capping beam foot transversely, notwithstanding absence of contact of the transverse roller sets 145 with the skid base beams.

The operator of each capping beam foot has control over each of the hydraulic jack mechanisms of each foot, including the vertical hydraulic jacks 157 located within each gripper 147. Accordingly, if it is necessary to move the capping beam foot more than the approximately seven-foot stroke of the transverse hydraulic jacks 149, the operator may selectively de-pressurize and advance the grippers 147 transversely using the transverse hydraulic jacks. Once the grippers are at the desired location, the operator may repressurize the vertical hydraulic jacks 157 within the grippers to retain them in rigid relationship to their mounting skid base beams. In this manner, the capping beam feet may be moved in inchworm fashion transversely to align with any gauge of capping beams.

When the capping beam feet are in load bearing relation on the upper surface of the capping beams, it is necessary to pressurize the pancake jack mechanism 123 of each capping beam foot in order to synchronize transverse movement of the skid base 27. Accordingly, the pancake jack mechanism 123 brings the center leg 111 into contact with the supporting capping beam, and strokes the leg downward between 1 and 1⅜ inches, so that the spaced, outer legs 113 remain in contact with the capping beams 15 while the skid base beams 57 are supported on the transverse roller sets 145. The transverse hydraulic jacks 147 of all four capping beam feet are then synchronized to move the skid base 27 in either the port or the starboard directions. Again, if it is desired to move the skid base more than the range provided by one of the transverse jacks 149, the transverse jacks may be used to reposition selectively de-pressurized grippers 147 so as to further move the skid base.

As indicated above, the skid base may also be equipped with up to eight transverse base extensions 77 that increase the length of the transverse skid base beams 57, to thereby provide for a further range of transverse motion of the skid base 27 upon the capping beam feet.

POWERED SWIVELLING MOVEMENT OF THE CAPPING BEAM FOOT FOR ORIENTATION UPON THE SKID BASE

As with the transverse movement of the capping beam feet when suspended in mid-air, the walking mechanisms 109 of the capping beam may be swiveled using the hydraulic swivel jack 177. The walking mechanism is not a sufficiently great mass that friction prevents its swivelling movement and accordingly, the walking mechanisms may be aligned with the capping beams, notwithstanding that the swivel rollers 135 are ⅛ inch out of contact with the upper framework 117.

Once the aft capping beam feet are in load bearing relation upon the capping beams during the aforementioned transfer of the skid base 27 to the fixed platform 11, the center leg 111 is stroked downwards by 1⅜ inches, so that the swivel rollers 135 are compressed between the upper and lower frameworks 117 and 135 and the upper pedestals 139 are lifted from the lower pedestal 137, thereby enabling swivelling motion between the walking mechanisms 109 and the skid base 27 to occur. The skid base is then in a state of simultaneous, swivelling and transverse sliding, with respect to the capping beams 15.

STRUCTURE AND OPERATION OF THE SKID-OFF FEET

Figures 10A, 10B, 10C:
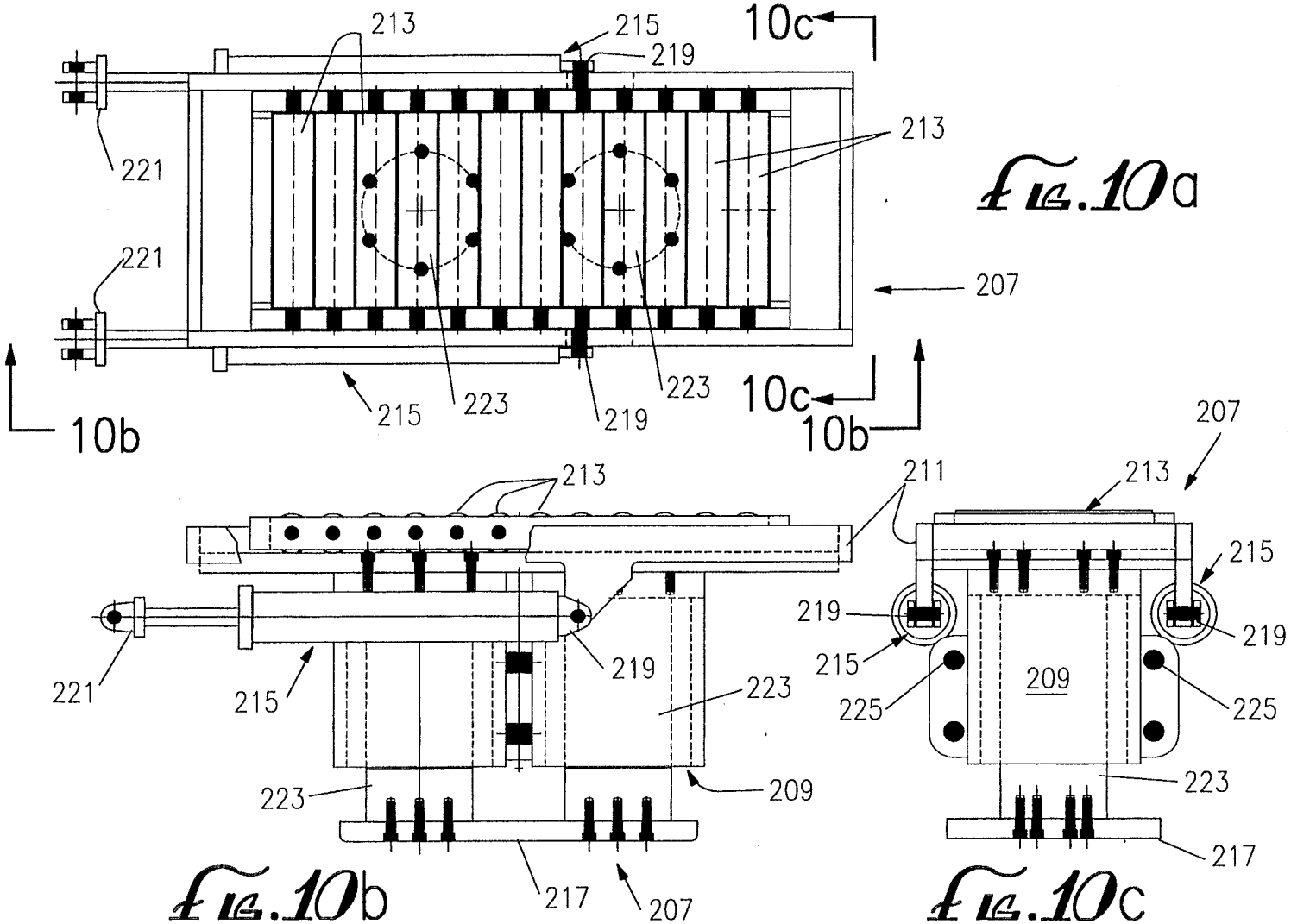
FIG. 10A is a plan view of the center leg of an aft skid-off foot, not including the outer legs, which complete the walking mechanism.
FIG. 10B is a side view of the aft skid-off foot of FIG. 9A, taken along lines 10B—10B.
FIG. 10C is rear view of the aft skid-off foot of FIG. 10A, taken along lines 10C—10C.

The aft pair of skid-off feet 51 that are used to power movement of the skid base 27 upon the cantilever beams 25, are quite similar in construction to the walking mechanisms 109 of the capping beam feet. They do not, however, feature the swivel mechanism 61 employed by the capping beam feet. As shown in FIG. 10, a center leg 207 of the aft pair of skid-off feet 51 includes a pancake jack mechanism 209, a longitudinal roller base 211 and rollers 213, a pair of horizontal walking jacks 215, and a cantilever pad 217 disposed on the bottom of the center leg for contacting and riding upon the cantilever beam 25. The aft pair of skid-off feet, like the capping beam feet, also include two spaced, outer legs (not shown).

The roller base 211 mounts a plurality of rollers 213 that permit longitudinal movement of the center leg 207 with respect to the spaced, outer legs. It supports the rollers 213 in close adjacent relationship to the underside of a static framework that mounts the spaced, outer legs to the skid base, much as the longitudinal roller tray 195 of the capping beam feet slidably retains the longitudinal rollers against the lower framework 131. As with the capping beam foot walking mechanisms 109, described earlier, two vertically disposed arms (not shown) on each side of the roller base 211 mount the roller base, to thereby sandwich the roller base between the center leg 207 and the static framework. The two horizontal walking jacks 215, each having a cylinder end 210 connected to the center leg and a rod end 221 connected to one of the spaced, outer legs, are used to move the outer legs and the skid base with respect to the center leg when one or the other is in contact with the cantilever beam surface. The pancake jack mechanism 209, as with the capping beam feet, includes two vertical jacks 223 that extend the cantilever pad 217 downward into contact with the cantilever beam, thereby lifting the spaced, outer legs. The two horizontal walking jacks 215 are then expanded or contracted depending upon the direction that the skid base 27 is to be moved, in an identical cycle to that shown for the capping beam feet in FIG. 8. When the horizontal walking jacks 215 have reached the end of their stroke, the pancake jack mechanism 209 returns the spaced, outer legs into contact with the cantilever beam and lifts the center leg 207 out of contact with the cantilever beam 25, so that the piston may be back-stroked. Although not shown, the spaced, outer legs also feature two skid-off clamps which may be selectively pinned downward to lock a horizontal flange of the cantilever beam to the aft pair of skid-off feet 51, or may be pinned upwardly using the locking apertures 225 shown in FIG. 10C.

Figure 12A:
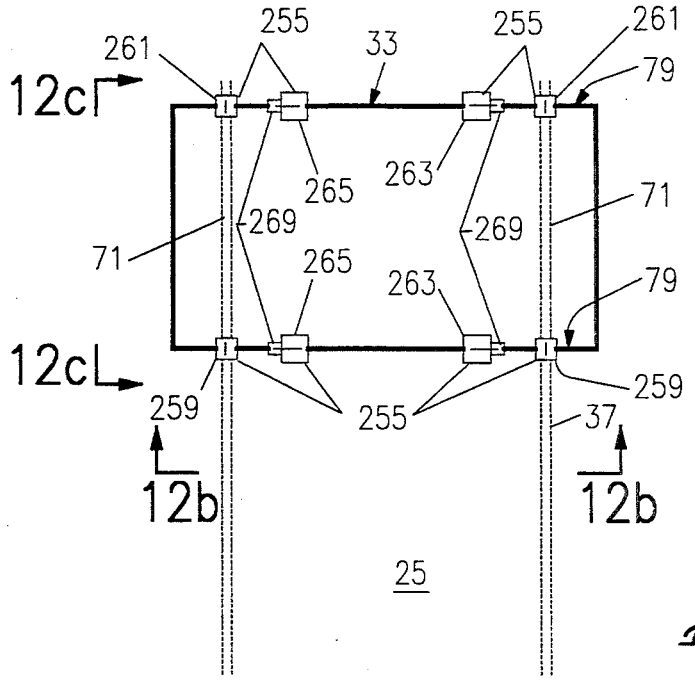
FIG. 12A is a plan schematic view of the drill floor, showing the arrangement of eight skidding feet that are vertically disposed below the drill floor to support the drill floor on the upper surface of the skid base.

FIG. 12 illustrates the construction of the fore pair of skid-off feet 49, which are somewhat different from the aft pair of skid-off feet and which also do not have swivel mechanisms 61. The fore skid-off feet do include, however, a single outer leg 227, a transverse roller set 229, and a transverse roller tray 231, to allow the fore skid-off feet to move transversely to align with the cantilever beams. The fore skid-off feet are mounted upon 60 foot centers, but are slightly adjustable in spacing by means of a transverse jack 233 that couples the fore skid-off feet to an interior location on the underside 75 of the skid base 27.

Two vertically disposed lateral arms, similar to those described in connection with the capping beam feet and the skid-off feet, sandwich the transverse roller set 229 between the fore skid-off foot and a mounting skid base beam, and allow for rolling movement between that fore skid-off foot and the mounting skid base beam. The transverse jack 233 is pivotally-coupled to the mounting skid base beam and also to a vertical jack 235 of the skid-off foot to provide this movement. When the vertical jack 235 is extended, weight of the skid-base is transferred from the outer leg and onto the center leg 227 which has three sets of freely- rotating Hillman rollers 237.

In this regard, the fore pair of skid-off feet 49 do not perform walking motion, as do the capping beam feet and the aft pair of skid-off feet, but rather are maintained in either a condition in which the outer leg of the fore skid-off foot supports the skid base 27, or alternatively, the center leg 227 via the freely-rotating Hillman rollers 237.

The underside 239 of the transverse roller base mounts the cylinder 241 of the vertical jack 235, whereas the piston 243 is mounted by a plurality of mounting bolts to the Hillman rollers 237. The Hillman rollers, illustrated in FIG. 11D, include a continuous roller track and a plurality of rollers, which allow the fore pair of skid-feet 49 to move when in contact with the cantilever beam 25 under the influence of one of the aft pair of skid-off feet or the aft pair of capping beam feet 55.

Figure 11A:
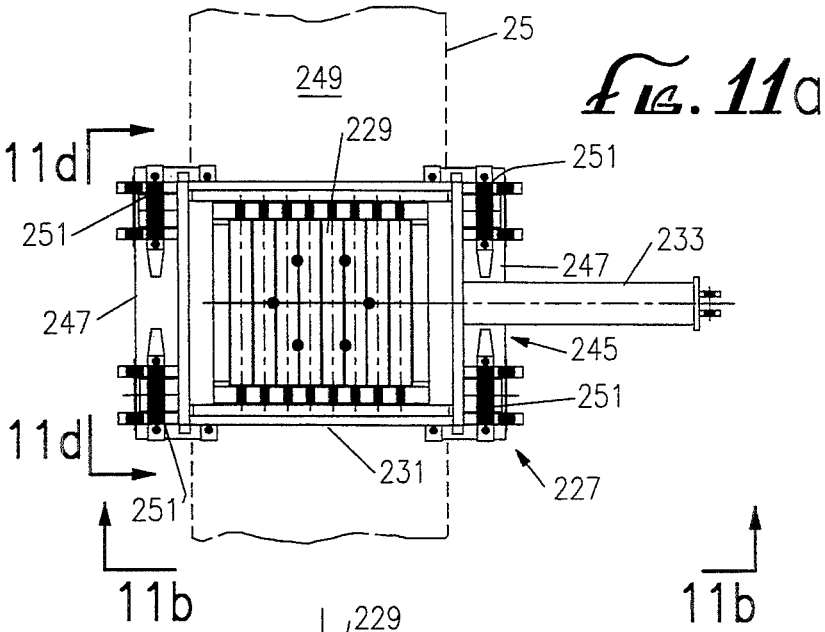
FIG. 11A is a plan view of a fore skid-off foot, showing in phantom a cantilever beam located beneath the foot mechanism.
Figure 11B:
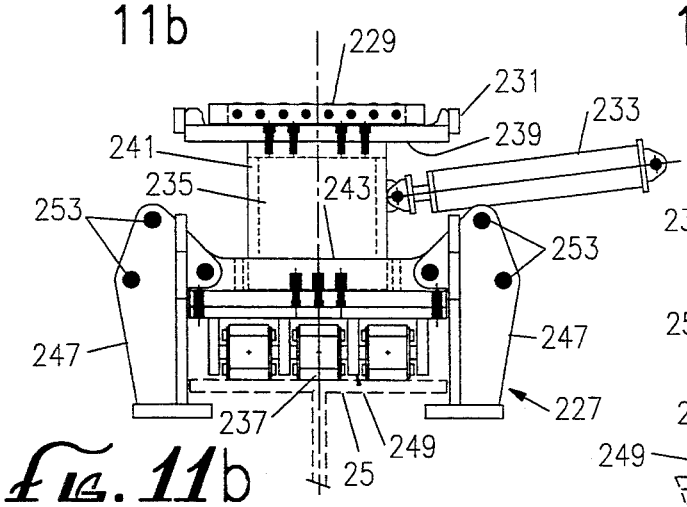
FIG. 11B is a rear view of the fore skid-off foot of FIG. 11A, taken along lines 10B—10B.
Figure 11D:
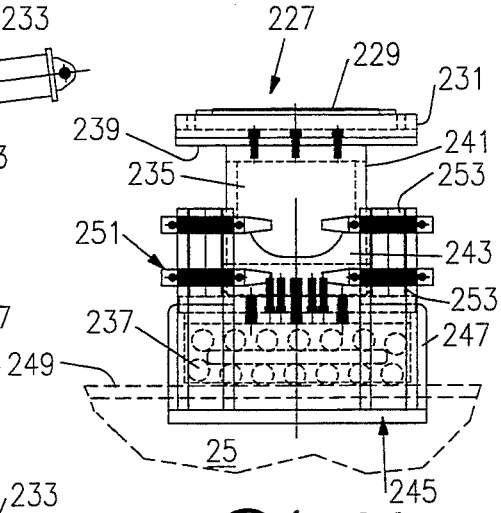
FIG. 11D is a side view of the fore skid-off foot of FIG. 11A, taken along lines 11D—11D.
Figure 11C:
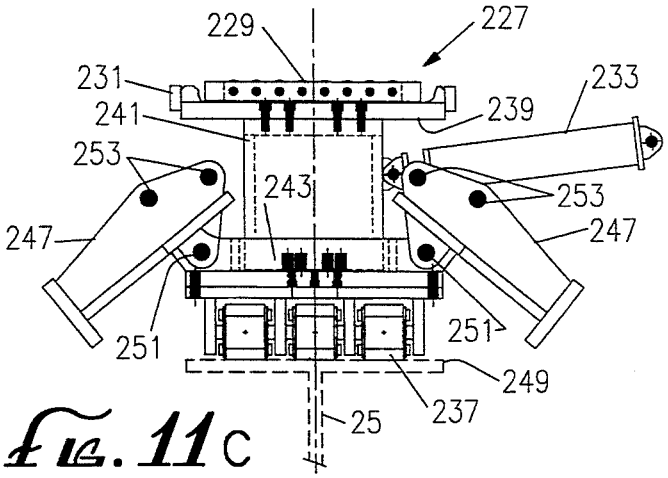
FIG. 11C is a view of the fore skid-off foot of FIG. 11B, showing a two member clamp mechanism, with each member pivoted outwards and pinned to allow placement and removal of the fore skid-off foot with the cantilever beam.

The fore pair of skid-feet 49 also mount a cantilever hold down clamp 245, which is composed of two L-shaped flanks 247 pivotally-mounted to lock the skid-off foot against the horizontal surface 249 of the I-shaped cantilever beam. As shown in FIGS. 11B and 11C, each L-shaped flank 247 includes two pivotal mounting pins 251 and two locking holes 253 that may be used to pin the L-shaped flanks in locking and guiding engagement with the horizontal flange of the cantilever beam, as shown in FIG. 11B. Alternatively, the L-shaped flanks may be pinned in open relationship, to allow the fore skid-off foot to be removed from or placed upon the associated cantilever beam, during transference of the skid base.

STRUCTURE AND OPERATION OF DRILL FLOOR SKIDDING AND THE SKIDDING FEET

As discussed earlier, eight skidding feet 255 are vertically disposed below the bottom of the drill floor substructure 33 to support the drill floor package 29 on the upper surfaces of the cantilever beams and skid base 37 and 43.

Two pairs of longitudinal skidding feet 259 and 261 are arranged upon a sixty foot transverse center, to correspond to the width of the cantilever beams and the longitudinal support beams 71. The remaining (port and starboard) transverse pairs of skidding feet 263 and 265 are mounted about forty foot transverse center and are used to support the drill floor package 29 only upon the upper rails 79 of the skid base. The four transverse skidding feet 263 and 265 will support the drill floor package 29 upon these rails 79, and accordingly are spaced apart in pairs by forty feet to correspond to the spacing between the upper rails 79. The two pairs of longitudinally disposed skidding feet 259 and 261 are used to support the drill floor package 29 only during longitudinal movement onto and off of the skid base.

Figure 12B:
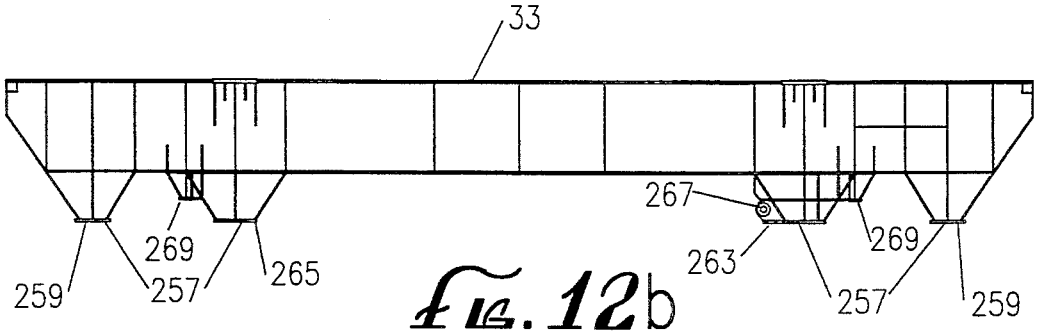
FIG. 12B shows an aft view of the drill floor with four skidding feet shown, the aft pair of longitudinally disposed skidding feet, and aft ones of the port and starboard pairs of transversely disposed skidding feet.
Figure 12C:
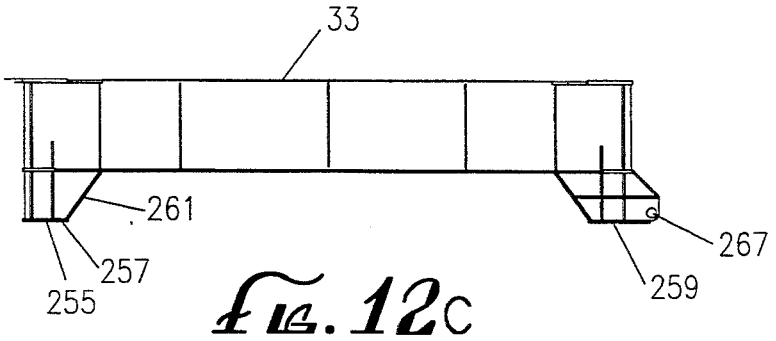
FIG. 12C shows a side view of the drill floor of FIG. 12A, taken along lines 12B—12B.

As shown in FIGS. 12B and 12C, the fore pair of longitudinal skidding feet 259 and the starboard pair of transverse skidding feet 265 feature eye-sockets 267 which are used to pivotally mount the pair of dog mechanisms that move the drill floor package 29 longitudinally upon the cantilever beams and the skid base, and also transversely upon the skid bare. Notably, none of the eight skidding feet 255 feature bearings that provide free movement between the skidding feet and the beams upon which they ride. Rather, the dog mechanisms simply pull or push the drill floor package 29, causing it to move with respect to its support beams, using them as rails.

Figure 3E:
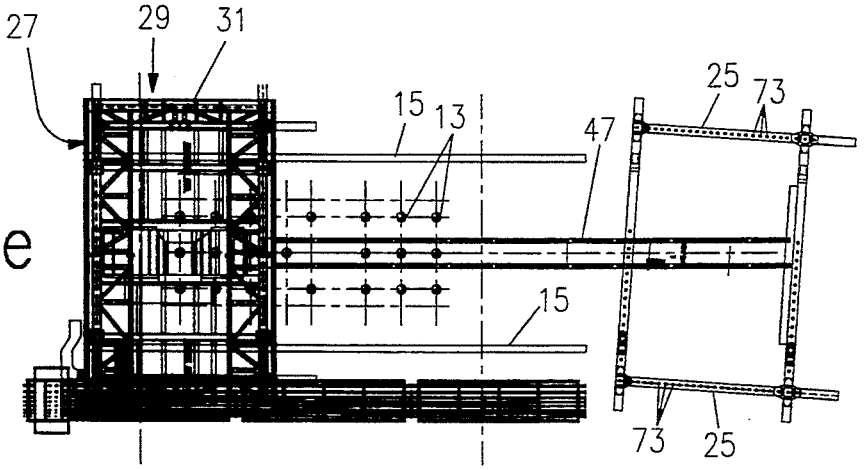
FIG. 3E shows the skid base further moved along the capping beams in the aft direction to a desired drilling position.

To move the drill floor package 29, the dog mechanisms are coupled to either the fore pair of longitudinally disposed skidding feet 259 or the starboard pair of transversely disposed pair of skidding feet 265 to move the drill floor package in the correspondingly desired directions. As best seen in FIGS. 3E, the transverse upper rails 79, like the longitudinal beams 71 and cantilever beams 25, feature a number of circular sockets 73 that are used to move the drill floor package. Since only the starboard pair of transversely disposed skidding feet 265 have eye-holes for mounting the dog mechanisms, only the starboard side of the transverse upper rails 79 of the skid base define circular sockets for moving the drill floor package transversely.

Each dog mechanism (not shown) includes a hydraulic jack, featuring a piston rod, a hook mechanism at one end of the piston rod that engages the circular sockets 73, and a cylinder that supports the rod along a longitudinal axis of movement. These cylinders are each pivotally coupled to the skidding feet by a removable pin, allowing the dog mechanisms to be used alternatively for movement in both the longitudinal and transverse directions.

The dog mechanisms are pivoted downwards, adjacent to the supporting beams, and their associated hooks engaged with a circular socket 73. Once the hooks of both dog mechanisms are so engaged, the dog mechanisms are synchronously either extended or retracted to push or pull the drill floor package 29 in the desired direction. When the movement of the hydraulic jack is completed, the hook mechanism is disengaged and moved (by retraction or extension of the jacks) to engage the next circular socket 73. In this manner, the drill floor package 29 is advanced along its supporting beams in inchworm fashion.

The transverse skidding feet (the port and starboard pairs) are elevated to allow the drill floor substructure 33 to be positioned upon the upper rails 79 of the skid base. As seen in FIG. 12B, each of the transverse skidding feet feature a jacking pad 269 disposed adjacent to the skidding foot for this purpose. When the drill floor substructure 33 is to be skidded onto the upper surface 43 of the skid base, these jacking pads are used to support the drill floor substructure 33 upon a set of four hydraulic jacks (not shown), which lift the drill floor slightly, allowing the placement of skidding shoes 271 beneath each of the two pairs of longitudinal skidding feet 259 and 261. Each approximately 3 inches thick, these shoes 271 allow the drill floor substructure 33 to be skidded onto and off of the upper surface of the skid base 27 without contemporaneous interference from the pairs of transverse skidding feet 263 and 265.

Once the drill floor substructure 33 has been moved entirely onto the skid base, the hydraulic jacks are again placed beneath the jacking pads 269 to lift the drill floor with respect to the skid base, and the skidding shoes 271 are removed from the longitudinal skidding feet (the fore and aft pairs) at the outer ends of the drill floor.

Figure 13A:
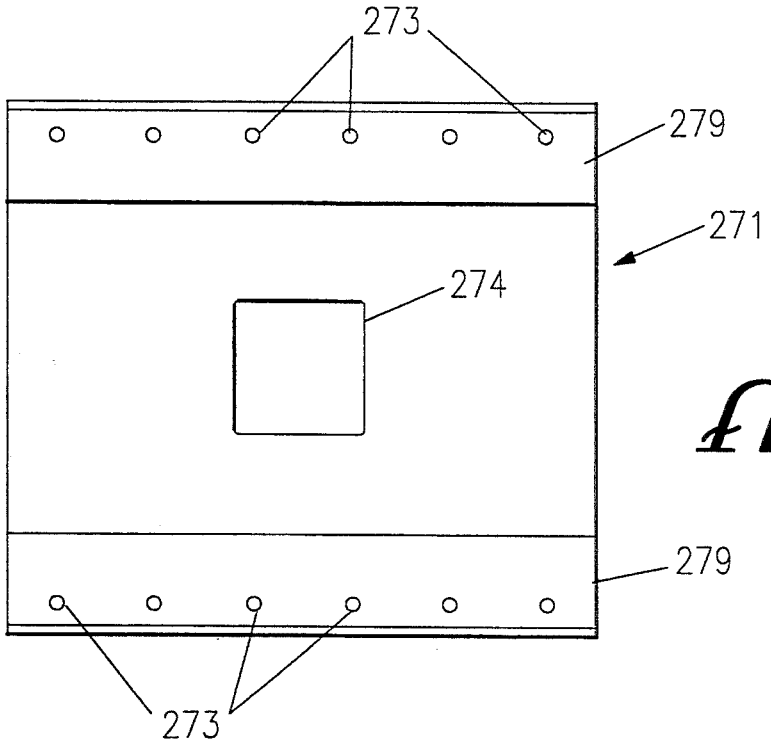
FIG. 13A is a plan view of a skidding shoe that is placed below the fore and aft pairs of longitudinally disposed skidding feet and supporting beams when the drill floor is moved onto and off of the skid base via the cantilever beams.
Figure 13B:
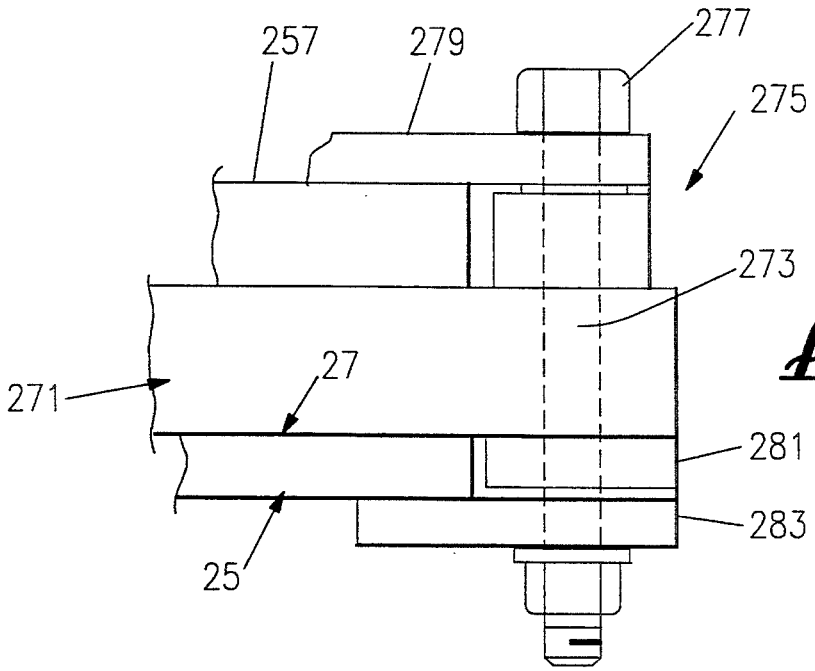
FIG. 13B is a front view of the skidding shoe, also showing a horizontal pad of a skidding foot and a clamp mechanism that affixes the skidding shoe to the horizontal pad during longitudinal movement of the drill floor onto and off of the skid base via the cantilever beams.
Figure 14:
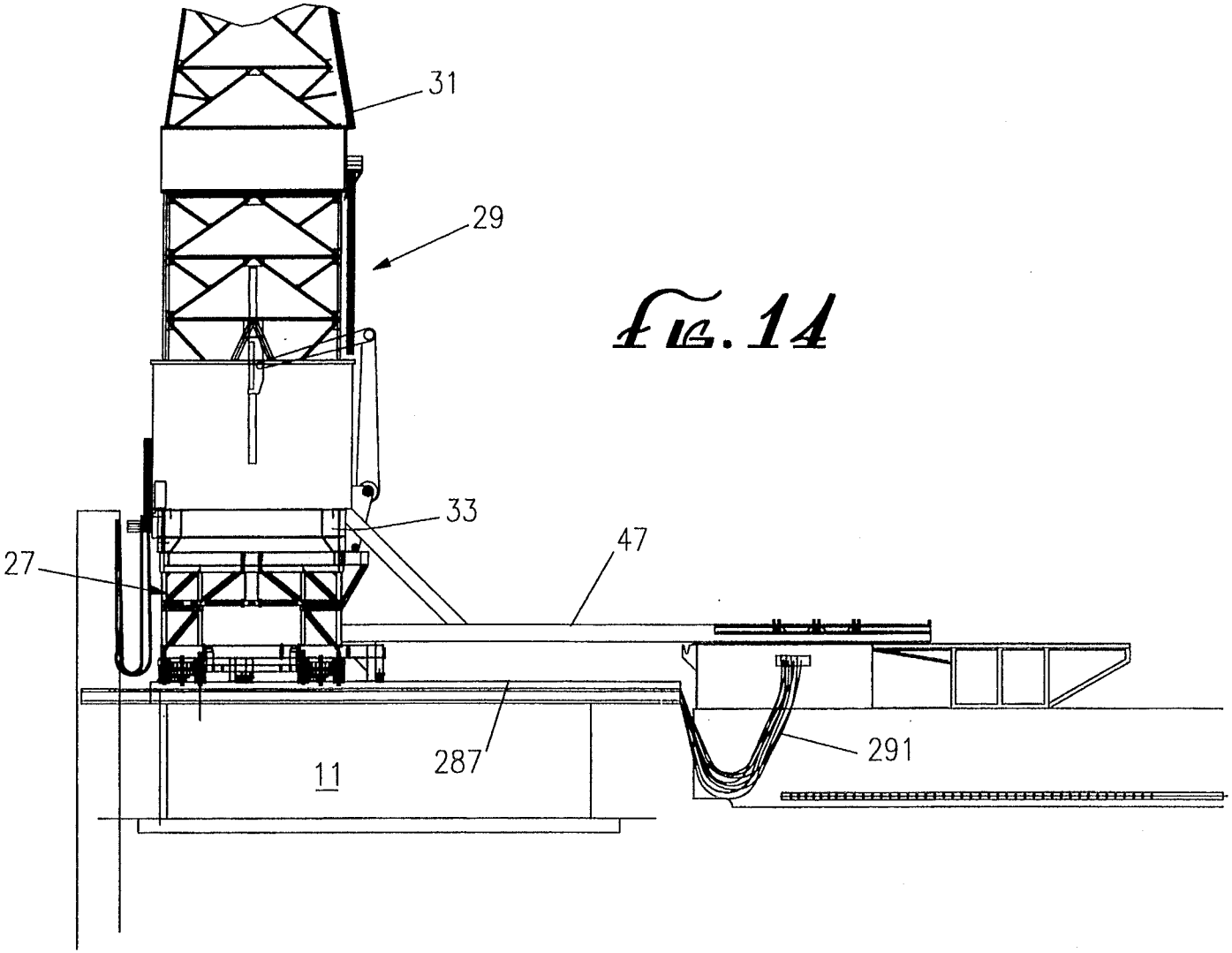
FIG. 14 is a close-up view of the offshore platform and jack-up rig of FIG. 1D, showing a catwalk and "suitcase" piping which run from the drill floor package to the fore end of the capping beams.

As seen in FIGS. 13A and 13B, the skidding shoes are approximately 36 inches long and 32 inches wide and have a number of holes 273 at their transverse sides. The horizontal pad 257 has a slot 274 through its thickness that engages a key block welded to the tip of the shoe, and a clamp mechanism 275 is connected to retain the skidding shoe against the pad of the longitudinal skidding foot. As shown in FIG. 13B, each skidding shoe 271 utilizes a number of eleven-inch by one-inch bolts 277 and an upper retention plate 279 to hold the skidding shoe 271 in contact with the horizontal pad 257 of the skidding foot during skidding movement. During skidding, the resistive force from friction between the skidding shoe and the beam below the shoe is transferred from the shoe to the horizontal pad by the engagement of the key block with the fore or aft end of the slot 274.

During periods when an emergency tie-down is necessary, a lower retention plate 283 may be installed, using the same eleven-inch by one-inch bolt structure to rigidly retain the skidding foot in close contact with the skidding surface.

TENDER ASSIST SUPPORT BETWEEN THE DRILL FLOOR PACKAGE AND THE JACK-UP RIG AFTER POSITIONING OF THE DERRICK

Once a desired drilling position 13 has been determined, the skid base 27 is moved in the fore and aft directions as appropriate to align the skid base longitudinally with the desired drilling position 45. The derrick 31 is then moved in the transverse direction to a position overlying the desired drilling position. As previously indicated, this movement may be accomplished by movement of the skid base 27, using the sliding mountings 63 of the capping beam feet. Preferably, however, the drill floor substructure 33 is skidded transversely upon the upper rails 79.

If piping has not previously been configured, it is necessary, once the equipment is positioned at the desired drilling position, to couple the electrical cables and hydraulic hoses and pipes that help support and control drilling operations.

As best seen in FIG. 3E, a catwalk 47 is extended longitudinally from the cantilever structure 23 to the skid base and drill floor package. In addition, a cable tray 285, service pipe tray 287 and blow-out preventer/-diverter ("BOP") pipe tray 289 carry cables, pipes and hoses between the skid base and the jack-up rig (FIG. 15).

In accordance with the principles of this invention, a pipe "suitcase" is utilized to convey the two aforementioned groups of pipes from the vicinity of the skid base 27 to the fore ends of the capping beams 35, where they may be coupled across the gap by flexible hoses 291 to the jack-up rig 19. As best seen in FIGS. 16B and 19, the blow-out preventer 97 is a large, vertically disposed valve structure which in operation is mounted upon a flange of the well head. The blow-out preventer 97 is stored upon the transversely movable cart 99 within the center cavity 101 of the skid base, so as to be positioned at a desired transverse drilling position 83. A number of flexible hoses 293 couple the blow-out preventer/diverter inputs and outputs to piping within the skid base which runs to the end wall of the skid base, where additional flexible hoses 297 continue these conduits to the longitudinal BOP pipe tray 289, one suitcase 299 of which is shown in FIGS. 17A and 17B.

Figure 17A:
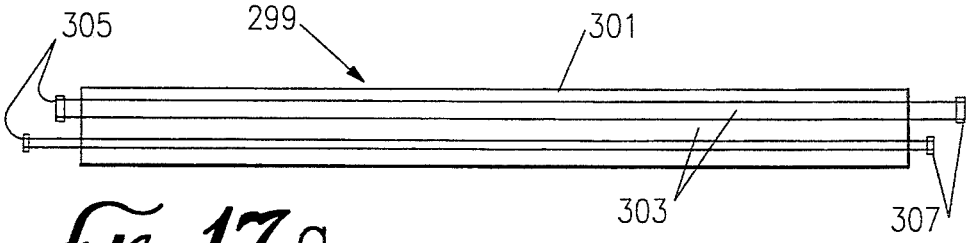
FIG. 17A is a side view of a twelve foot suitcase used to carry pipes to the blow-out preventer and diverter.
Figure 17B:
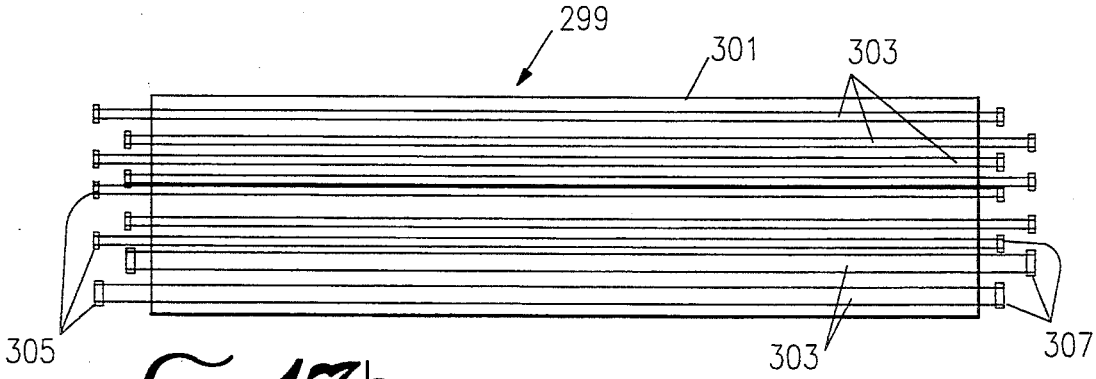
FIG. 17B is a plan view of the suitcase of FIG. 17A, taken along lines 17B—17B.

Each suitcase 299, as seen in FIGS. 17A and 17B, is composed of a steel framework 301 that carries a number of steel hydraulic pipes 303, which support pressures of up to 3000 p.s.i. The pipes 303 are held to structural members of the steel framework by pairs of U-clamps (not shown), which allow the pipes to move somewhat in a longitudinal direction, so that they may be easily coupled to adjoining suitcases. Each suitcase is essentially a fixed length module having a matching cross-section of 3000 p.s.i. hydraulic pipes, so as to readily interface to adjacent modules. At either end of each pipe a "quick disconnect" coupling is provided, for readily and quickly attaching and detaching adjacent modules. Male and female ends 305 and 307 of each coupling feature a solid pipe section, which is welded to the end of the steel pipes, and a freely-rotating male or female nut, threaded for mating engagement.

Once the skid base 27 is positioned longitudinally with respect to the desired drilling position, an appropriate number of suitcases may be quickly and easily installed in fixed-length increments to couple the skid base and jack-up rig 19. In the preferred embodiment, the jack-up rig is equipped with several different types of BOP suitcases, and a number of service pipe suitcases 309 to appropriately couple the drilling equipment to the jack-up rig. Each of these suitcases contains a varied number of pipes and varied clamping mechanisms suited to the particular purpose. For example, the BOP suitcases in the preferred embodiment include four suitcases of 20-foot lengths, each having 37 pipes in 3 unclamped layers. Each of the three layers is separated by a interior truss or other structure, and can slid by approximately a foot longitudinally in order to facilitate connections to other suitcases. The jack-up rig is also equipped with a 30-foot horizontal BOP suitcase, a 12-foot horizontal BOP suitcase, and the L-shaped vertical suitcase 295. In addition, several different service pipe suitcases, including vertical and horizontal and L-shaped, are provided for appropriately configuring the supply of hydraulics to the drilling equipment.

Figure 15B:
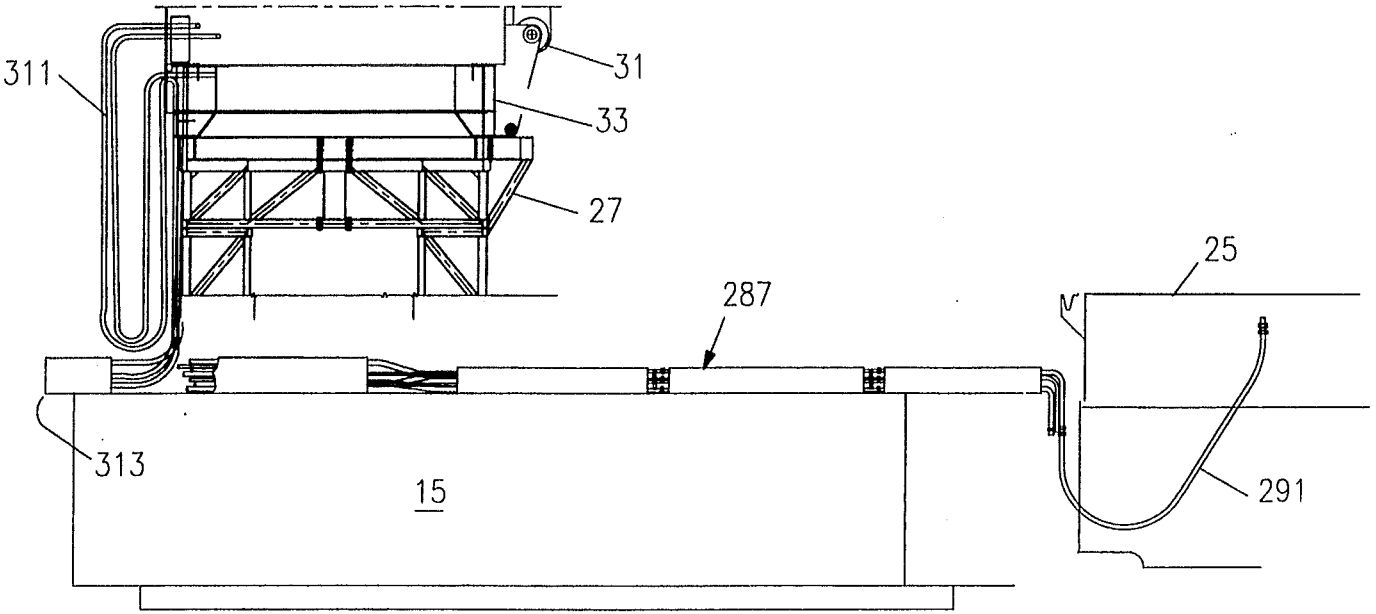
FIG. 15B is a side view of the skid base of FIG. 15A showing the drag chain and surface piping and taken along lines 15B—15B.
Figure 15C:
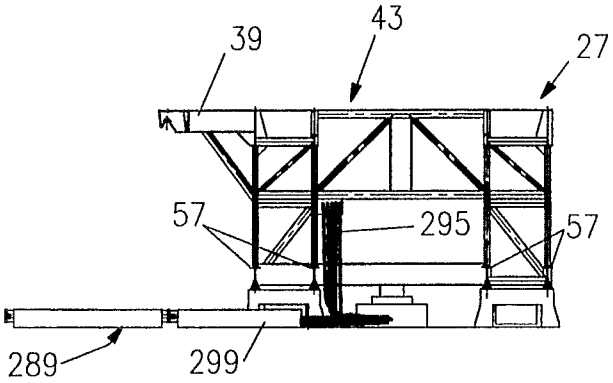
FIG. 15C is another side view of the skid base, showing flexible hose couplings between the blow-out preventer pipe tray and the skid base, taken along lines 15C—15C.
Figure 18A:
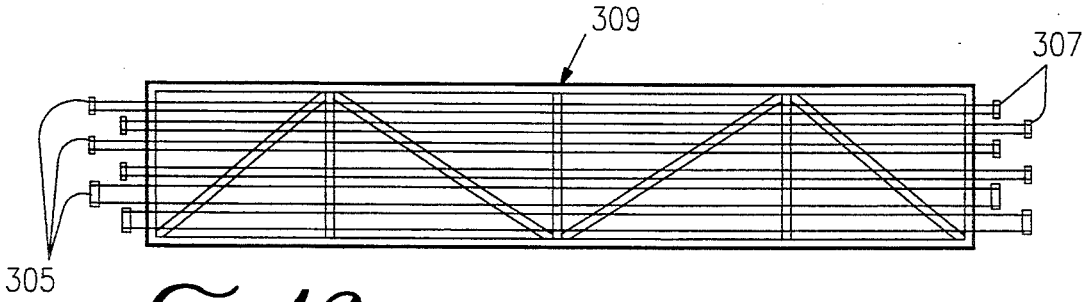
FIG. 18A is a plan view of a service piping suitcase.
Figure 18B:
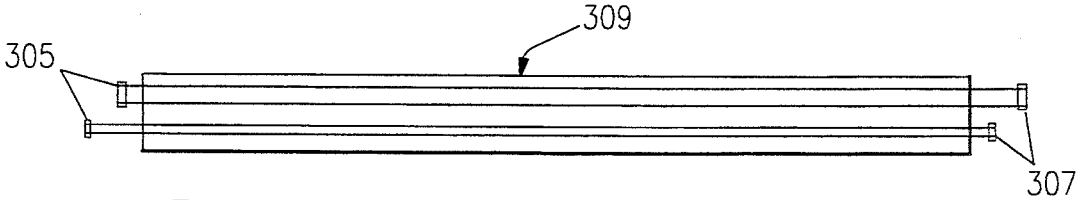
FIG. 18B is a side view of the suitcase of FIG. 18A, taken along lines 18B—18B.
Figure 18C:
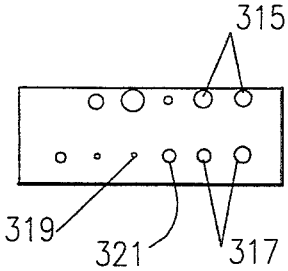
FIG. 18C is a cross-sectional layout of the service piping within the suitcase of FIG. 18A.

As best seen in FIGS. 15A and 15B, the service pipe tray is coupled to the drill floor package 29 to supply fluids and semi-fluids from the jack-up rig 19. These pipes convey fire water, cement, mud, potable water, salt water, and other necessary materials to adjacent the lower surface of the skid base. A number of flexible hydraulic hoses 311 couple these pipes to the end of a drag chain 313 (FIG. 15A and 15B), which allows the drill floor package 29 to move both transversely and longitudinally within a limited range. The drag chain 313 is essentially a bundle of the flexible hoses, and connects at an opposite end to the upper surface of the skid base (FIG. 18). The suitcases that make up this tray (FIG. 18) are of nearly identical construction to the BOP suitcase of FIG. 17, excepting the arrangement and numbering of the pipes. As seen in FIG. 18B, the service pipe suitcases include six inch mud pipes 315, five inch cement pipes 317, potable and salt water pipes 319 and 321, and a number of other conduits as shown.

The service pipe tray runs from adjacent the skid base along the capping beams to the fore end of the offshore platform. Flexible hoses 291 are then also used to complete the connection from the offshore platform 11 across the gap to the jack-up rig 19.

TRANSFER FROM THE FIXED PLATFORM BACK TO THE JACK-UP RIG

After the desired number of wells has been drilled, it is usually desirable to retransfer the skid base 27 and drill floor package 29 onto the jack-up rig 19 for their transport to another facility. This transfer is basically the inverse of the procedure described earlier. In normal operation, the piping and various cable connections and the catwalk 47 would normally have been removed back aboard the jack-up rig in preparation for the retransfer procedure.

The skid base 27 and its load (the drill floor package 29) are advanced upon the synchronized walking motion of each of the four capping beam feet until they reach the fore end of the capping beams. Once the skid base is at the fore end of the capping beams 35, the jack-up rig 19 is elevated or lowered such that the locking structures 41 at the aft ends of its cantilever beams are positioned just below the bottom of the spur beams 39. The pancake jack mechanisms 123 of each of the capping beam feet are then engaged to move the center feet into contact with the capping beams 15, thereby compressing and activating both the swivel mechanisms 61 and the transverse roller sets 145 for powered translation and alignment of the locking slots 69 of the spur beams 39 with the locking structures 41 at the aft ends of the associated cantilever beams 25.

To accomplish this, the synchronized movement of the fore capping beam feet is stopped, and the skid base 27 maintained upon the capping beam feet in free swivelling and transverse relation thereto. The capping beam feet are then appropriately moved either fore or aft to orient the skid base 27 to any misalignment of the cantilever structure 23. In addition, the skid base may be moved transversely upon the capping beam feet using the transverse jack mechanisms 149 to appropriately and exactly align the longitudinal beams 71 of the surface of the skid base with the cantilever beams 25. Once this is accomplished, the cantilever beams 25 are moved to align their locking structures 41 vertically with the locking slots 69. The cantilever beams 25 are then elevated such as to engage the spur beams 39 to thereby lock the skid base and the cantilever beams against relative movement.

The drill floor package 29 is then skidded back onto the cantilever beams. First, the entire drill floor package is elevated and the skidding shoes 279 returned to the longitudinal skidding feet, to thereby maintain the other skidding feet in elevated non-interfering relation with the skid base. The aforementioned dog mechanisms are then utilized to pull the drill floor package 29 in inchworm fashion onto the cantilever beams 25. Once the drill floor package 29 is advanced a sufficient distance in the forward direction, the jack-up rig 19 then lowers its hull down upon its legs 21 until the cantilever beams are at a horizontal level with the capping beams 15. If necessary, the cantilever structure 23 is extended in the aft direction to close an excess gap between the cantilever structure and the fixed platform 11, the capping beams and cantilever beams in nearby relationship, pointing towards each other. The cantilever structure is thereby ready for transference of the skid base 27 onto its upper surface.

Due to the transference of the drill floor package 29 onto the cantilever beams, and the lowering of the cantilever beams 25 and their aftward extension, the skid base 27 should already be positioned with its fore skid-off feet in overlapping alignment with the cantilever beams 25. However, if necessary, the capping beam feet are advanced further forward and,i using the swivelling and sliding procedures just mentioned, positioned to align the fore pair of skid-off feet 49 in overlapping relation with the cantilever beams 25.

The pancake jack mechanism 123 of the fore pair of capping beam feet 53 are then retracted, causing the fore pair of skid-off feet 49 to assume load bearing relation on the upper surfaces of the capping beams. In this state, the L-shaped pivotally mounted flanges 247 of the fore pair of skid-off feet, described earlier, are pivoted downwards so that their flanges clamp the upper surfaces of the cantilever beams 299 in adjacent relationship to the fore pair of skid-off feet. The vertical jack mechanisms 237 of the fore skid-off feet are then stroked so that each of the fore feet are supported upon their sets of freely rotating Hillman rollers 237.

With the fore pair of capping beam feet 53 thereby removed from contact with the capping beams, the skid base is further moved towards the fore end of the capping beams 35, the aft end of the skid base in simultaneously swivelling and side-to-side relationship thereon. That is, as the skid base is "walked" onto the cantilever beams with the fore skid-off feet guiding translation of the skid base in alignment with the cantilever beams, and the aft pair of capping beam feet 55 drive the movement and cooperate to bear the weight of the skid base.

Once the pair of aft skid-off feet 51 are in overlapping relationship to the aft ends of the cantilever beams, they are moved into engaging relationship with the cantilever beams by de-pressurizing the pancake jack mechanisms 123 of the aft pair of capping beam feet 53, following if necessary, powered transverse alignment of the aft end of the skid base through the capping beam feet. The outer legs of the aft skid-off feet are then clamped in adjacent relationship to the cantilever beams.

Thus, as seen in FIG. 2A, the skid base is thereby transferred to again ride entirely upon the cantilever beams. The skid base is then continued in its forward movement, using synchronized walking of the aft pair of skid-off feet 51, towards a desired location on the cantilever beams, and the entire cantilever structure 23 is then retracted aboard the jack-up rig 19 to its stowed condition.

The hull of the jack-up rig 19 may thereafter be lowered to a floating position by retraction of its legs 21, and the legs then raised clear of the sea bed to a stowed position. The jack-up rig is thereby ready for towing to another facility to engage in yet another drilling operation.

The procedures and equipment previously describe provide for a quick and practical installation and removal of drilling equipment aboard a fixed platform. Using this implementation, the drill floor package 29 may be placed over any desired drilling position without the necessity of using a jack-up rig with its cantilever extended under extreme conditions. Similarly, the present system enables the derrick to be quickly and easily placed over any desired drilling position with the aid of the novel foot mechanisms, previously described, and enables modular piping to quickly and easily couple drilling equipment to the jack-up rig using a minimum of flexible tubing, further simplifying installation and movement of the drill floor package.

The techniques and devices just described provide for a system that may be used with any size fixed platform, and thus also provide the flexible and practical approach to service present and future offshore oil production platforms for many years to come. In addition, the device and methods described enable the safe and easy transference of the drill floor package from the jack-up rig to all desired portions of the fixed platform, notwithstanding limited misalignment or relative movement between the two. Undesired side loads are minimized, and importantly, danger to workers may also be minimized.

From the foregoing, it is apparent that various modifications to the preferred embodiment described herein will readily occur to those of skill in the art. For example, the drill floor package may be installed with movement mechanism, or loaded upon the skid base, such that it is not necessary to use spurs and locking slots. Alternatively, the skid-off feet may be made to feature swivel and transverse sliding mechanisms in addition to, or in the alternative to, the capping beam feet. Other differences in the design of the foot mechanisms may also be made without departing from the procedures and mechanisms described herein.

Having thus described an exemplary embodiment of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

We claim:

1. A method of transferring a skid base from a floatable jack-up rig having downwardly extendable legs engageable with the sea bed to raise the rig's hull above the surface of the sea, the jack-up rig supporting the skid base on a pair of spaced parallel cantilever beams extending fore and aft in a longitudinal direction movably mounted on the jack-up rig, to a fixed platform spaced above the sea surface by a fixed plurality of platform legs engaging the sea bed, the fixed platform having a pair of spaced parallel capping beams also extending fore and aft in a longitudinal direction, using, two longitudinally spaced, fore and aft pairs of skid-off feet mounted to the underside of the skid base with one skid-off foot of each pair resting on an associated one of the cantilever beams, the skid-off feet supporting the skid base for longitudinal movement along the cantilever beams, and two longitudinally spaced pairs of fore and aft capping beam feet mounted to the underside of the skid base, the capping beam feet being engageable with the capping beams to support the skid base for longitudinal movement along the capping beams, the aft pair of capping beam feet being spaced aft of the aft skid-off feet and the fore pair of capping beam feet being spaced longitudinally between the fore and aft skid-off feet, each capping beam foot being mounted to the skid base for movement in a direction transversely of the skid base and for swivelling motion about a vertical axis relative to the skid base, said method comprising the steps of:

maneuvering the jack-up rig in its floatable condition towards the fixed platform to a position in which the cantilever beams are generally aligned with and pointing towards the fore ends of the capping beams, in spaced relation thereto;

setting down the legs of the jack-up rig into contact with the sea bed and elevating the rig's hull on the legs until the upper surfaces of cantilever beams are generally on a horizontal level with the upper surfaces of the capping beams, with the longitudinal axis of the cantilever beams limited to not more than a predetermined amount of misalignment relative to the longitudinal axis of the capping beams;

extending the cantilever beams on the jack-up rig aft until the aft ends of the cantilever beams are in closely spaced, adjacent relation to the fore ends of the capping beams;

moving the skid base aft on the cantilever beams, supported by the fore and aft pairs of skid-off feet, until the aft pair of capping beam feet are in overlapping adjacent relationship to the fore ends of the capping beams;

engaging the aft pair of capping beam feet with the capping beams for longitudinal sliding motion therealong end for simultaneous transverse sliding and swivelling movement relative to the skid base;

continuing the aft movement of the skid base, supported by the aft pair of capping beam feet and the fore pair of skid-off feet, until the fore pair of capping beam feet are in overlapping adjacent relationship to the capping beams;

engaging the fore pair of capping beam feet with the capping beams for longitudinal sliding motion therealong and for simultaneous transverse sliding and swivelling movement relative to the skid base; and, thereafter moving the skid base aft along the capping beams, supported on them by the fore and aft pairs of capping beam feet, until the skid base is entirely clear of the cantilever beams whereby the skid base is transferred from the cantilever beams of the jack-up rig to the capping beams of the fixed platform without imposing substantial transverse loads on the capping beams, despite any limited misalignment.

2. The method is described in claim 1, wherein a drill floor package is initially positioned upon the cantilever beams of the jack-up rig forward of the skid base for movement along the cantilever beams, the method including the following further steps after the skid base has been moved entirely clear of the cantilever beams:

withdrawing the cantilever beams in relation to the skid base a distance sufficient to entirely clear them from interference with the capping beams or the skid base;

raising the jack-up rig vertically until the upper surface of the cantilever beam lies in substantially the same horizontal plane as the upper surface of the skid base;

connecting the skid base and the cantilever beams to prevent relative movement between them while providing surfaces lying generally in the same horizontal plane as the upper surface of the skid base; and, moving the drill floor package longitudinally aft on the cantilever beams and onto the upper surface of the skid base.

3. A method of transferring drilling equipment, including a skid base, from a floatable jack-up rig having downwardly extendable legs engageable with the sea bed to raise the rig's hull above the sea surface, the jack-up rig having, a pair of spaced parallel cantilever beams extending fore and aft upon a deck of the jack-up rig in a longitudinal direction and movably mounted on the rig, to a fixed platform supported above the sea surface by platform legs engaging the sea bed, the fixed platform having an elevated pair of spaced parallel capping beams also extending fore and aft in a longitudinal direction, wherein the skid base has mounted on its underside two longitudinally spaced, fore and aft pairs of skid-off feet, and two longitudinally spaced pairs of fore and aft capping beam feet, the skid off feet initially engaging the cantilever beams to support the skid base thereon, each of the aft pair of skit-off feet having a movement mechanism for selectively causing movement of the skid foot longitudinally along the associated cantilever beams in fore or aft directions, the capping beam feet being selectively engageable and dis-engageable from the capping beams and supporting the skid base on the capping beams when engaged therewith, each capping beam foot mounted on at least one skid base beam extending transversely across the underside of the base and having a movement mechanism for selectively causing movement of the capping foot longitudinally along an associated one of the capping beams when engaged therewith in fore or aft directions, a swivel mechanism that permits rotation of the capping foot relative to the skid base, and a sliding mounting that permits movement for the capping foot transversely of the skid base, the method comprising the steps of:

maneuvering the jack-up rig in the floatable condition to a position in which the aft ends of the cantilever beams are generally aligned with and pointing towards the fore ends of the capping beams in spaced relation thereto;

setting down the legs of the jack-up rig into the sea bed and elevating the rig's hull until the upper surfaces of the cantilever beams are in generally the same horizontal plane as the upper surfaces of the capping beams, with not more than a predetermined limit of misalignment between their respective longitudinal axes;

moving the cantilever beams aft from the rig until their aft ends are in close proximity to the fore ends of the capping beams;

selectively operating the skid-off feet movement mechanisms to move the skid base aft along the cantilever beams until the pair of aft capping beam feet are positioned in overlapping relation to the pair of capping beams;

operating the swivel mechanisms and the sliding mountings of the aft pair of capping beam feet to align their movement mechanisms longitudinally with the associated capping beams to compensate for misalignment between the cantilever beams and the capping beams;

engaging the aft pair of capping beam feet with the capping beams for longitudinal motion therealong and for simultaneous swivelling and transverse movement of the skid base upon the aft capping beam feet;

disengaging the aft pair of skid-off feet from the cantilever beams;

continuing the aft movement of the skid base along the capping beams, supported by the aft capping beam feet and the fore skid-off feet, until the fore pair of capping beam feet are positioned in overlapping relation to the capping beams;

operating the swivel mechanisms and the sliding mountings of the fore pair of capping beam feet to align their movement mechanisms longitudinally with the associated capping beams to compensate for misalignment between the cantilever beams and the capping beams less than a predetermined limit;

engaging the fore pair of capping beam feet with the capping beams for longitudinal motion therealong and for simultaneous swivelling and transverse movement of the skid base on the fore capping feet; and disengaging the fore pair of skid-off feet from the cantilever beams, whereby the skid base is transferred from the cantilever beams of the jack-up rig to the capping beams of the fixed platform without imposing substantial transverse loads on the capping beams despite any limited misalignment less than the predetermined limit.

4. The method as described in claim 3, wherein a drill floor package is initially positioned upon the cantilever beams of the jack-up rig forward of the skid base for movement along the cantilever beams, wherein the skid base includes a pair of spur beams projecting forwardly from the forward end of the skid base adjacent its upper surface, and wherein the cantilever beams include locking portions for engaging and disengaging the spur beams against relative longitudinal movement upon relative vertical motion into and out of engagement therewith, the method including the following further steps after the skid base has been transferred to the capping beams:

withdrawing the cantilever beams a short distance until they align vertically with the portions of the spur beams engageable by the locking portions of the cantilever beams;

raising the jack-up rig vertically on its legs until the locking portions of the cantilever beams engage with and lock to the spur beams to prevent relative longitudinal movement between said skid base and the cantilever beams, the upper surface of the skid base, the spur beams and the cantilever beams lying in substantially the same horizontal plane; and moving the drill floor package longitudinally aft on the cantilever beams and across the spur beams onto the upper surface of the skid base.

5. A method according to claim 3, wherein:

the step of operating the swivel mechanisms and the sliding mountings of the aft pair of capping beam feet includes the step of moving the aft capping beam feet along the sliding mountings until each aft capping foot is aligned transversely with its associated one of the capping beams; and, the step of operating the swivel mechanisms and the sliding mountings of the fore capping beam feet includes the step of moving the fore capping beam feet along the sliding mountings until each fore capping foot is aligned transversely with its associated one of the capping beams.

6. A method according to claim 3, the skid base being generally rectangular in plan and having a longitudinal axis, wherein said method further comprises the step, after the skid base has been transferred to the capping beams, of aligning the longitudinal axis of the skid base with the capping beams using the swivelling mechanism and sliding mountings of the capping beam feet.

7. A method of transferring a skid base to a floatable jack-up rig having downwardly extendable legs engageable with the sea bed to raise the rig's hull above the surface of the sea, the jack-up rig adapted to support the skid base on a pair of spaced parallel cantilever beams extending fore and aft in a longitudinal direction movably mounted on the jack-up rig, from a fixed platform spaced above the sea surface by a fixed plurality of platform legs engaging the sea bed, the fixed platform having a pair of spaced parallel capping beams also extending fore and aft in a longitudinal direction that support the skid base thereon, using, two longitudinally spaced, fore and aft pairs of capping beam feet mounted to the underside of the skid base with one capping beam foot of each pair resting on an associated one of the capping beams, the capping beam feet supporting the skid base for longitudinal movement along the capping beams, each capping beam foot being mounted to the skid base for movement in a direction transversely of the skid base and for swivelling motion about a vertical axis relative to the skid base, and two longitudinally spaced pairs of fore and aft skid-off feet mounted to the underside of the skid base, the skid-off feet being engageable with the cantilever beams to support the skid base for longitudinal movement along the cantilever beams, the aft pair of capping beam feet being spaced aft of the aft skid-off feet and the fore pair of capping beam feet being spaced longitudinally between the fore and aft skid-off feet, said method comprising the steps of:

maneuvering the jack-up rig in its floatable condition towards the fixed platform to a position in which the cantilever beams are generally aligned with and pointing towards the fore ends of the capping beams, in spaced relation thereto;

setting down the legs of the jack-up rig into contact with the sea bed and elevating the rig's hull on the legs until the upper surfaces of cantilever beams are generally on a horizontal level with the upper surfaces of the capping beams, with the longitudinal axis of the cantilever beams limited to not more than a predetermined amount of misalignment relative to the longitudinal axis of the capping beams;

extending the cantilever beams on the jack-up rig aft until the aft ends of the cantilever beams are in closely spaced, adjacent relation to the fore ends of the capping beams;

moving the skid base longitudinally forward on the capping beams, supported by the fore and aft pairs of capping beam feet, until the fore pair of skid-off feet are in overlapping adjacent relationship to the aft ends of the cantilever beams;

engaging the fore pair of skid-off feet with the cantilever beams for longitudinal sliding motion therealong and for simultaneous transverse sliding and swivelling movement of the aft pair of capping beam feet relative to the skid base;

continuing the forward movement of the skid base, supported by the aft pair of capping beam feet and the fore pair of skid-off feet, until the aft pair of skid-off feet are in overlapping adjacent relationship to the cantilever beams;

engaging the aft pair of skid-off feet with the cantilever beams for longitudinal sliding motion therealong; and, disengaging the aft pair of capping beam feet from the capping beams, whereby the skid base is transferred to the cantilever beams of the jack-up rig from the capping beams of the fixed platform without imposing substantial transverse loads on the capping beams, despite any limited misalignment.

8. A method according to claim 7, wherein the step of moving the skid base longitudinally forward on the capping beams, supported by the fore and aft pairs of capping beam feet, until the fore pair of skid-off feet are in overlapping adjacent relationship to the aft ends of the cantilever beams, further includes the step of advancing the capping beam feet non-synchronously and thereby causing transverse sliding and swivelling movement of the aft pair of capping beam feet relative to the skid base to thereby place the fore pair of skid-off feet in overlapping adjacent relationship to the aft ends of the cantilever beams, despite any limited misalignment.

9. An offshore drilling system comprising:

a floatable jack-up rig having downwardly extendable legs engageable with the sea bed to raise the rig's hull from the sea surface, said rig having a pair of cantilever beams extending fore and aft in a longitudinal direction;

a fixed platform supported above the sea bed suspended by legs engaged with the sea bed having a pair of capping beams extending fore and aft in a longitudinal direction;

said jack-up rig in its floatable condition being maneuvered to a position in which the aft ends of said cantilever beams are positioned adjacent to the fore ends of said capping beams and the hull of said jack-up rig thereafter being raised by engaging said downwardly extendable legs with the sea bed and elevating the rig's hull on said legs, to align a longitudinal axis of said jack-up rig with a longitudinal axis of said fixed platform;

said cantilever beams being extended in the same horizontal plane as said capping beams toward and closely spaced from the fore ends of said capping beams at less than a predetermined amount of misalignment between the longitudinal axes of said capping and said cantilever beams;

a generally rectangular skid base resting on said cantilever beams for longitudinal movement therealong to be transferred to said capping beams;

two longitudinally spaced fore and aft pairs of skid-off feet mounted to the underside of said skid base with one skid-off foot of each pair resting on an associated one of said cantilever beams, said skid-off feet supporting said skid base for longitudinal movement along said cantilever beams;

two longitudinally spaced fore and aft pairs of capping beam feet mounted to the underside of said skid base, the aft pair of capping beam feet being spaced aft of the aft pair of said skid-off feet and the fore pair of capping beam feet being spaced longitudinally between the fore and aft pairs of skid-off feet, each said capping beam foot being mounted to said skid base for movement in a direction transversely of said skid base and for swivelling movement about a vertical axis relative to said skid base;

said capping beam feet engaging said capping beams for longitudinal movement therealong while enabling simultaneous transverse and swivelling motion relative to said skid base during transfer of said skid base from said cantilever beams to said capping beams; and, whereby transfer of said skid base from said jack-up rig to said fixed platform can occur with reduced imposition of side loads on said capping beams, despite any misalignment less than the predetermined amount.

10. An offshore drilling system according to claim 9, further including:

a drill floor package initially mounted on said cantilever beams of said jack-up rig, forward of said skid base, for movement along said cantilever beams, a pair of spur beams projecting forwardly from the forward end of said skid base adjacent to its upper surface, said spur beams having a downward-facing locking slot adjacent their forward ends;

said cantilever beams having a locking pin secured to their forward ends moveable vertically into and out of said locking slot in an associated one of said spur beams;

said rig, subsequent to transfer of said skid base to said capping beams, being raised vertically on its legs to cause said locking pin to enter said locking slots to cause said cantilever beams to become locked to said skid base against relative longitudinal separation with the upper surfaces of said skid base, said spur beams and said cantilever beams lying in substantially the same horizontal plane; and, whereby said drill floor package may be moved aft along said cantilever beams and across said spur beams onto said skid base.

11. An offshore platform used in drilling oil and gas wells, comprising:

a drill floor package having a derrick and a drill floor substructure supporting said derrick;

a platform supported above the surface of the water by legs engaging the sea bed, said platform having two beams that horizontally run from a fore portion of said platform to an aft portion; and, a skid base supporting said drill floor package, said skid base having a plurality of separate feet that vertically extend downward from an underside of said skid base into engagement with said beams, each foot including a movement mechanism that selectively provides axial movement of each said foot in relation to said beams when engaged, said movement mechanism including a walking mechanism having at least two legs that alternately support said skid base, and that also move between two relative spaced positions, whereby said skid base may move upon said beams and support said skid base substantially out of contact with said beams during axial movement, such that said skid base may be moved along said beams without substantial sliding friction between said beams and said skid base.

12. An offshore platform according to claim 11, wherein:

said skid base mounts upper rails, said upper rails running from side-to-side; and, said drill floor package being supported thereon for transverse motion of said derrick relative to said skid base.

13. An offshore platform used in drilling oil and gas wells, said offshore platform being attended by a jack-up rig positioned closely nearby, the jack-up rig having two parallel cantilever beams each having a locking pin, said offshore platform comprising:

a drill floor package having a derrick and a drill floor substructure supporting said derrick;

a fixed platform supported above the surface of the water by legs engaging the sea bed, said fixed platform having two capping beams that horizontally run from a fore portion of said fixed platform to an aft portion; and, a skid base supporting said drill floor package, said skid base having a plurality of separate capping beam feet that vertically extend downward from an underside of said skid base into engagement with said capping beams, each capping beam foot including a movement mechanism that selectively provides axial movement of said skid base in relation to said capping beams when engaged, thereby enabling said skid base to move in relation to said capping beams upon said feet, an upper surface of said skid base, said drill floor package being supported thereon for transverse motion of said derrick relative to said skid base, and two spur beams that each mount a locking slot, said locking slot adapted to engage a locking pin of a corresponding cantilever beam, said locking slot mounted in relation to said locking pin such that an upper side of said spur beams align, when said locking pin is engaged with said locking slot, in flush rigid alignment with the upper surfaces of the cantilever beams of the jack-up rig;

wherein the upper surfaces of said spur beams are thereby adapted to support the transfer said drill floor package between the cantilever beams of the jack-up rig and said upper surface of said skid base.

14. An offshore platform for drilling oil and gas wells, said offshore platform being attended by a jack-up rig having two parallel cantilever beams that are extended in generally adjacent parallel orientation to said capping beams, comprising:

a drill floor package having a derrick and a drill floor substructure supporting said derrick;

a fixed platform supported above the surface of the water by legs engaging the sea bed, said fixed platform having two capping beams that horizontally run from a fore portion of said fixed platform to an aft portion; and, a skid base supporting said drill floor package, said skid base having two distinct sets of feet including a plurality of separate capping beam feet that vertically extend downward from an underside of said skid base into engagement with said capping beams, each capping beam foot including a movement mechanism that selectively provides axial movement of said skid base in relation to said capping beams when engaged, thereby enabling said skid base to move in relation to said capping beams upon said feet, and a plurality of skid-off feet that are also vertically disposed beneath said skid base and are adapted to be engaged with the cantilever beams and to support said skid base thereon; and, wherein at least two of said skid-off feet also each include a movement mechanism that provides movement to said skid base upon said skid-off feet between said fore and aft portions of the jack-up rig.

15. An offshore platform according to claim 14, wherein:

said skid base includes at least one skid base beam that extends from side-to-side on the underside of said skid base, said skid base beams adapted to extend across a space between said cantilever beams and to support said skid base with respect to said cantilever beams, at least one of said skid base beams mounting a pair of said capping beam feet;

said capping beam feet each include a swivel mechanism that enables said movement mechanism of each capping beam foot to be swivelled with respect to said skid base beams, such that the axial movement of said movement mechanisms may be oriented to use said capping beams as rails, notwithstanding limited misalignment between the two, and, a sliding mounting that mounts each said capping beam foot to said skid base beams for movement transversely to said skid base, such that said movement mechanism may be moved transversely with respect to said skid base beams, and such that axial movement of said movement mechanisms may be aligned to use said capping beams as rails, notwithstanding limited misalignment between the two.

16. An offshore platform according to claim 15, wherein:

said skid base includes at least one of said skid base beams mounting each said skid-off foot;

said skid-off feet include at least two fore skid-off feet that are the first skid-off feet to support said skid base upon the cantilever beams when said skid base is loaded from said offshore platform to the jack-up rig, each of said fore skid-off feet including a sliding mounting that mounts said fore skid-off feet to mounting ones of said skid base beams, such that said fore skid-off feet may be transversely aligned to use the cantilever beams as rails, notwithstanding any misalignment between the two.

17. An offshore platform according to claim 14, wherein:

said capping beam feet include at least two aft capping beam feet that are the first capping beam feet to be moved upon said capping beams when said skid base is loaded to said offshore platform from the jack-up rig;

said skid-off feet include at least two aft skid-off feet that are the first skid-off feet to be removed from said skid base upon the cantilever beams when said skid base is loaded to said offshore platform from the jack-up rig; and said offshore platform further comprises an aft vertical jack mechanism, moveable between retracted and extended positions, for causing weight of said skid base to be transferred to the cantilever beams from said capping beams (as said aft skid-off feet are engaged with the cantilever beams and said capping beam feet are disengaged with said capping beams, by relative lengthening of said aft skid-off feet in relation to said aft capping beam feet by said vertical jack means) and from the cantilever beams to said capping beams (as said aft skid-off feet are shortened relative to said capping beam feet by said vertical jack means, thereby disengaging said aft skid-off feet with the cantilever beams and causing said aft capping beam feet to engage said capping beams and support said skid base thereon).

18. An offshore platform for drilling oil and gas wells comprising:

a drill floor package having a derrick and a drill floor substructure supporting said derrick;

a fixed platform supported above the surface of the water by legs engaging the sea bed, said fixed platform having two capping beams that horizontally run from a fore portion of said fixed platform to an aft portion;

a skid base supporting said drill floor package, said skid base having a plurality of separate capping beam feet that vertically extend downward from an underside of said skid base into engagement with said capping beams, each capping beam foot including a movement mechanism that selectively provides axial movement of said skid base in relation to said capping beams when engaged, thereby enabling said skid base to move longitudinally upon said capping beam feet;

a source of fluids and semi-solids for supporting drilling operations of said drill floor package; and piping for connecting said drill floor package with said source across a distance dimension that changes as said skid base is moved upon said capping beams, said piping including a plurality of discrete pipe modules, each module having a plurality of conduits of predetermined arrangement, all of said conduits in a given module having substantially the same length, such that modules may be coupled in modular format to form said piping and may be individually added or subtracted as said skid base is moved longitudinally upon said capping beams.

19. A skid base adapted to support a drill floor package, and further adapted be transferred between capping beams of an offshore platform and cantilever beams of a jack-up rig, said skid base comprising:

a skid structure having an upper surface adapted to support the drill floor package, and an underside of sufficient width to be supported upon both of the capping beams and the cantilever beams;

a plurality of foot assemblies mounted by and disposed vertically below said underside of said skid structure, each of said plurality of foot assemblies adapted to be engaged with support beams that are one of the capping beams and the cantilever beams and adapted to bear weight of, and to support, said skid base upon said support beams;

wherein each foot assembly is mounted to said skid base by an adjustable mounting that permits said plurality of foot assemblies to be varied in their relative spacings from one another along a width dimension of said underside, such that said plurality of foot assemblies may be aligned in their relative spacings to match a spacing associated with the said supporting beams.

20. A skid base according to claim 19, wherein at least one foot assembly includes a movement mechanism that is adapted to provide relative axial movement between said skid base and said supporting beam.

21. A skid base according to claim 20, wherein:

said movement mechanism provides relative axial movement; and, each of said foot assemblies having said movement mechanism also includes a swivel mechanism that enables said walking mechanism to be swivelled and aligned with said support beam for movement therealong.

22. A skid base according to claim 19, wherein said skid base further comprises at least one transverse base extension mounted to a flank of said skid structure for increasing the width of said underside and increasing a range of relative transverse movement of said foot assembly relative to said underside.

23. A foot assembly that supports a drill floor package upon the upper surface of an offshore platform, wherein the drill floor package is supported by parallel mounting beams and wherein the upper surface of the offshore platform has parallel capping beams that bear the load of the drill floor package, the parallel mounting beams being generally perpendicular in orientation to the parallel capping beams, the foot assembly comprising:

a first movement mechanism including a first bearing surface that allows relative motion of said foot assembly upon one of the parallel capping beams along a first linear direction;

a second movement mechanism including a second bearing surface that mounts said first movement mechanism to at least one of the parallel mounting beams and that allows relative motion between said foot assembly and the parallel mounting beams, the drill floor package supported thereby, along a second linear direction of the parallel mounting beams; and, a swivel mechanism positioned between said first movement mechanism and said second movement mechanism, for permitting relative swivelling movement therebetween.

24. A jack-up rig used to assist the drilling of oil and gas wells aboard a fixed platform, the fixed platform supported above the bed of the sea and having two parallel capping beams that run horizontally from a fore portion of the fixed platform to an aft portion, said jack-up rig comprising:

a jack-up body supporting two parallel cantilever beams each having a locking pin, said jack-up body also having legs extendable to elevate at said cantilever beams to a level above the sea bed at which it is substantially elevated to a level of the fixed platform above the sea bed;

a drill floor package having a derrick and a drill floor substructure supporting said derrick;

a skid base supporting said drill floor package, said skid base having a plurality of separate capping beam feet that vertically extend downward from an underside of said skid base for engagement with said capping beams, each capping beam foot including a movement mechanism that selectively provides axial movement of said skid base in relation to said capping beams when engaged, thereby enabling said skid base to move in relation to said capping beams upon said feet, an upper surface of said skid base, said drill floor package being supported thereon for transverse motion of said derrick relative to said skid base, and two spur beams that each mount a locking slot that is adapted to engage said locking pin of a corresponding cantilever beam, said locking slot mounted in relation to said locking pin such that an upper side of said spur beams align, when said locking pin is engaged with said locking slot, in flush rigid alignment with the upper surfaces of the cantilever beams of the jack-up rig;

wherein the upper surfaces of said spur beams are thereby support the transfer said drill floor package between the cantilever beams of the jack-up rig and said upper surface when said skid base is transferred to and supported by the capping beams of the fixed platform.

* * * * *